US007303864B2

(12) United States Patent
Ohzeki

(10) Patent No.: US 7,303,864 B2
(45) **Date of Patent: *Dec. 4, 2007**

(54) BLACK AND WHITE PHOTOTHERMOGRAPHIC MATERIAL AND IMAGE FORMING METHOD

(75) Inventor: Tomoyuki Ohzeki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/090,495

(22) Filed: Mar. 28, 2005

(65) Prior Publication Data

US 2005/0214702 A1 Sep. 29, 2005

(30) Foreign Application Priority Data

Mar. 29, 2004 (JP) ..... 2004-097152
Jan. 25, 2005 (JP) ..... 2005-017163

(51) Int. Cl.
*G03C 1/494* (2006.01)

(52) U.S. Cl. ..... 430/617; 430/618; 430/619; 430/620; 430/567; 430/570

(58) Field of Classification Search ..... 430/567, 430/570, 617, 618, 619, 620
See application file for complete search history.

(56) References Cited

U.S. PATENT DOCUMENTS 5,637,449 A * 6/1997 Harring et al. ..... 430/619
6,576,410 B1 * 6/2003 Zou et al. ..... 430/350
2003/0224307 A1 * 12/2003 Yamamoto et al. ..... 430/568
2004/0131983 A1 * 7/2004 Ohzeki et al. ..... 430/619
2004/0137389 A1 * 7/2004 Fukui et al. ..... 430/619

* cited by examiner

*Primary Examiner*—Hoa Van Le
(74) *Attorney, Agent, or Firm*—Margaret A. Burke; Sheldon J. Moss

(57) ABSTRACT

The invention provides a black and white photothermographic material comprising an image forming layer containing on at least one side of a support at least a photosensitive silver halide, a non-photosensitive organic silver salt, a reducing agent for silver ions, and a binder, wherein:

the non-photosensitive organic silver salt comprises at least one compound selected from a silver salt of an azole compound or a silver salt of a mercapto compound;

and the photothermographic material further comprises, a compound that can be one-electron-oxidized to provide a one-electron oxidation product which releases one or more electrons, and an adsorptive redox compound having a group adsorbable to the silver halide and a reducing group in the molecule. The invention provides a black and white photothermographic material having high image quality and an excellent storability, and an image forming method.

24 Claims, 1 Drawing Sheet

BLACK AND WHITE PHOTOTHERMOGRAPHIC MATERIAL AND IMAGE FORMING METHOD

CROSS-REFERENCE TO RELATED APPLICATION

This application claims priority under 35 USC 119 from Japanese Patent Application Nos. 2004-97152 and 2005-17163, the disclosures of which are incorporated by reference herein.

BACKGROUND OF THE INVENTION

1. Field of the Invention

The present invention relates to a black and white photothermographic material and an image forming method. More particularly, the invention relates to a black and white photothermographic material having high image quality and excellent storability, and an image forming method thereof.

2. Description of the Related Art

In recent years, in the medical field and the graphic arts field, there has been a strong desire for making the photographic process dry from the viewpoints of protecting the environment and economy of space. Further, the development of digitization in these fields has resulted in the rapid development of systems in which image information is captured and stored in a computer, and then when necessary processed and output by transmitting it to a desired location. Here the image information is output onto an image forming material using a laser image setter or a laser imager, and developed to form an image at the location. It is necessary for the image forming material to be able to record an image with high-intensity laser exposure and that a clear black-tone image with a high resolution and sharpness can be formed. While various kinds of hard copy systems using pigments or dyes, such as ink-jet printers or electrophotographic systems, have been distributed as general image forming systems using such digital imaging recording materials, images on the digital imaging recording materials obtained by such general image forming systems are insufficient in terms of the image quality (sharpness, granularity, gradation, and tone) needed for medical images used in making diagnoses, and high recording speeds (sensitivity). These kinds of digital imaging recording materials have not reached a level at which they can replace medical silver halide film processed with conventional wet development.

Black and white photothermographic materials utilizing organic silver salts are already known. Generally, the black and white photothermographic material has an image forming layer in which a photosensitive silver halide, a reducing agent, a reducible silver salt (for example, an organic silver salt), and if necessary, a toner for controlling the color tone of developed silver images, are dispersed in a binder.

Black and white photothermographic materials form a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which black and white photothermographic materials are described, and the Fuji Medical Dry Imager FM-DP L is an example of a medical image forming system that has been made commercially available.

A black and white photothermographic material using a silver salt of a nitrogen-containing heterocyclic compound as an organic silver salt and a hydrophilic binder such as gelatin is disclosed in U.S. Pat. No. 6,576,410.

SUMMARY OF THE INVENTION

A first aspect of the invention provides a black and white photothermographic material comprising, on at least one side of a support, an image forming layer comprising at least a photosensitive silver halide, a non-photosensitive organic silver salt, a reducing agent for silver ions, and a binder, wherein:

the non-photosensitive organic silver salt comprises at least one compound selected from a silver salt of an azole compound or a silver salt of a mercapto compound;

and the black and white photothermographic material further comprises at least one compound selected from a compound that can be one-electron-oxidized to provide a one-electron oxidation product which releases one or more electrons or an adsorptive redox compound having a group adsorbable to the silver halide and a reducing group in a molecule.

A second aspect of the invention provides an image forming method using the black and white photothermographic material according to the first aspect, wherein the method comprises:

(a) providing an assembly for forming an image by placing the black and white photothermographic material between a pair of fluorescent intensifying screens;
(b) putting an analyte between the assembly and an X-ray source;
(c) irradiating the analyte with X-rays having an energy level in a range of 25 kVp to 125 kVp;
(d) taking the black and white photothermographic material out of the assembly; and
(e) heating the removed black and white photothermographic material in a temperature range of 90° C. to 180° C.

DETAILED DESCRIPTION OF THE INVENTION

Figure 1:
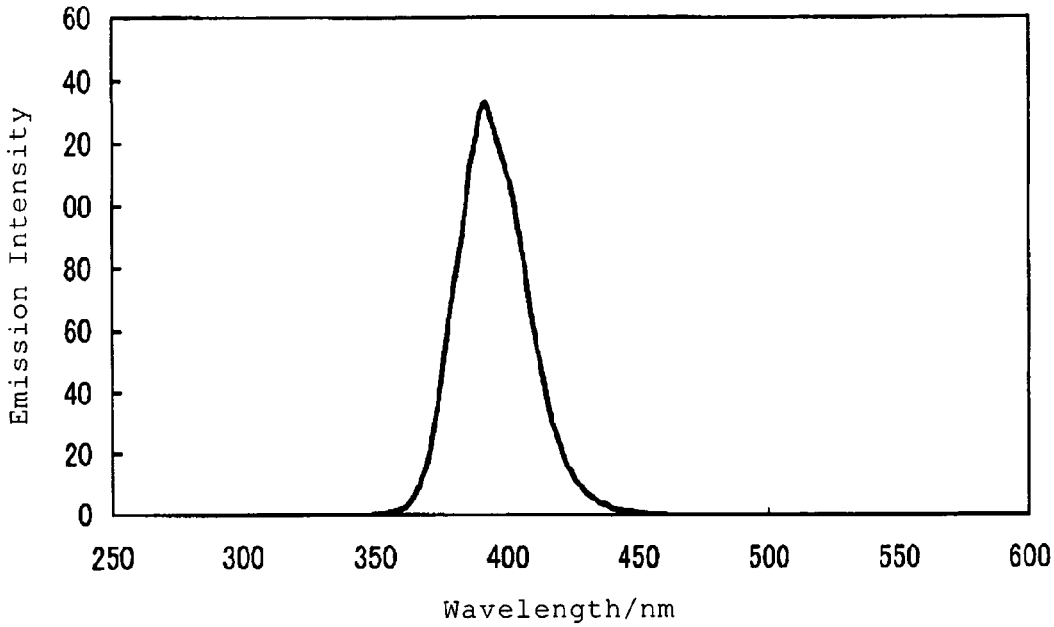
FIG. 1 shows an emission spectrum of a fluorescent intensifying screen.

An object of the present invention relates to an improved black and white photothermographic material and an improved method of forming an image. Particularly, an object of the present invention is to provide a black and white photothermographic material which has high sensitivity, high image quality, excellent raw stock storability, and excellent image storability, and a method of forming an image.

For black and white photothermographic materials in which a silver salt of a nitrogen-containing heterocyclic compound is used as the organic silver salt, there exists a problem that diagnosis ability is lowered, because of sensitivity being low and color tone of developed silver images being yellowish brown. So that improvement for medical-purpose images has been required. Furthermore, another problem that has become obvious is that storage stability during storage prior to use for forming image after coating (herein referred to as "raw stock storability") and image storability were poor. The inventors found that the use of novel sensitizers of the present invention can provide an effective means for solving the above problems, and thereby arrived at the black and white photothermographic material of the present invention.

Moreover, the use of the black and white photothermographic materials of the present invention can provide an improved image forming method for medical use.

The present invention will be described in detail below.

1. Black and White Photothermographic Material

In the present invention, a photographic characteristic curve is a D-log E curve representing a relationship between the common logarithm (log E) of light exposure value, i.e., the exposure energy, and the optical density (D), i.e., a scattered light photographic density, by plotting the former on the abscissa axis and the latter on the ordinate axis.

Sensitivity in the present invention means the reciprocal of the light exposure value necessary to give a density of fog+(optical density of 1.0).

Gradation in the present invention is expressed as a gradient of a line joining the points at fog+(optical density of 0.25) and fog+(optical density of 2.0) on the photographic characteristic curve (i.e., the value equals tan θ when the angle between the line and the horizontal axis is θ). In the present invention, an average gradient is from 1.8 to 4.3, and preferably from 2.2 to 3.2.

The black and white photothermographic material of the present invention has, on at least one side of a support, an image forming layer comprising a photosensitive silver halide, a non-photosensitive organic silver salt, a reducing agent, and a binder. The image forming layer of the present invention may be disposed on one side, or may be disposed on both sides of the support. Further preferably, the image forming layer may have disposed thereon a surface protective layer, or a back layer, a back protective layer, or the like may be disposed on the opposite side of the image forming layer with respect to the support.

As an embodiment of the black and white photothermographic material of the present invention, the photothermographic material comprises a compound that can be one-electron-oxidized to provide a one-electron oxidation product which releases one or more electrons (afterwards sometimes referred to as an electron releasing compound.).

The compound that can be one-electron-oxidized to provide a one-electron oxidation product which releases one or more electrons is preferably at least one compound selected from the following Groups 1 or 2:

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

More preferably, the compounds of Groups 1 and 2 have an adsorptive group to silver halide or a partial structure of a spectral sensitizing dye in a molecule.

As another embodiment of the black and white photothermographic material of the present invention, the photothermographic material comprises an adsorptive redox compound having an adsorptive group to silver halide and a reducing group in a molecule (afterwards sometimes referred to as an adsorptive redox compound.).

It is preferred that the adsorptive redox compound having an adsorptive group to silver halide and a reducing group in a molecule is represented by the following formula (I).

$$A\text{-}(W)n\text{-}B \qquad \text{Formula (I)}$$

In formula (I), A represents a group capable of adsorption to a silver halide (hereafter, it is called an adsorptive group), W represents a divalent linking group, n represents 0 or 1, and B represents a reducing group.

The non-photosensitive organic silver salt of the invention contains at least one salt selected from a silver salt of an azole compound or a silver salt of a mercapto group.

The non-photosensitive organic silver salt of the invention is preferably a silver salt of a nitrogen-containing heterocyclic compound, more preferably at least one salt selected from a silver salt of a triazole compound or a silver salt of a tetrazole compound, and particularly preferably a silver salt of a benzotriazole compound.

An alternative preferred non-photosensitive organic silver salt is at least one selected from a silver salt of an aliphatic mercapto compound or a silver salt of a heterocyclic mercapto compound, and more preferably a silver salt of an aliphatic mercapto compound having 10 or more carbon atoms.

The constitutions and preferable components of these layers will be explained in detail below.

(Photosensitive Silver Halide)

1) Halogen Composition

For the photosensitive silver halide used in the invention, there is no particular restriction on the halogen composition and silver chloride, silver chlorobromide, silver bromide, silver iodobromide, silver iodochlorobromide and silver iodide can be used. Of these, silver bromide, silver iodobromide, and silver iodide are preferable.

One of the preferable photosensitive silver halide used in the invention has an average silver bromide content of 60 mol % or higher, and more preferably 80 mol % or higher.

Another preferable photosensitive silver halide used in the invention has a high average silver iodide content of 40 mol % or higher, more preferably 80 mol % or higher and, further preferably 90 mol % or higher.

Other components are not particularly limited and can be selected from silver chloride, silver chlorobromide, silver bromide, silver iodobromide, silver iodochlorobromide, silver iodide, and the like.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. Further, a technique of localizing silver bromide or silver iodide to the surface of a silver chloride, silver bromide, or silver chlorobromide grains can also be used preferably.

2) Method of Grain Formation

The method of forming photosensitive silver halide is well-known in the relevant art and, for example, methods described in Research Disclosure No. 17029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in Japanese Patent Application Laid-Open (JP-A)

No. 11-119374 (paragraph Nos. 0217 to 0224) and methods described in JP-A Nos. 11-352627 and 2000-347335 are also preferred.

According to the method of forming tabular grains, preferably used are those described in JP-A Nos. 59-119350 and 59-119344. As for forming dodecahedral grains, tetradecahedral grains, and octahedral grains, the methods described in JP-A Nos. 2002-081020, 2003-287835, and 2003-287836 can be used for reference.

3) Grain Size

The photosensitive silver halide is preferably tabular grains having a mean aspect ratio of 2 or more, and more preferably tabular grains having a mean aspect ratio of 5 or more. A mean equivalent spherical diameter is preferably 0.3 μm to 8 μm, and more preferably 0.5 μm to 5 μm. The term "equivalent spherical diameter" used in the invention means a diameter of a sphere having the same volume as the volume of tabular silver halide grain.

The tabular silver halide grains of the invention preferably have a mean thickness of 0.3 μm or less, more preferably 0.2 μm or less and, further preferably 0.1 μm or less.

4) Grain Form

While examples of forms of silver halide grains in the invention can include cubic grains, octahedral grains, tabular grains, spherical grains, rod shape grains, potato-like grains and the like, particularly preferable in the invention are tabular grains.

Silver halide grains which are rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or more, more preferably 65% or more and, further preferably 80% or more. The ratio of the {100} face, Miller index, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferably, the photosensitive silver halide grain can contain metals or complexes of metals belonging to groups 6 to 10 of the periodic table. The metal or the center metal of the metal complex from groups 6 to 10 of the periodic table is preferably ferrum, rhodium, ruthenium, or iridium. The metal complex may be used alone, or two or more kinds of complexes comprising identical or different species of metals may be used together. The content is preferably in a range from $1\times10^{-9}$ mol to $1\times10^{-3}$ mol per 1 mol of silver. The heavy metals, metal complexes and the addition method thereof are described in JP-A No. 7-225449, in paragraph Nos. 0018 to 0024 of JP-A No. 11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion, and lithium ion, ammonium ion, and alkyl ammonium ion (for example, tetramethyl ammonium ion, tetraethyl ammonium ion, tetrapropyl ammonium ion, and tetra(n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization, and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of an emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous silver nitrate just before completion of grain formation, it can be adsorbed to the outermost surface of the silver halide grain and most of them form an insoluble salt with silver ions on the surface of the grain. Since silver salt of hexacyano iron (II) is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained in the photosensitive silver halide emulsion used in the invention, various kinds of gelatins can be used. It is necessary to maintain an excellent dispersion state of a photosensitive silver halide emulsion in a coating solution containing an organic silver salt, and gelatin having a molecular weight of 10,000 to 1,000,000 is preferably used. And phthalated gelatin is also preferably used. These gelatins may be used at grain formation or at the time of dispersion after desalting treatment and it is preferably used at grain formation.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306. The sensitizing dyes described above may be used alone or two or more of them may be used in combination. In the invention, sensitizing dye can be added preferably after a desalting step and before a coating step, and more preferably after a desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide in the present invention can be used without chemical sensitization, but is preferably chemically sensitized by at least one of a chalcogen sensitizing method, gold sensitizing method and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea, or carboxymethyltrimethylthiourea), thioamides (e.g., thioacetamide), rhodanines (e.g., diethylrhodanine or 5-benzylydene-N-ethylrhodanine), phosphinesulfides (e.g., trimethylphosphinesulfide), thiohydantoins, 4-oxo-oxazolidin-2-thiones, disulfides or polysulfides (e.g., dimorphorinedisulfide, cystine, or lenthionine (1,2,3,5,6-pentathiepane)), polythionates, and sulfur element, and active gelatin can be used. Specifically, thiosulfates, thioureas, and rhodanines are preferred.

In selenium sensitization, unstable selenium compounds can be used. These unstable selenium compounds are described in Japanese Patent Application Publication (JP-B) Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea, or acetyltrimethylselemourea), selenoamides (e.g., selenoamide or N,N-diethylphenylselenoamide), phosphineselenides (e.g., triphenylphosphineselenide or pentafluorophenyltriphenylphosphineselenide), selenophosphates (e.g., tri-p-tolylselenophosphate or tri-n-butylselenophosphate), selenoketones (e.g., selenobenzophenone), isoselenocyanates, selenocarbonic acids, selenoesters, diacylselenides, or the like can be used. Furthermore, non-unstable selenium compounds such as selenius acid, salts of selenocyanic acid, selenazoles, and selenides described in JP-B Nos. 46-4553 and 52-34492, and the like can also be used. Specifically, phosphineselenides, selenoureas, and salts of selenocyanic acids are preferred.

In tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, 7-301880 and the like, can be used as a tellurium sensitizer.

As typical examples of a tellurium sensitizer, phosphinetellurides (e.g., butyl-diisopropylphosphinetelluride, tributylphosphinetelluride, tributoxyphosphinetelluride, or ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, or bis(ethoxycarmonyl)telluride), telluroureas (e.g., N,N'-dimethylethylenetellurourea or N,N'-diphenylethylenetellurourea), telluramides, or telluroesters may be used. Specifically, diacyl(di)tellurides and phosphinetellurides are preferred. Especially, the compounds described in paragraph No. 0030 of JP-A No. 11-65021 and compounds represented by formula (II), (III), and (IV) in JP-A No. 5-313284 are preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. More specifically, chloroauric acid, potassium chloroaurate, potassium aurithiocyanate, gold sulfide, gold selenide, or the like can be used. In addition to these, the gold compounds described in U.S. Pat. Nos. 2,642,361, 5,049,484, 5,049,485, 5,169,751, and 5,252,455, Belg. Patent No. 691857, and the like can also be used. Noble metal salts other than gold such as platinum, palladium, iridium and the like, which are described in Chimie et Pysique Photographique, written by P. Grafkides, (Paul Momtel, 5th ed., 1987) and Research Disclosure (vol. 307, Item 307105), can also be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied in the presence of silver halide solvent.

Specifically, thiocyanates (e.g., potassium thiocyanate), thioethers (e.g., coumpounds described in U.S. Pat. Nos. 3,021,215 and 3,271,157, JP-B No. 58-30571 and JP-A No. 60-136736, especially, 3,6-dithia-1,8-octanediol), tetra-substituted thioureas (e.g., coumpounds described in JP-B No. 59-11892 and U.S. Pat. No. 4,221,863, especially, tetramethylthiourea), thione compounds described in JP-B No. 60-11341, mercapto compounds described in JP-B No. 63-29727, mesoionic compounds described in JP-A No.

60-163042, selenoethers described in U.S. Pat. No. 4,782,013, telluroether compounds described in JP-A No. 2-118566, and sulfites can be described. Among them, thiocyanates, thioethers, tetra-substituted thioureas, and thione compounds are preferable, and particularly preferable among them is thiocyanates. The addition amount of silver halide solvent preferably is from $10^{-5}$ mol to $10^{-2}$ mol per 1 mol of silver halide.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The addition amount of chalcogen sensitizer used in the invention may vary depending on the silver halide grain used, the chemical ripening condition, and the like, and it is about $10^{-8}$ mol to $10^{-1}$ mol, and preferably, about $10^{-7}$ mol to $10^{-2}$ mol, per 1 of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is 3 to 10, preferably, 4 to 9; and the temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred.

The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention is preferably chemically sensitized by at least one method of gold sensitizing method and chalcogen sensitizing method for the purpose of designing a high-sensitivity photothermographic material.

9) Compound that can be One-Electron-Oxidized to Provide a One-Electron Oxidation Product which Releases one or more Electrons The compound that can be one-electron-oxidized to provide a one-electron oxidation product which releases one or more electrons according to the invention will be explained.

The compound that can be one-electron-oxidized to provide a one-electron oxidation product which releases one or more electrons according to the invention is preferably a compound of the following Group 1 or Group 2:

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (I). And the preferable range of these compounds is the same as the preferable range described in the quoted specification.

Formula (1)

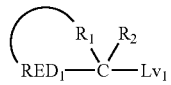

Formula (2)

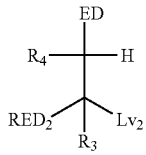

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

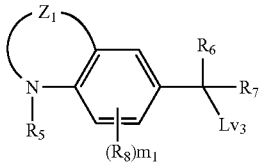

Formula (4)

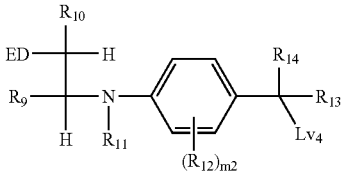

Formula (5)

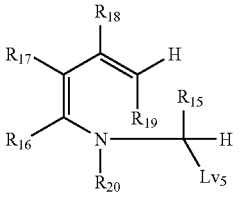

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bind each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

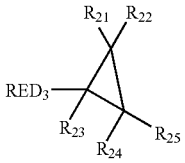

Formula (7)

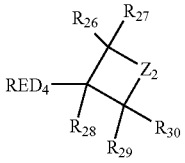

In formulae (6) and (7), $RED_3$ and $RED_4$ each independently represent a reducing group. $R_{21}$ to $R_{30}$ each independently represent a hydrogen atom or a substituent. $Z_2$ represents one selected from $—CR_{111}R_{112}—$, $—NR_{113}—$, and —O—. $R_{111}$ and $R_{112}$ each independently represent a hydrogen atom or a substituent. $R_{113}$ represents one selected from a hydrogen atom, an alkyl group, an aryl group, and a heterocyclic group.

Formula (8)

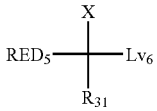

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, and a heterocyclic amino group. $Lv_6$ is a leaving group and represents a carboxyl group or a salt thereof, or a hydrogen atom.

Reaction formula (1)

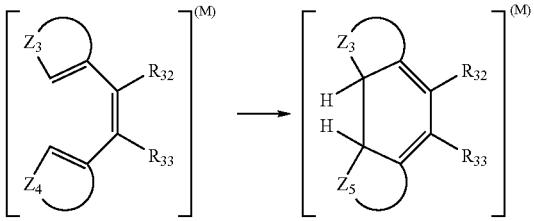

Formula (9)

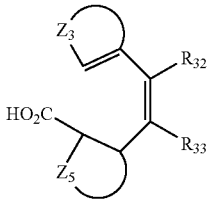

The compound represented by formula (9) is a compound that undergoes a bonding reaction represented by reaction formula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5 or 6-membered heterocycle with C═C. $Z_4$ represents a group to form a 5 or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5 or 6-membered cyclic aliphatic hrdrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

$RED_6$—Q—Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

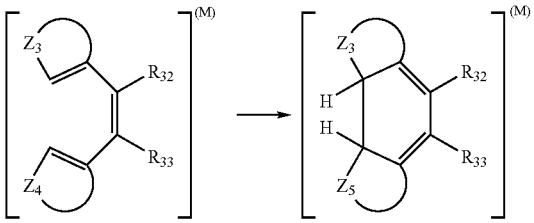

Formula (10)

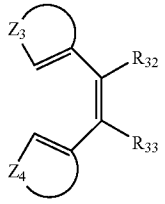

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5 or 6-membered aryl group or heterocyclic group with C═C. $Z_5$ represents a group to form a 5 or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from each other.

As preferable adsorptive group, a nitrogen-containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of a heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen-containing heterocyclic group including quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used, and a 5 or 6-membered aromatic heterocyclic group containing a quaternary nitrogen atom is further preferably used. Particularly preferably, a pyrydinio group, a quinolinio group, or an isoquinolinio group is used. The nitrogen-containing heterocyclic group including a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 and 2 having a quaternary salt of nitrogen or phosphorus as an adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a connecting group, and typically represent one selected from a single bond, an alkylene group, an arylene group, a heterocyclic group, —O—, —S—, —$NR_N$, —C(═O)—, —$SO_2$—, —SO—, —P(═O)—, and the group which consists of combinations thereof. Herein, $R_N$ represents one selected from a hydrogen atom, an alkyl group, an aryl group, and a heterocyclic group.

S represents a residue which is obtained by removing one atom from the compound represented by Group 1 or 2.

i and j are an integral number of 1 or more, and are selected in a range of i+j=2 to 6. It is preferred that i is 1, 2, or 3 and j is 1 or 2. It is more preferred that i is 1 or 2 and j is 1. And, it is particularly preferred that i is 1 and j is 1. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

Specific examples of the compounds of Groups 1 and 2 according to the invention are shown below without intention of restricting the scope of the invention.

1

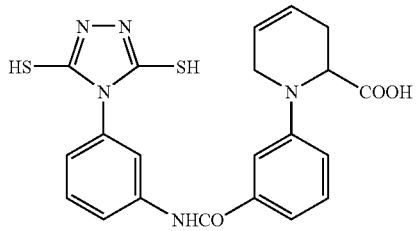

2

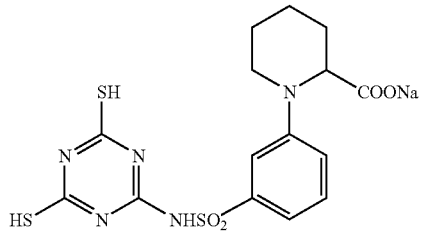

3

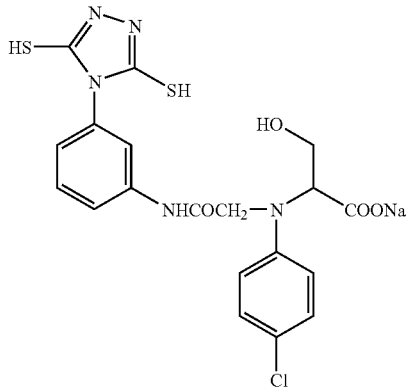

4

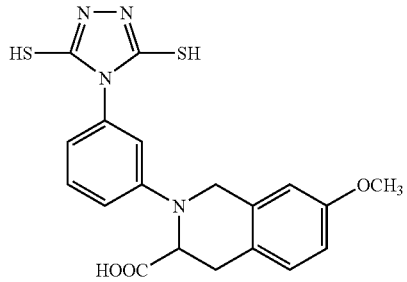

5

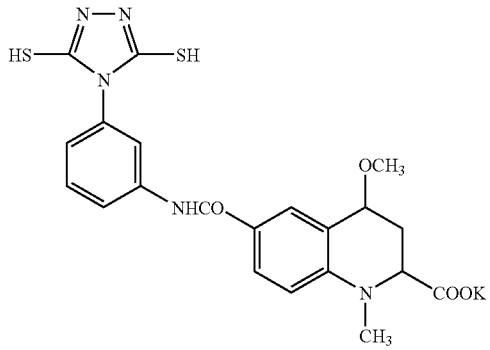

6

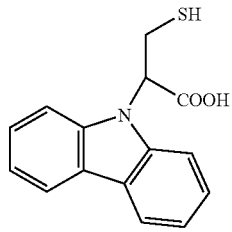

7

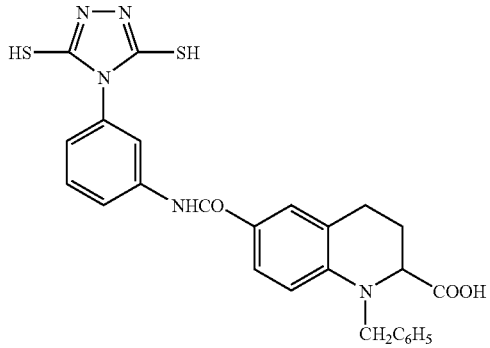

8

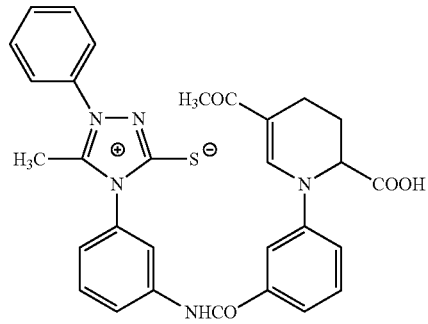

-continued
9
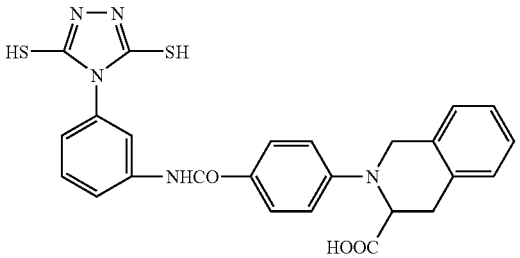
10
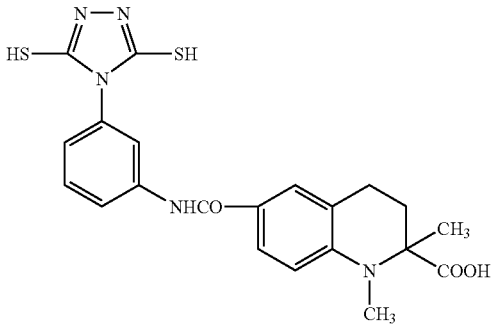
11
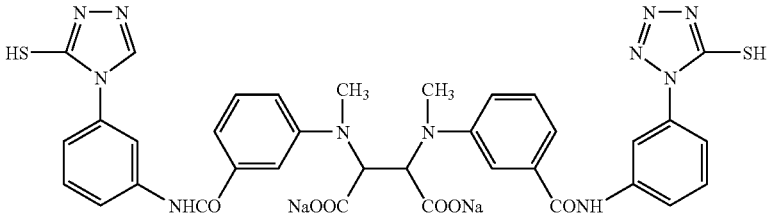
12
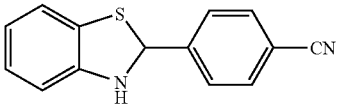
13
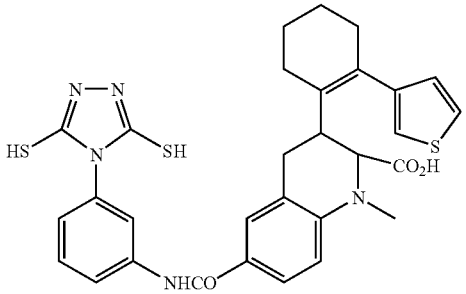
14
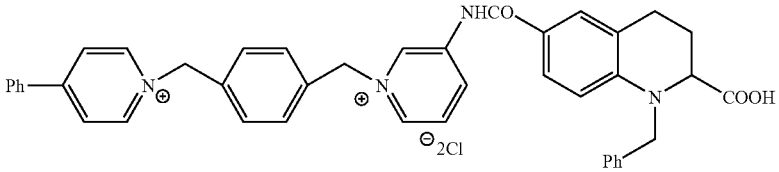
15
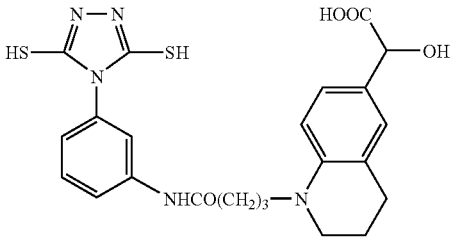
16
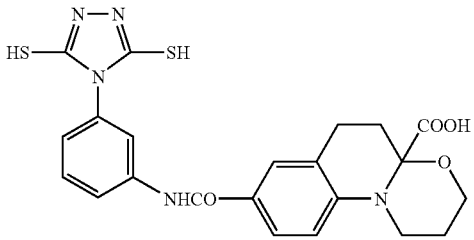
17
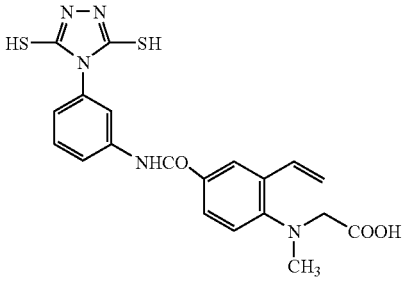
18
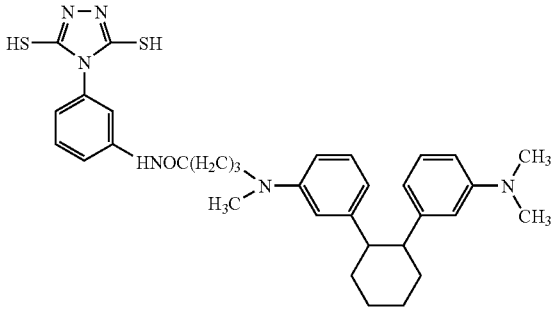

-continued
19
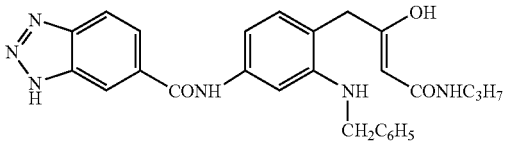
20
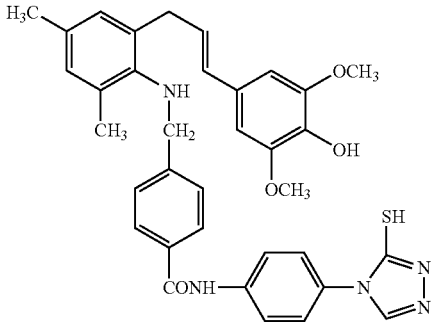
21
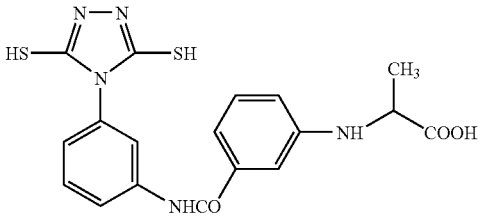
22
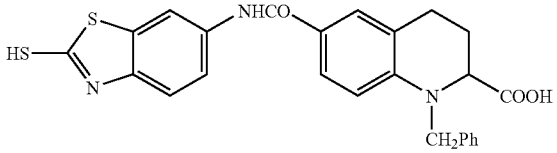
23
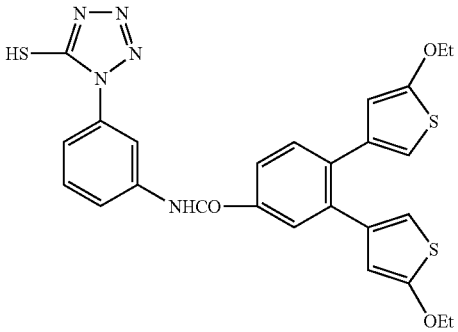
24
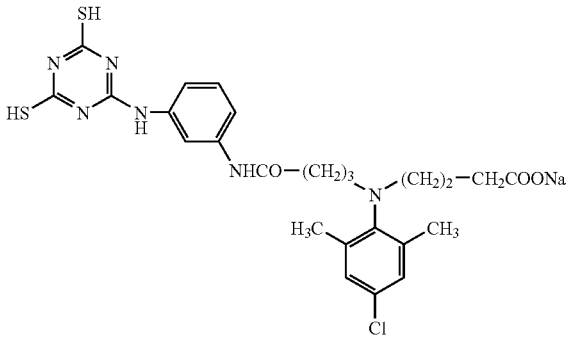
25
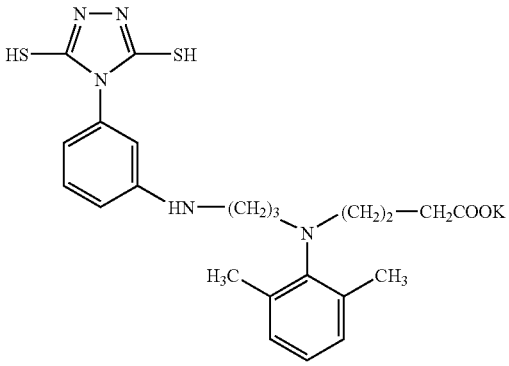
26
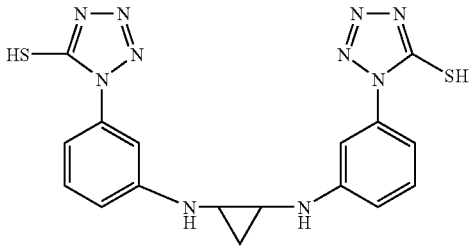

-continued
27
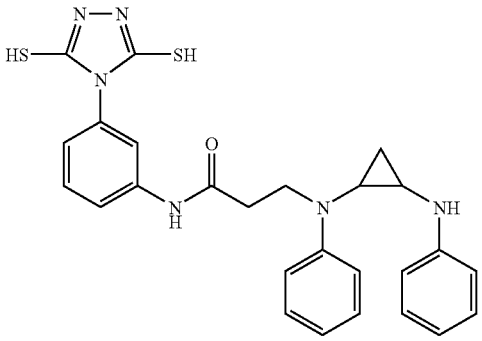
28
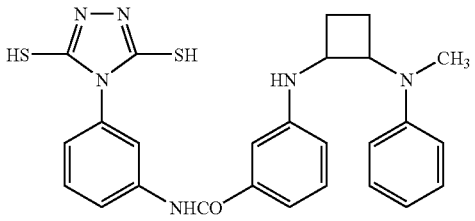
29
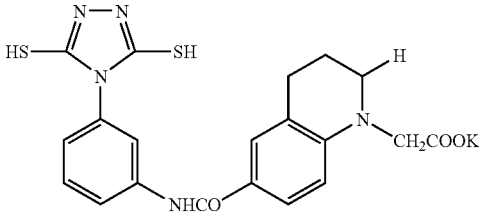
30
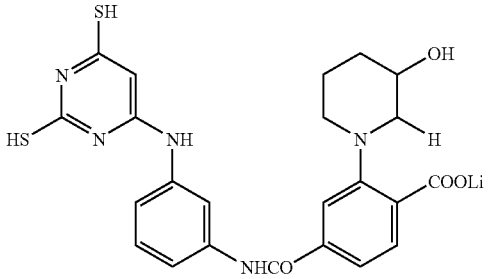
31
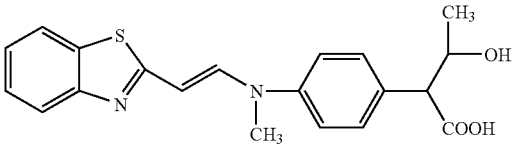
32
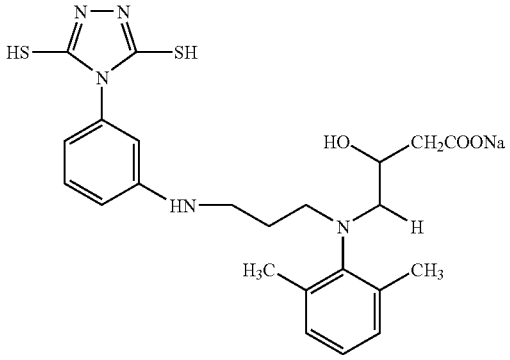
33
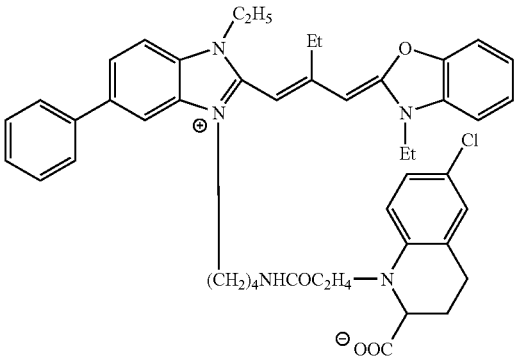
34
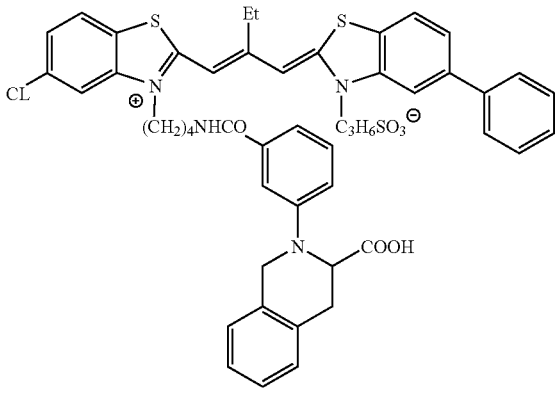
35
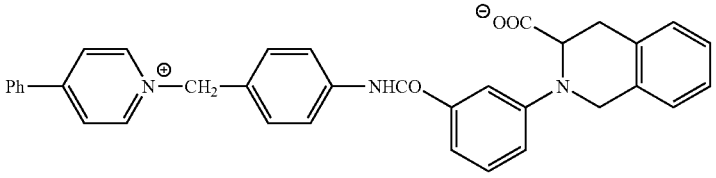

-continued
36
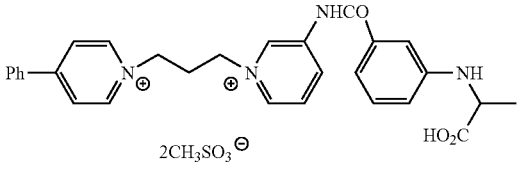
37
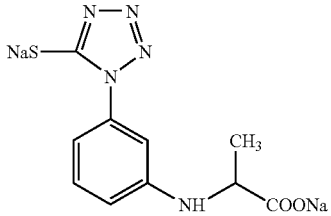
38
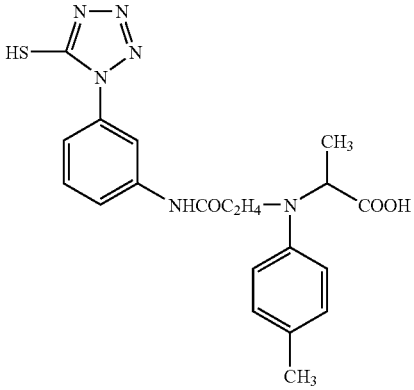
39
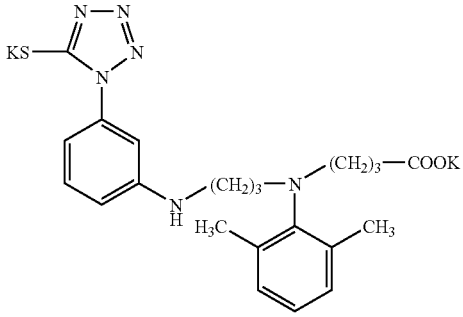
40
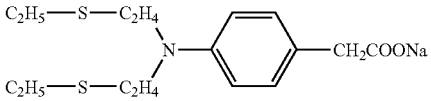
41
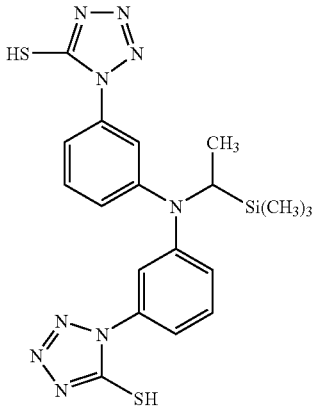
42
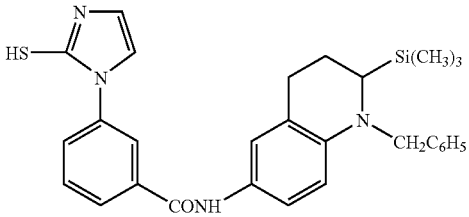
43
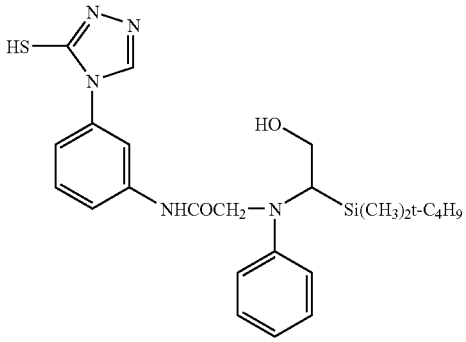

-continued

44

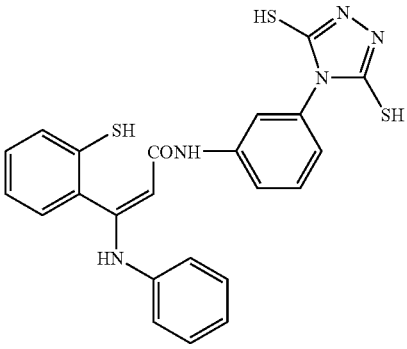

45

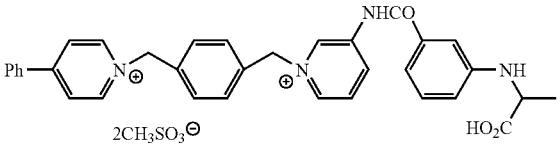

46

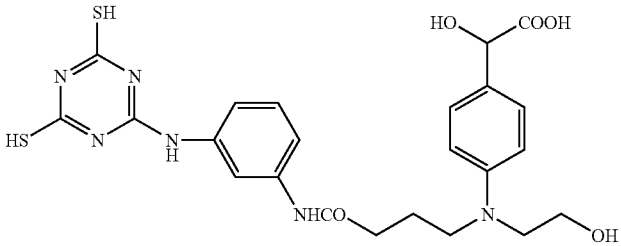

47

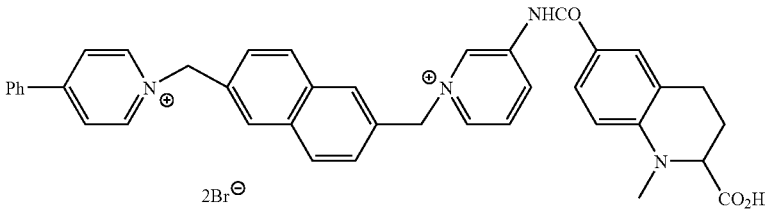

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added after a photosensitive silver halide grain formation step and before a desalting step; in a chemical sensitization step (just before the chemical sensitization to immediately after the chemical sensitization); or before coating.

It is preferred that the compound of Groups 1 and 2 used in the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably added to the image forming layer. The compound may be added to a surface protective layer or an intermediate layer, in combination with its addition to the image forming layer, to be diffused to the image forming layer in the coating step. These compounds may be added before or after addition of a sensitizing dye. Each compound is contained in the image forming layer preferably in an amount of $1\times10^{-9}$ mol to $5\times10^{-2}$ mol, more preferably $1\times10^{-8}$ mol to $2\times10^{-3}$ mol, per 1 mol of silver halide.

10) Adsorptive Redox Compound Having Adsorptive Group and Reducing Group

The adsorptive redox compound having an adsorptive group to silver halide and a reducing group in a molecule according to the invention will be described. It is preferred that the adsorptive redox compound having an adsorptive group to silver halide and a reducing group in a molecule according to the invention is represented by the following formula (I).

A-(W)n-B Formula (I)

In formula (I), A represents a group capable of adsorption to a silver halide (hereafter, it is called an adsorptive group), W represents a divalent linking group, n represents 0 or 1, and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(=S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group, and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described.

A heterocyclic group having a quaternary nitrogen atom may also be adopted, wherein a mercapto group as a substituent may dissociate to form a mesoion. Examples of such heterocyclic group include an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, and the like. Preferred among them is a triazolium ring group such as a 1,2,4-triazolium-3-thiolate ring group. Examples of the aryl group include a phenyl group and a naphthyl group. Examples of the alkyl group include linear, branched, or cyclic alkyl groups having 1 to 30 carbon atoms. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization. Specific examples of the thione group include a thioamide group (herein a —C(═S)—NH— group); and groups containing a partial structure of the thioamide group, such as linear or cyclic thioamide groups, a thiouredide group, a thiourethane group, or a dithiocarbamate ester group, and the like. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, and the like.

The thione group used as the adsorptive group, as well as the thione group derived from the mercapto group by tautomerization, may be a linear or cyclic, thioamide group, thiouredide group, thiourethane group or dithiocarbamate ester group, that cannot be tautomerized into the mercapto group (having no hydrogen atom at α-position of the thione group).

The heterocyclic group, as an adsorptive group, which contains at least one atom selected from a nitrogen atom, a sulfur atom, a selenium atom, and a tellurium atom represents a nitrogen-containing heterocyclic group having —NH— group, as a partial structure of a heterocycle, capable to form a silver iminate (>NAg) or a heterocyclic group, having an —S— group, a —Se— group, a —Te— group or a ═N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzophthiophene group, a benzothiazole group, a benzoxazole group, a thiadiazole group, an oxadiazole group, a triazine group, a selenoazole group, a benzoselenazole group, a tellurazole group, a benzotellurazole group, and the like are described.

The sulfide group or disulfide group as an adsorptive group contains all groups having "—S—" or "—S—S—" as a partial structure. Preferable is a group having a partial structure of alkyl (or alkylene)-S-alkyl (or alkylene); aryl (or arylene)-S-alkyl (or alkylene); or aryl (or arylene)-S-aryl (or arylene). Herein, X represents an —S— group or an —S—S— group. Further, the sulfide group and the disulfide group may form a cyclic structure. Specific examples of the cyclic structure include groups with a thiolane ring, a 1,3-dithiolane ring, a 1,2-dithiolane ring, a thiane ring, a dithiane ring, a thiomorpholine ring, and the like. Particularly preferable as the sulfide group is a group having a partial structure of alkyl (or alkylene)-S-alkyl (or alkylene). Particularly preferable as the disulfide group is a 1,2-dithiolane ring group.

The cationic group as an adsorptive group means the group containing a quaternary nitrogen atom, such as an ammonio group or a nitrogen-containing heterocyclic group including a quaternary nitrogen atom. The ammonio group may be a trialkylammonio group, a dialkylarylammonio group, an alkyldiarylammonio group, or the like, and examples thereof include a benzyldimethylammonio group, a trihexylammonio group, a phenyldiethylammonio group, and the like. As examples of the heterocyclic group containing a quaternary nitrogen atom, a pyridinio group, a quinolinio group, an isoquinolinio group, an imidazolio group, and the like are described. Preferred are a pyridinio group and an imidazolio group, and particularly preferred is a pyridinio group. The quaternary nitrogen-containing heterocyclic group may have any substituent. Preferred as the substituent in the case of the pyridinio group and the imidazolio group are a alkyl group, an aryl group, an acylamino group, a chlorine atom, an alkoxycarbonyl group, a carbamoyl group, and the like. Particularly preferred as the substituent in the case of the pyridinio group is a phenyl group.

The ethynyl group as an adsorptive group means —C≡CH group and the said hydrogen atom may be substituted.

The adsorptive group described above may have any substituent. As examples of the substituent, a halogen atom (a fluorine atom, a chlorine atom, a bromine atom, or an iodine atom), an alkyl group (a linear, branched, or cyclic alkyl group, and a bicyclic alkyl group and an active methine group are contained), an alkenyl group, an alkynyl group, an aryl group, a heterocyclic ring group (substituted position is not asked), an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group and a salt thereof, an oxalyl group, an oxamoyl group, a cyano group, a carbonimidoyl group, a formyl group, a hydroxy group, an alkoxy group (a group containing an ethyleneoxy group or a propyleneoxy group as repeating unit is contained), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an N-hydroxyureido group, an imide group, an alkoxycarbonylamino group, an aryloxycarbonylamino group, a sulfamoylamino group, a semicarbazide group, a thiosemicarbazide group, a hydrazino group, an ammonio group, an oxamoylamino group, an N-alkylsulfonylureido group, an N-arylsulfonylureido group, an N-acylureido group, an N-acylsulfamoylamino group, a hydroxyamino group, a nitro group, a heterocyclic group containing a quaternary nitrogen atom (for example, a pyridinio group, an imidazolio group, a quinolinio group, and an isoquinolinio group), an isocyano group, an imino group, a mercapto group, an alkylthio group, an arylthio group, a heterocyclic thio group, an alkyldithio group, an aryldithio group, a heterocyclic dithio group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Herein, the active methine group means a methine group subsutituted by two electron-attracting group, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. Herein, two electron-attracting groups may bind each other to form a cyclic structure. The salt means a cation such as a salt from an alkali metal, an alkali earth metal, and a heavy metal and an organic cation such as an ammonium ion, a phosphonium ion, and the like.

Further, as typical examples of an adsorptive group, the compounds described in pages 4 to 7 in the specification of JP-A No. 11-95355 are described.

As an adsorptive group represented by A in formula (I), a mercapto-substituted heterocyclic group (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzthiazole group, a 2-mercaptobenzimidazole group, a 1,5-dimethyl-1,2,4-triazorium-3-thiolate group, or the like), a heterocyclic group substituted by a dimercapto group (e.g., a 2,4-dimercaptopyrimidine group, a 2,4-dimercaptotriazine group, a 3,5-dimercapto-1,2,4-triazole group, a 2,5-dimercapto-1,3-thiazole group, or the like), or a nitrogen-containing heterocyclic group having an —NH— group capable to form an imino-silver (>NAg) as a partial structure of a heterocycle (e.g., a benzotriazole group, a benzimidazole group, an indazole group, or the like) is more preferable, and particularly preferable is a heterocyclic group substituted by a dimercapto group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group. The aliphatic group represented by $R_1$ preferably has 1 to 30 carbon atoms, and particularly the aliphatic group represented by $R_1$ is a linear, branched or cyclic alkyl group, an alkenyl group, an alkynyl group, or an aralkyl group having 1 to 20 carbon atoms (e.g., a methyl group, an ethyl group, an isopropyl group, a t-butyl group, an n-octyl group, an n-decyl group, an n-hexadecyl group, a cyclopropyl group, a cyclopentyl group, a cyclohexyl group, an aryl group, a 2-butenyl group, a 3-pentenyl group, a propargyl group, a 3-pentynyl group, a benzyl group, or the like). The aryl group represented by $R_1$ is preferably a monocyclic or condensed ring aryl group having 6 to 30 carbon atoms and that having 6 to 20 carbon atoms is more preferable. For example, a phenyl group, a naphthyl group, and the like are described. The linking group represented by W may have any substituent, whereby the substituent is the same as the substituent for an adsorptive group described above.

In formula (I), a reducing group represented by B represents the group capable to reduce a silver ion. As the examples, a formyl group, an amino group, a triple bond group such as an acetylene group, a propargyl group and the like, a mercapto group, and residues which are derived from a compound selected from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described.

In formula (I), a preferable reducing group represented by B is the residue derived from the compound represented by formulae ($B_1$) to ($B_{13}$).

$B_1$

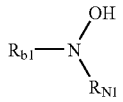

$B_2$

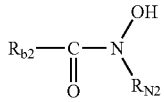

$B_3$

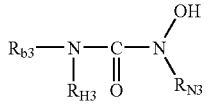

$B_4$

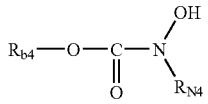

$B_5$

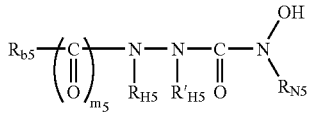

$B_6$

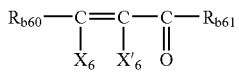

$B_7$

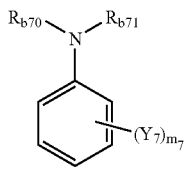

-continued

B8

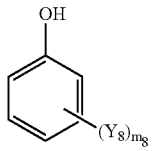

B9

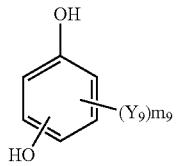

B10

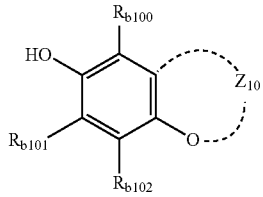

B11

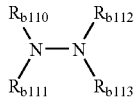

B12

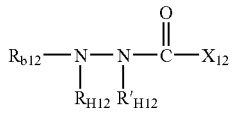

B13

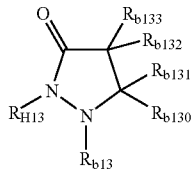

In formulae ($B_1$) to ($B_{13}$), $R_{b1}$, $R_{b2}$, $R_{b3}$, $R_{b4}$, $R_{b5}$, $R_{b70}$, $R_{b71}$, $R_{b110}$, $R_{b111}$, $R_{b112}$, $R_{b113}$, $R_{b12}$, $R_{b13}$, $R_{N1}$, $R_{N2}$, $R_{N3}$, $R_{N4}$, and $R_{N5}$ represent a hydrogen atom, an alkyl group, an aryl group, or a heterocyclic group; and $R_{H3}$, $R_{H5}$, $R'_{H5}$, $R_{H12}$, $R'_{H12}$, and $R_{H13}$ represent a hydrogen atom, an alkyl group, an aryl group, an acyl group, an alkylsulfonyl group, or an arylsulfonyl group; and among them, $R_{H3}$ may still more represent a hydroxy group. $R_{b100}$, $R_{b101}$, $R'_{b102}$, and $R_{b130}$ to $R_{b133}$ represent a hydrogen atom or a substituent. $Y_7$ and $Y_8$ represent a substituent except for a hydroxy group, $Y_9$ represents a substituent, $m_5$ represents 0 or 1, $m_7$ represents an integer from 0 to 5, $m_8$ represents an integer from 1 to 5, and $m_9$ represents an integer from 0 to 4. $Y_7$, $Y_8$, and $Y_9$ may still more represent an aryl group condensed to a benzene ring (e.g., a benzene condensed ring) and furthermore may have a substituent. $Z_{10}$ represents a non-metal atomic group capable to form a ring and $X_{12}$ represents a hydrogen atom, an alkyl group, an aryl group, a heterocyclic group, an alkoxy group, an amino group (an alkylamino group, an arylamino group, a heterocyclic amino group, and a cyclic amino group are contained), or a carbamoyl group.

In formula ($B_6$), $X_6$ and $X'_6$ each represent a hydroxy group, an alkoxy group, a mercapto group, an alkylthio group, an amino group (an alkylamino group, an arylamino group, a heterocyclic amino group, and a cyclic amino group are contained), an acylamino group, a sulfonamide group, an alkoxycarbonylamino group, a ureido group, an acyloxy group, an acylthio group, an alkylaminocarbonyloxy group, or an arylaminocarbonyloxy group. $R_{b60}$ and $R_{b61}$ represent an alkyl group, an aryl group, an amino group, an alkoxy group and an aryloxy group, and $R_{b60}$ and $R_{b61}$ may bind each other to form a cyclic structure.

In the explanation of each group in above formulae ($B_1$) to ($B_{13}$), an alkyl group means a linear, branched, or cyclic, and a substituted or unsubstituted alkyl group having 1 to 30 carbon atoms. An aryl group means a monocyclic or condensed ring, and a substituted or unsubstituted aromatic hydrocarbon ring such as a phenyl group and a naphthyl group. And, a heterocyclic ring group means an aromatic or nonaromatic, a monocyclic or condensed ring, and a substituted or unsubstituted heterocyclic group having at least one heteroatom.

And the substituent described in the explanation of each substituent in formulae ($B_1$) to ($B_{13}$) means the same as the substituent for an adsorptive group described above. These substituents may be further substituted by these substituents.

In formulae ($B_1$) to ($B_5$), $R_{N1}$, $R_{N2}$, $R_{N3}$, $R_{N4}$, and $R_{N5}$ are preferably a hydrogen atom or an alkyl group and herein, an alkyl group is preferably a linear, branched or cyclic, and a substituted or unsubstituted alkyl group having 1 to 12 carbon atoms and more preferably a linear, branched or cyclic, and a substituted or unsubstituted alkyl group having 1 to 6 carbon atoms such as a methyl group, an ethyl group, a propyl group, a benzyl group, and the like.

In formula ($B_1$), $R_{b1}$ is preferably an alkyl group and a heterocyclic group and herein, an alkyl group means a linear, branched or cyclic, and a substituted or unsubstituted alkyl group and is preferably an alkyl group having 1 to 30 carbon atoms and more preferably an alkyl group having 1 to 8 carbon atoms. The heterocyclic ring group means a 5 or 6-membered monocyclic or condensed ring, and an aromatic or nonaromatic heterocyclic group and may have a substituent. As the heterocyclic group, an aromatic heterocyclic group is preferable, and as examples, a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group, a quinazoline ring group, and the like are described. Especially, a triazine ring group and a benzothiazole ring group are preferable. The case, wherein an alkyl group or a heterocyclic group represented by $R_{b1}$ further has one or plural —NH($R_{N1}$)OH groups as its substituent is one of the preferred embodiments of the compound represented by formula ($B_1$).

In formula ($B_2$), $R_{b2}$ is preferably an alkyl group, an aryl group, or a heterocyclic group, and more preferably, an alkyl group or an aryl group. Preferred range of the alkyl group is the same as that in the explanation of $R_{b1}$. As the aryl group, a phenyl group or a naphthyl group is preferable, and a phenyl group is particularly preferable, and it may have a substituent. The case, wherein the group represented by $R_{b2}$ further has one or plural —NH($R_{N2}$)OH groups as its substituent is one of the preferred embodiments of the compound represented by formula ($B_2$).

In formula ($B_3$), $R_{b3}$ is preferably an alkyl group or an aryl group, wherein a preferred range thereof is similar to that in the explanation of $R_{b1}$ and $R_{b2}$. $R_{H3}$ is preferably a hydrogen atom, an alkyl group, or a hydroxy group, and more preferably a hydrogen atom. The case, wherein the group represented by $R_{b3}$ further has one or plural —NH($R_{N3}$)CON($R_{N3}$)OH group as its substituent is one of the preferred embodiments of the compound represented by formula ($B_3$). And $R_{b3}$ and $R_{N3}$ may bind each other to form a cyclic structure (preferably a 5 or 6-membered saturated heterocycle).

In formula ($B_4$), $R_{b4}$ is preferably an alkyl group, wherein a preferred range thereof is similar to that in the explanation of $R_{b1}$. The case where the group represented by $R_{b4}$ further has one or plural —OCON($R_{N4}$)OH groups as its substituent is one of the preferred embodiments of the compound represented by formula ($B_4$).

In formula ($B_5$), $R_{b5}$ preferably is an alkyl group or an aryl group, and more preferably an aryl group, wherein preferred ranges of these groups are the same as those in the explanation of $R_{b1}$ and $R_{b2}$. $R_{H5}$ and $R'_{H5}$ are preferably a hydrogen atom or an alkyl group, and more preferably a hydrogen atom.

In formula ($B_6$), it is preferred that $R_{b60}$ and $R_{b61}$ bind each other to form a cyclic structure. The cyclic structure formed herein is a 5 to 7-membered nonaromatic carbon ring or a heterocycle and may be monocyclic or condensed ring. As typical examples of preferred cyclic structure, a 2-cyclopentene-1-one ring, a 2,5-dihydrofuran-2-one ring, a 3-pyrroline-2-one ring, a 4-pyrazoline-3-one ring, a 2-cyclohexene-1-one ring, a 4-pyrazoline-3-one ring, a 2-cyclohexene-1-one ring, a 5,6-dihydro-2H-pyran-2-one ring, a 5,6-dihydro-2-pyridone ring, a 1,2-dihydronaphthalene-2-one ring, a cumarin ring (a benzo-α-pyran-2-one ring), a 2-quinolone ring, a 1,4-dihydronaphthalene-1-one ring, a chromone ring (a benzo-γ-pyran-4-one ring), a 4-quinolone ring, an indene-1-one ring, a 3-pyrroline-2,4-dione ring, an uracil ring, a thiouracil ring, a dithiouracil ring, and the like are described, and a 2-cycolopentene-1-one ring, a 2,5-dihydrofuran-2-one ring, 3-pyrroline-2-one ring, a 4-pyrazoline-3-one ring, a 1,2-dihydronaphthalene-2-one ring, a cumarin ring (a benzo-α-pyran-2-one ring), a 2-quinolone ring, a 1,4-dihydronaphthalene-1-one ring, a chromone ring (a benzo-γ-pyran-4-one ring), a 4-quinolone ring, an indene-1-one ring, a dithiouracil ring, and the like are more preferable, and a 2-cycolopentene-1-one ring, a 2,5-dihydrofuran-2-one ring, a 3-pyrroline-2-one ring, an indene-1-one ring, and a 4-pyrazoline-3-one ring are still more preferable.

When $X_6$ and $X'_6$ represent a cyclic amino group, a cyclic amino group means a nonaromatic nitrogen-containing heterocyclic group bound at a nitrogen atom, e.g., a pyrrolidino group, a pyperidino group, a pyperadino group, a morphorino group, a 1,4-thiazine-4-yl group, a 2,3,5,6-tetrahydro-1,4-thiazine-4-yl group, an indolyl group, and the like are included.

As $X_6$ and $X'_6$, a hydroxy group, a mercapto group, an amino group (an alkylamino group, an arylamino group, and a cyclic amino group are contained), an acylamino group, a sulfonamide group, an acyloxy group, and an acylthio group are preferable, and a hydroxy group, a mercapto group, an amino group, an alkylamino group, a cyclic amino group, a sulfonamide group, an acylamino group, and an acyloxy group are more preferable, and a hydroxy group, an amino group, an alkylamino group, and a cyclic amino group are particularly preferable. Further, it is preferred that at least one of $X_6$ and $X'_6$ is a hydroxy group.

In formula ($B_7$), $R_{b70}$ and $R_{b71}$ are preferably a hydrogen atom, an alkyl group, or an aryl group, and more preferably an alkyl group. The preferred range of the alkyl group is the same as that in the explanation of $R_{b1}$. $R_{b70}$ and $R_{b71}$ may bind each other to form a cyclic structure (e.g., a pyrrolidine ring, a pyperidine ring, a morphorino ring, a thiomorphorino ring, and the like). As the substituent represented by $Y_7$, an alkyl group (that preferred range is the same as the explanation of $R_{b1}$), an alkoxy group, an amino group, an acylamino group, a sulfonamide group, a ureido group, an acyl group, an alkoxycarbonyl group, a carbamoyl group, a sulfamoyl group, a chlorine atom, a sulfo group or a salt thereof, a carboxyl group or a salt thereof, and the like are preferable and $m_7$ preferably represents an integer from 0 to 2.

In formula ($B_8$), $m_8$ is preferably an integer from 1 to 4 and the plural $Y_8$ may be the same or different. $Y_8$ in the case where $m_8$ is 1, or at least one of the plural $Y_8$ in the case where $m_8$ is 2 or more is preferably an amino group (an alkylamino group and an arylamino group are contained), a sulfonamide group, or an acylamino group. In the case where $m_8$ is 2 or more, the remaining $Y_8$ is preferably a sulfonamide group, an acylamino group, a ureido group, an alkyl group, an alkylthio group, an acyl group, an alkoxycarbonyl group, a carbamoyl group, a sulfo group or a salt thereof, a carboxyl group or a salt thereof, a chlorine atom, or the like. Herein, in the case where o'-(or p'-)hydroxyphenylmethyl group (may further have a substituent) is substituted at the ortho or para position toward a hydroxy group as the substituent represented by $Y_8$ these compounds represent a compound group generally called as a bisphenol. The said compound is also one of the preferred examples represented by formula ($B_8$). Further, the case where $Y_8$ represent a benzene condensed ring and results to represent naphthols for formula ($B_8$) is very preferable.

In formula ($B_9$), the substitution position of two hydroxy groups may be each other an ortho position (catechols), a meta position (resorcinols), or a para position (hydroquinones). $m_9$ is preferably 1 or 2 and the plural $Y_9$ may be the same or different. As preferred substituents represented by $Y_9$, a chlorine atom, an acylamino group, a ureido group, a sulfonamide group, an alkyl group, an alkylthio group, an alkoxy group, an acyl group, an alkoxycarbonyl group, a carbamoyl group, a sulfo group or a salt thereof, a carboxyl group or a salt thereof, a hydroxy group, an alkylsulfonyl group, an arylsulfonyl group, and the like are described. The case where $Y_9$ represents a benzene condensed ring and results to represent 1,4-naphthohydroquinones for formula ($B_9$) is also preferable. When formula ($B_9$) represents catechols, $Y_9$ is particularly preferably a sulfo group or a salt thereof, or a hydroxy group.

In formula ($B_{10}$), when $R_{b100}$, $R_{b101}$, and $R_{b102}$ represent a substituent, preferred examples of the substituent are the same as the preferred examples of $Y_9$. Among them, an alkyl group (particularly a methyl group) is preferable. Preferred examples of a cyclic structure to form $Z_{10}$ are a chroman ring and a 2,3-dihydrobenzofuran ring are described and these cyclic structures may have a substituent and may form a spiro ring.

In formula ($B_{11}$), preferred examples of $R_{b111}$, $R_{b112}$, and $R_{b113}$ are an alkyl group, an aryl group, and a heterocyclic group, and their preferred ranges are the same as those in the explanation of $R_{b1}$ and $R_{b2}$. Among them, an alkyl group is preferable and two alkyl groups among $R_{b110}$ to $R_{b113}$ may bind to form a cyclic structure. Herein, a cyclic structure means 5 to 7-membered nonaromatic heterocycle, e.g., a pyrrolidine ring, a pyperidine ring, a morphorino group, a thiomorphorino ring, a hexahydropyridazine ring, and the like.

In formula ($B_{12}$), $R_{b12}$ is preferably an alkyl group, an aryl group or a heterocyclic group, and their preferred ranges are the same as those in the explanation of $R_{b1}$ and $R_{b2}$. $X_{12}$ is preferably an alkyl group, an aryl group (particularly a phenyl group), a heterocyclic group, an alkoxy group, an amino group (an alkylamino group, an arylamino group, a heterocyclic amino group, and a cyclic amino group are contained), or a carbamoyl group and, more preferably an alkyl group (particularly, an alkyl group having 1 to 8 carbon atoms is preferable), an aryl group (particularly, a phenyl group is preferable), an amino group (an alkylamino group, an arylamino group, and a cyclic amino group are contained). $R_{H12}$ and $R'_{H12}$ are preferably a hydrogen atom or an alkyl group, and more preferably a hydrogen atom.

In formula ($B_{13}$), $R_{b13}$ is preferably an alkyl group or an aryl group, and their preferred ranges are the same as those in the explanation of $R_{b1}$ and $R_{b2}$. $R_{b130}$, $R_{b131}$, $R_{b132}$, and $R_{b133}$ are preferably a hydrogen atom, an alkyl group (particularly, an alkyl group having 1 to 8 carbon atoms is preferable), or an aryl group (particularly, a phenyl group is preferable). $R_{H13}$ is preferably a hydrogen atom or an acyl group, and more preferably a hydrogen atom.

In formula (I), a reducing group represented by B is preferably a residue derived from a compound selected from hydroxylamines, hydroxamic acids, hydroxyureas, hydroxysemicarbazides, phenols, hydrazines, hydrazides, or phenidones, and particularly preferably, hydroxyureas, hydroxysemicarbazides, phenols, hydrazides, and phenidones.

The oxidation potential of a reducing group represented by B in formula (I) can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%:90% (% by volume)) and after bubbling with nitrogen gas over 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential ($E_{1/2}$) can be calculated by that obtained voltamograph.

When a reducing group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

Most of the reducing groups represented by B in the present invention are known in the photographic industry and those examples are described in the following patents. For example, JP-A Nos. 2001-42466, 8-114884, 8-314051, 8-333325, 9-133983, 11-282117, 10-246931, 10-90819, 9-54384, 10-171060, and 7-77783 can be described. And as an example of phenols, the compound described in U.S. Pat. No. 6,054,260 is described, too.

The compound of formula (I) of the present invention may have the ballasted group or polymer chain in it generally used in the non-moving photographic additives as a coupler. And as a polymer, for example, the polymer described in JP-A No. 1-100530 can be selected.

The compound of formula (I) of the present invention may be bis or tris type of compound. The molecular weight of the compound represented by formula (I) in the present invention is preferably from 100 to 10,000, more preferably from 120 to 1,000, and particularly preferably from 150 to 500.

The examples of the compound represented by formula (I) of the present invention are shown below, but the present invention is not limited in these. Further, the compounds illustrated in JP-A Nos. 2000-330247 and 2001-42446 are also preferable examples.

1

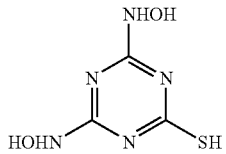

2

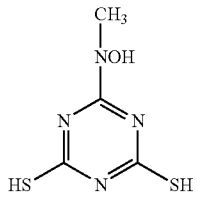

3

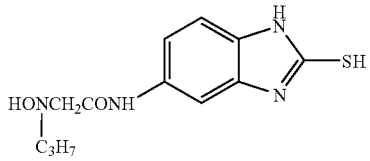

4

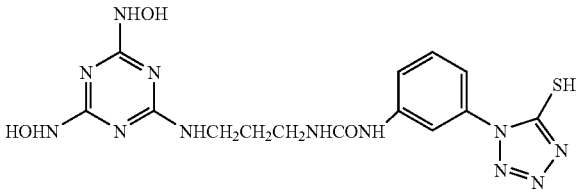

5

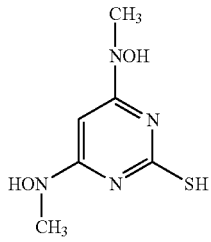

6

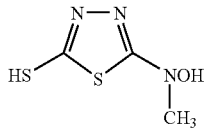

7

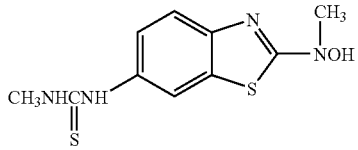

8

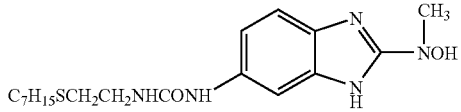

-continued
9
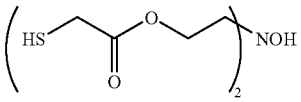
10
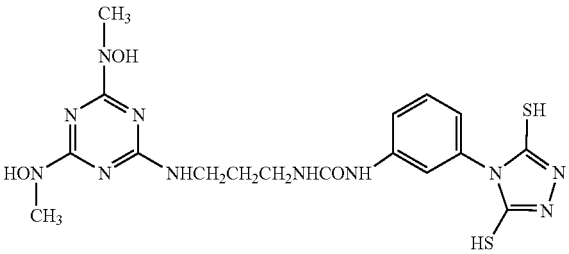
11
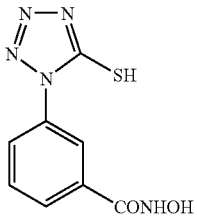
12
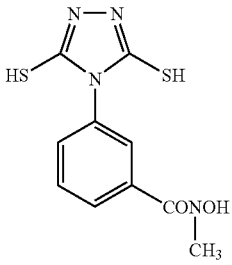
13
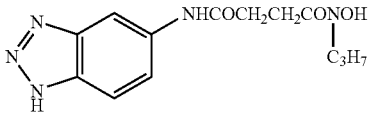
14
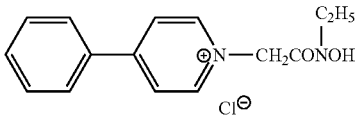
15
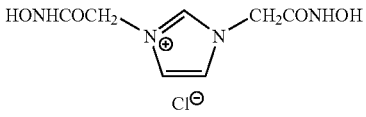
16
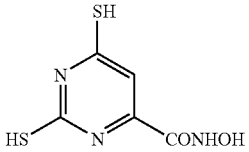
-continued
17
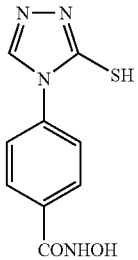
18
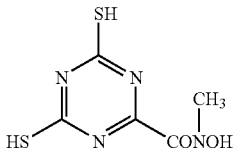
19
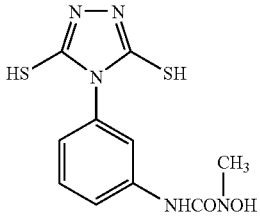
20
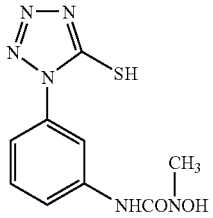
21
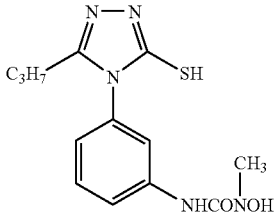
22
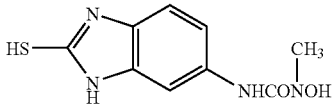
23
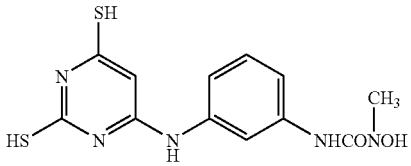
24
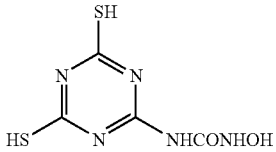

-continued
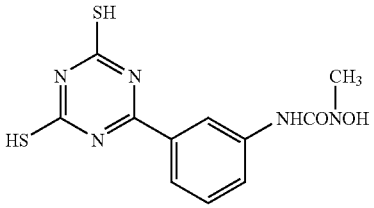
26
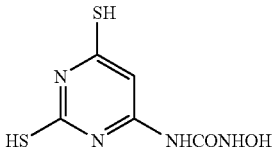
27
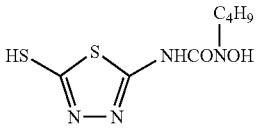
28
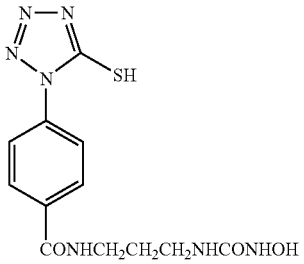
29
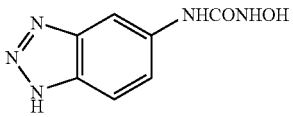
30
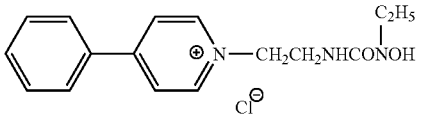
31
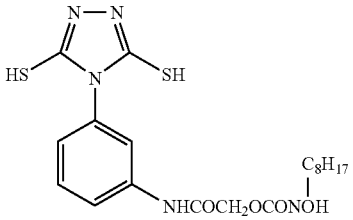
32
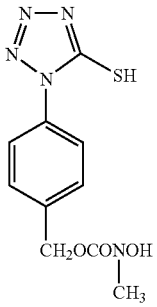
-continued
33
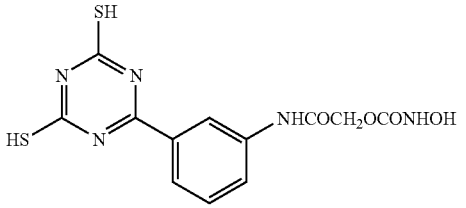
34
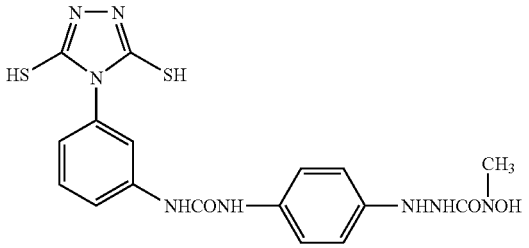
35
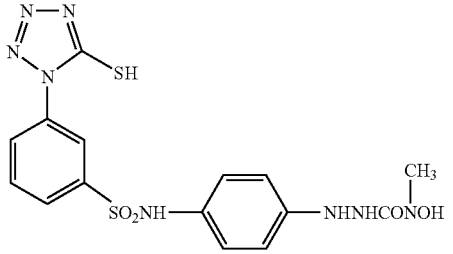
36
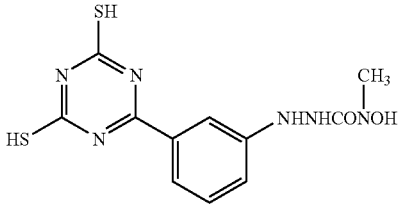
37
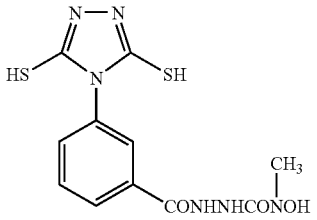
38
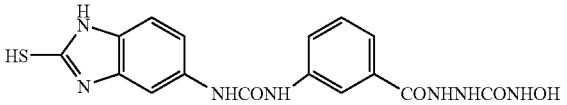

-continued
39
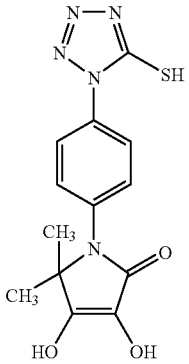
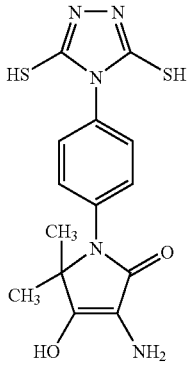
41
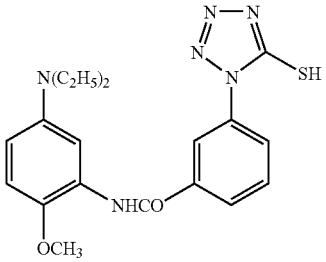
42
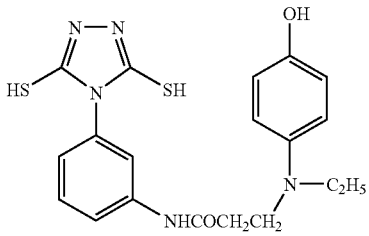
43
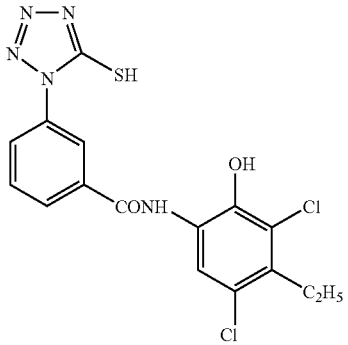
-continued
44
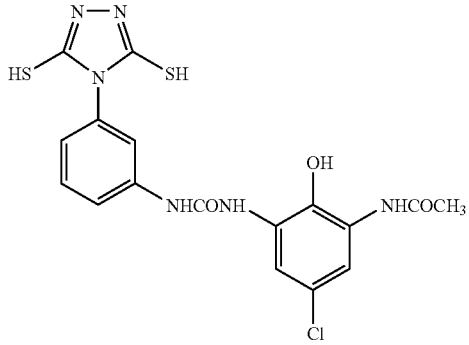
45
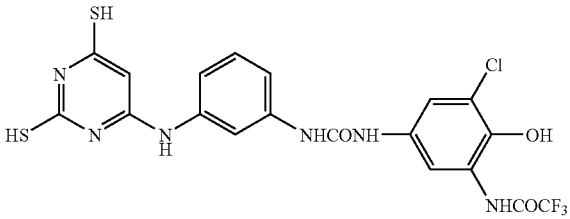
46
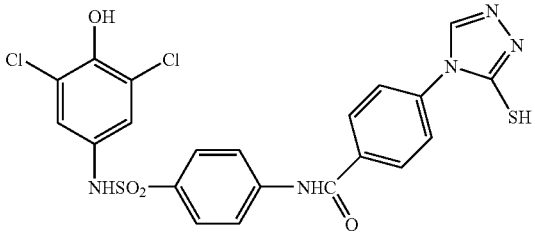
47
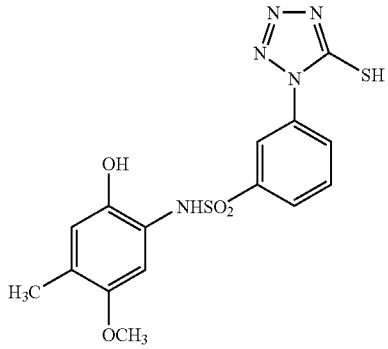
47
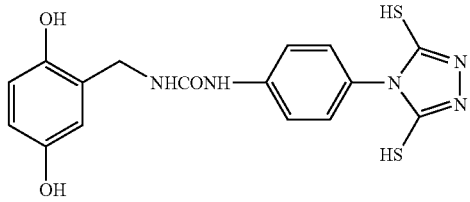
49
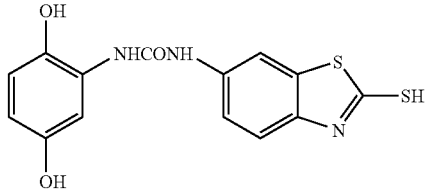

-continued
50
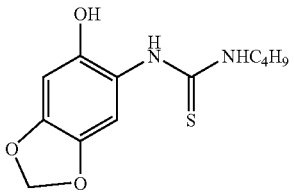
51
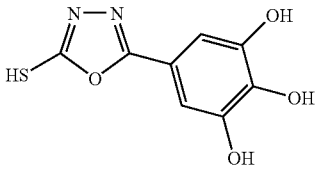
52
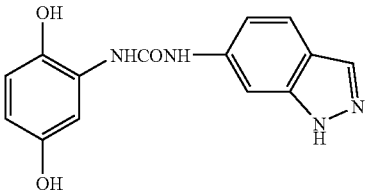
53
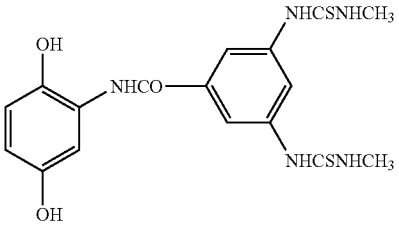
54
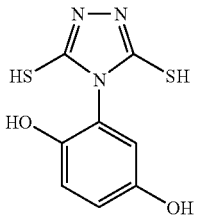
55
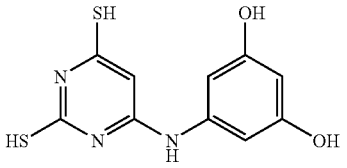
56
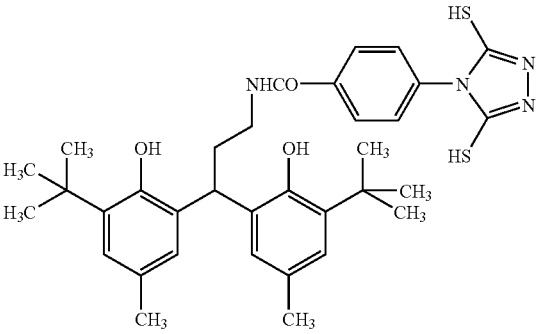
-continued
57
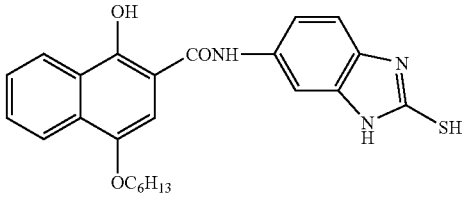
58
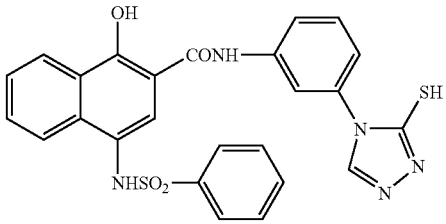
59
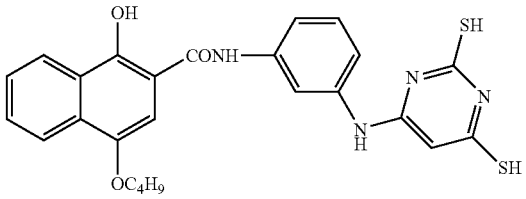
60
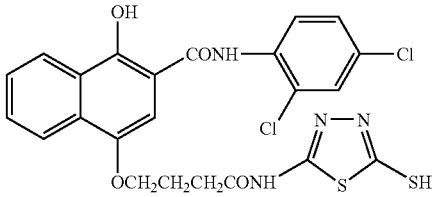
61
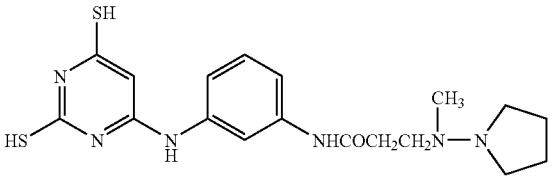
62
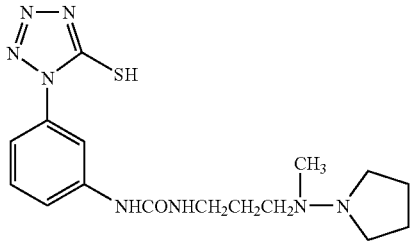
63
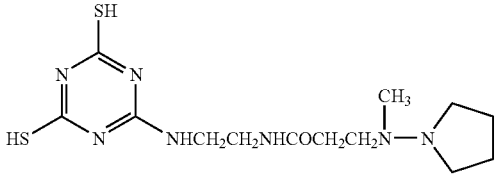

-continued
64
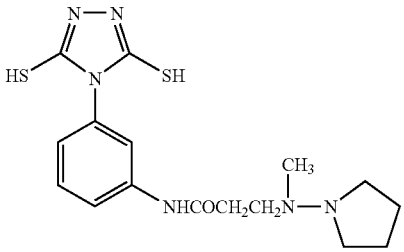
65
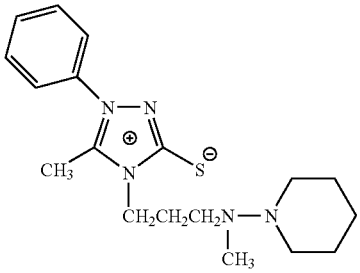
66
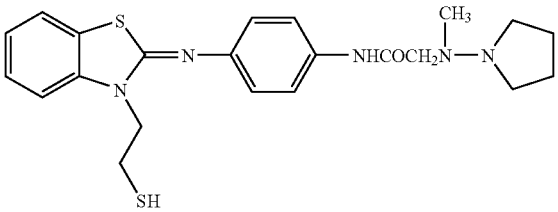
67
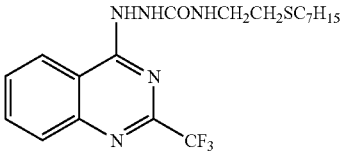
68
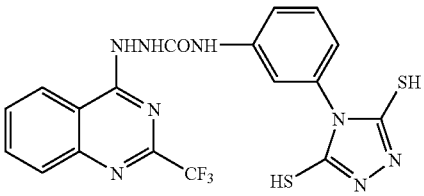
69
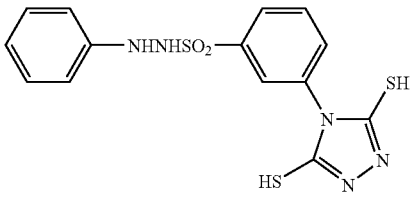
70
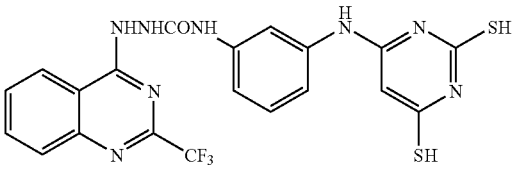
-continued
71
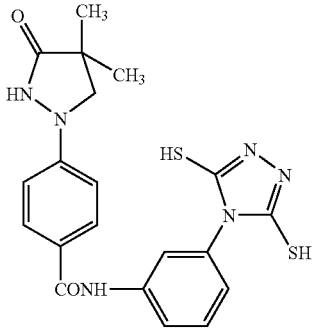
72
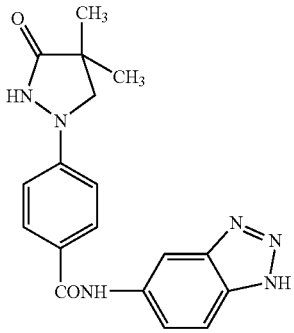
73
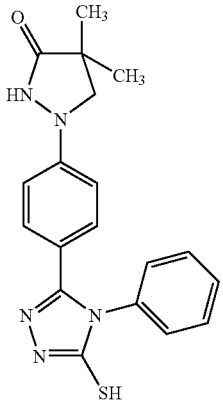
74
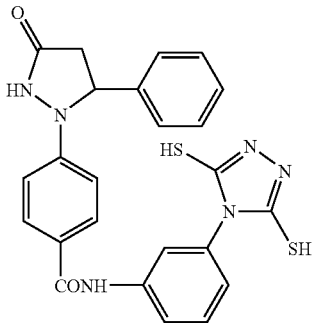

-continued
75
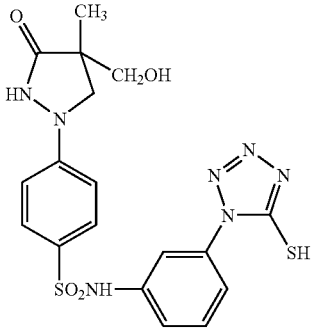
76
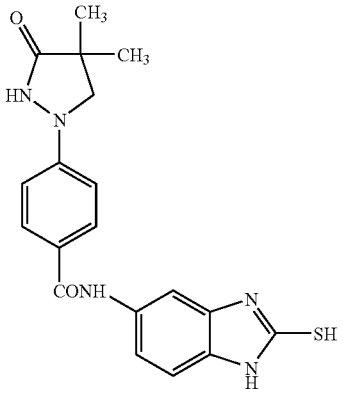
77
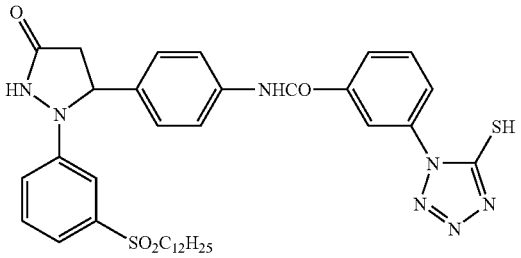
78
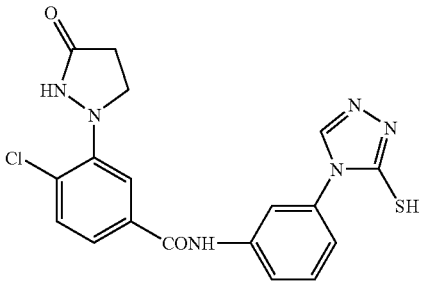
-continued
79
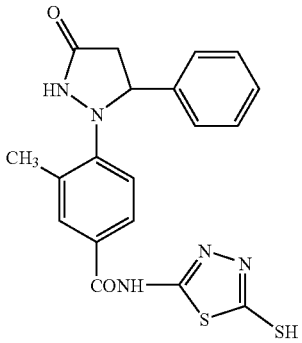
80
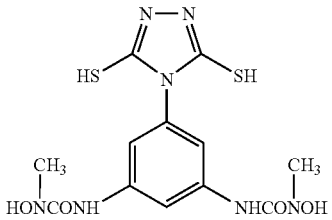
81
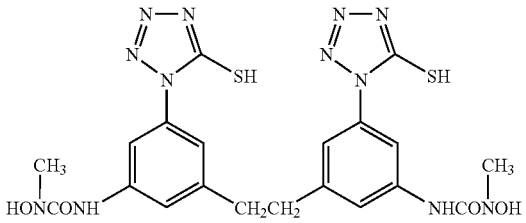
82
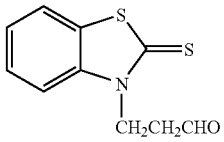
83
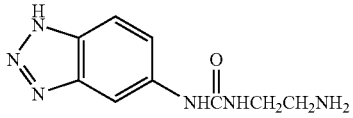
84
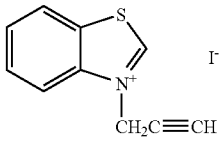
85
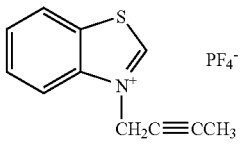
86
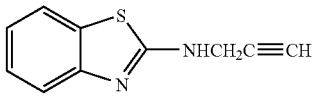
87
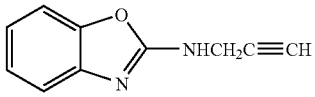

-continued

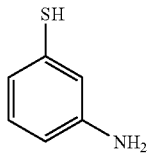

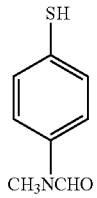

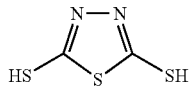

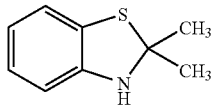

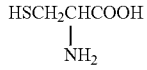

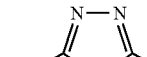

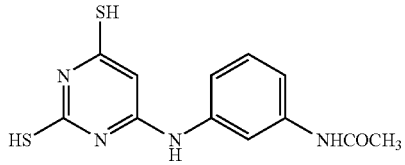

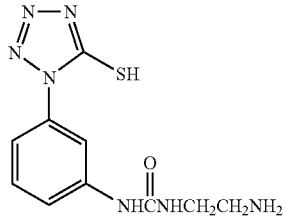

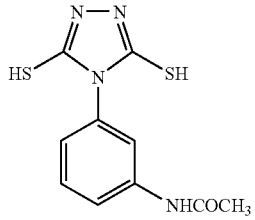

-continued

88

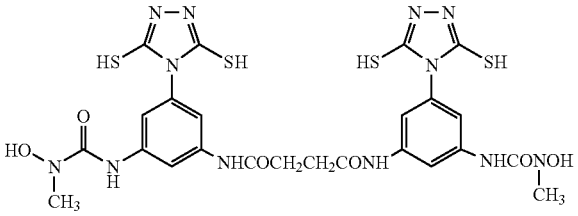

97

89

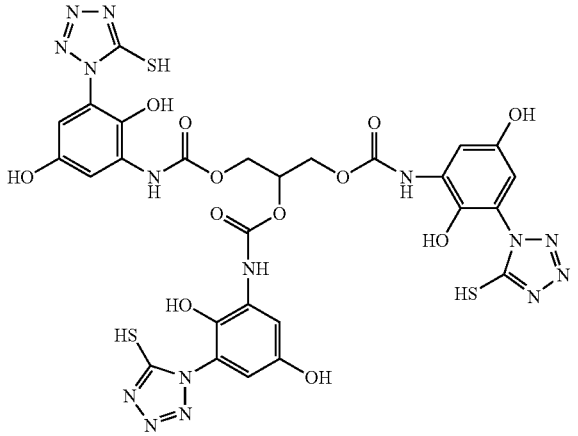

98

90

91

92 These compounds can be easily synthesized by any known methods.

93 The compound of formula (I) of the present invention can be used alone, but it is preferred to use two or more kinds of the compounds in combination. When two or more kinds of the compounds are used in combination, those may be added to the same layer or the different layers, whereby adding methods may be different from each other.

94 The compound represented by formula (I) of the present invention preferably is added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound may be added in several times, during these steps. It is preferred to be added in the image forming layer. But the compound may be added to a surface protective layer or an intermediate layer, in combination with its addition to the image forming layer, to be diffused to the image forming layer in the coating step.

96 The preferred addition amount is largely dependent on the adding method described above or the kind of the compound. It is generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) of the present invention can be added by dissolving in water or water-soluble solvent such as methanol, ethanol, or the like, or a mixed solution thereof. At this time, the pH may be arranged suitably by an acid or an alkaline and a surfactant can coexist. Further, these compounds may be added as an emulsified dispersion by dissolving them in an organic solvent having a high boiling point and also may be added as a solid dispersion.

11) Combined Use of a Plurality of Silver Halides

The photosensitive silver halide emulsion in the black and white photothermographic material used in the invention may be used alone, or two or more kinds of them (for example, those of different average particle sizes, different halogen compositions, different crystal habits, and different conditions for chemical sensitization) may be used together. Gradation can be controlled by using plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Mixing Silver Halide and Organic Silver Salt

The photosensitive silver halide in the invention is particularly preferably formed in the absence of the non-photosensitive organic silver salt and chemically sensitized. This is because sometimes sufficient sensitivity can not be attained by the method of forming the silver halide by adding a halogenating agent to an organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, homogenizer, or the like, or a method of mixing a photosensitive silver halide completed for preparation at any timing in the preparation of an organic silver salt and preparing the organic silver salt. The effect of the invention can be obtained preferably by any of the methods described above.

13) Mixing Silver Halide Into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Compound which Substantially Reduces Visible Light Absorption by Photosensitive Silver Halide)

In the present invention, it is preferred that the black and white photothermographic material contains a compound which substantially reduces visible light absorption by photosensitive silver halide after thermal development versus before thermal development.

In the present invention, it is particularly preferred that a silver iodide complex-forming agent is used as the compound which substantially reduces visible light absorption by photosensitive silver halide after thermal development.

<Silver Iodide Complex-Forming Agent>

The black and white photothermographic material of the present invention preferably contains a silver iodide complex-forming agent.

As for the silver iodide complex-forming agent according to the present invention, at least one of a nitrogen atom or a sulfur atom in the compound can contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion and the silver complex-forming agent. As a general guide, it is possible to obtain a large stability constant by a chelate effect from intramolecular chelate ring formation, by means of increasing the acid-base dissociation constant and the like.

As a silver iodide complex-forming agent according to the present invention, a 5 to 7-membered heterocyclic compound containing at least one nitrogen atom is preferable. In the case where the compound does not have a mercapto group, a sulfide group, or a thione group as a substituent, the said nitrogen-containing 5 to 7-membered heterocycle may be saturated or unsaturated, and may have another substituent. The substituent on a heterocycle may bind to each other to form a ring.

As preferable examples of 5 to 7-membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, 1,2,4-triazine, 1,3,5-triazine, pyrrolidine, imidazolidine, pyrazolidine, piperidine, piperazine, morpholine, indoline, isoindoline, and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzotriazole, 1,2,4-triazine, 1,3,5-triazine, and the like can be described. Particularly preferably, pyridine, imidazole, pyrazine, pyrimidine, pyridazine, phtharazine, triazine, 1,8-naphthylizine, 1,10-phenanthroline, and the like can be described.

These rings may have a substituent and any substituent can be used as far as it does not negatively impact the photographic property. As preferable examples, a halogen atom (fluorine atom, chlorine atom, bromine atom, or iodine atom), an alkyl group (a linear, branched, or cyclic alkyl group containing a bicycloalkyl group and an active methine group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, an N-sulfamoylcarbamoyl group, a carbazoyl group, a carboxyl group and a salt thereof, an oxalyl group, an oxamoyl group, a cyano group, a carbonimidoyl group, a formyl group, a hydroxy group, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamide group, a ureido group, a thioureido group, an imide group, an alkoxycarbonylamino group, an aryloxycarbonylamino group, a sulfamoylamino group, a semicarbazide group, an ammonio group, an oxamoylamino group, an N-alkylsulfonylureido group, an N-arylsulfonylureido group, an N-acylureido group, an N-acylsulfamoylamino group, a nitro group, a heterocyclic group containing a quaternary nitrogen atom (e.g., a pyridinio group, an imidazolio group, a quinolinio group, or an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, an N-acylsulfamoyl group, an N-sulfonylsulfamoyl group and a salt thereof, a phosphino group, a phosphinyl group, a phosphinyloxy group, a phosphinylamino group, a silyl group, and the like are described. Here, an active methine group means a methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal, or the like, or organic positive ion such as an ammonium ion, a phosphonium ion, or the like. These substituents may be further substituted by these substituents.

These heterocycles may be further condensed by another ring. In the case where the substituent is an anion group (e.g., $—CO_2^-$, $—SO_3^-$, $—S^-$, or the like), the heterocycle containing nitrogen atom of the invention may become a positive ion (e.g., pyridinium, 1,2,4-triazolium, or the like) and may form an intramolecular salt.

In the case where a heterocyclic compound is pyridine, pyrazine, pyrimidine, pyridazine, phthalazine, triazine, naththilizine, or phenanthroline derivative, the acid dissociation constant (pKa) of a conjugated acid of nitrogen-containing heterocyclic part in acid dissociation equilibrium of the said compound is preferably 3 to 8 in the mixture solution of tetrahydrofuran/water (3/2) at 25° C., and more preferably, the pKa is 4 to 7.

As the heterocyclic compound, pyridine, pyridazine, or phtharazine derivative is preferable, and particularly preferable is pyridine or phthalazine derivative.

In the case where these heterocyclic compounds have a mercapto group, a sulfide group or a thione group as the substituent, pyridine, thiazole, isothiazole, oxazole, isoxazole, imidazole, pyrazole, pyrazine, pyrimidine, pyridazine, triazine, triazole, thiadiazole, and oxadiazole derivatives are preferable, and thiazole, imidazole, pyrazole, pyrazine, pyrimidine, pyridazine, triazine, and triazole derivatives are particularly preferable.

For example, as the said silver iodide complex-forming agent, the compound represented by the following formulae (1) or (2) can be used.

Formula (1)

$$R^{11}—S—R^{12}$$

Formula (2)

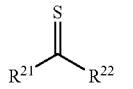

In formula (I), $R^{11}$ and $R^{12}$ each independently represent a hydrogen atom or a substituent. In formula (2), $R^{21}$ and $R^{22}$ each independently represent a hydrogen atom or a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7-membered nitrogen-containing heterocyclic type silver iodide complex-forming agent mentioned above can be described.

Further, the compound represented by formula (3) described below can also be used preferably.

Formula (3)

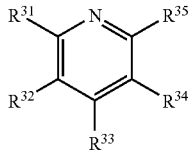

In formula (3), $R^{31}$ to $R^{35}$ each independently represent a hydrogen atom or a substituent. As the substituent represented by $R^{31}$ to $R^{35}$, the substituent of a 5 to 7-membered nitrogen-containing heterocyclic type silver iodide complex-forming agent mentioned above can be used. In the case where the compound represented by formula (3) has a substituent, preferred substituting position is $R^{32}$ to $R^{34}$. $R^{31}$ to $R^{35}$ may bind each other to form a saturated or an unsaturated ring. A preferred substituent is a halogen atom, an alkyl group, an aryl group, a carbamoyl group, a hydroxy group, an alkoxy group, an aryloxy group, a carbamoyloxy group, an amino group, an acylamino group, a ureido group, an alkoxycarbonylamino group, an aryloxycarbonylamino group, or the like.

In the compound represented by formula (3), the acid dissociation constant (pKa) of conjugated acid of pyridine ring part preferably is 3 to 8 in the mixed solution of tetrahydrofuran/water (3/2) at 25° C., and particularly preferably 4 to 7.

Furthermore, the compound represented by formula (4) is also preferable.

Formula (4)

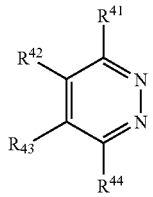

In formula (4), $R^{41}$ to $R^{44}$ each independently represent a hydrogen atom or a substituent. $R^{41}$ to $R^{44}$ may bind each other to form a saturated or an unsaturated ring. As the substituent represented by $R^{41}$ to $R^{44}$, the substituent of a 5 to 7-membered nitrogen-containing heterocyclic type silver iodide complex-forming agent mentioned above can be described. As preferred group, an alkyl group, an alkenyl group, an alkynyl group, an aryl group, a hydroxy group, an alkoxy group, an aryloxy group a heterocyclic oxy group, and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one subsutituent. As examples of $R^{51}$ to $R^{56}$ in formula (5), the substituent of a 5 to 7-membered nitrogen-containing heterocyclic type silver iodide complex-forming agent mentioned above can be described. And as more preferable examples of the substituent, an alkyl group, an alkenyl group, an alkynyl group, an aryl group, a hydroxy group, an alkoxy group, an aryloxy group, and the like are described. An alkyl group, an alkenyl group, an aryl group, an alkoxy group, and an aryloxy group are preferable and an alkyl group, an alkoxy group, and an aryloxy group are more preferable.

Formula (5)

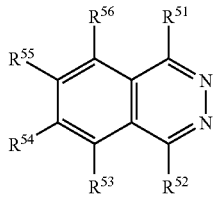

Further, the compound represented by formula (6) described below is also a preferable embodiment.

Formula (6)

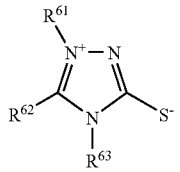

In formula (6), $R^{61}$ to $R^{63}$ each independently represent a hydrogen atom or a substituent. As examples of the substituent represented by $R^{62}$, the substituent of a 5 to 7-membered nitrogen-containing heterocyclic type silver iodide complex-forming agent mentioned above can be described.

As the compound preferably used, the compound represented by the following formula (7) is described.

$$R^{71}—S—(L)_nS—R^{72}$$ Formula (7)

In formula (7), $R^{71}$ and $R^{72}$ each independently represent a hydrogen atom or a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imide group, and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

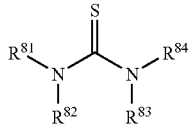

In formula (8), $R^{81}$ to $R^{84}$ each independently represent a hydrogen atom or a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imide group, and the like are described as examples.

Among the silver iodide complex-forming agents described above, the compounds represented by formulae (3), (4), (5), (6), and (7) are more preferable and, the compounds represented by formulae (3) and (5) are particularly preferable.

Preferable examples of silver iodide complex-forming agent are described below, however the present invention is not limited in these.

(1)

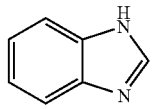

(2)

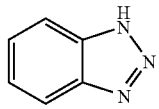

(3)

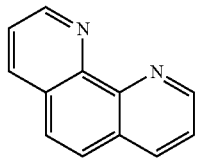

(4)

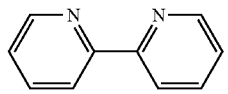

(5)

$C_5H_{11}SC_5H_{11}$ (6)

$C_4H_9SCH_2CH_2SC_4H_9$ (7)

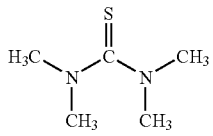

(8)

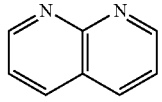

-continued
(9)
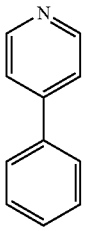
(10)
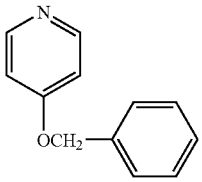
(11)
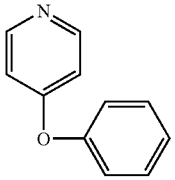
(12)
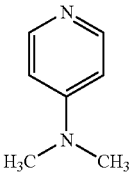
(13)
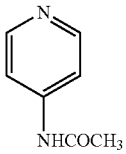
(14)
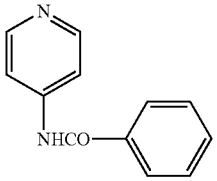
(15)
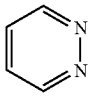
(16)
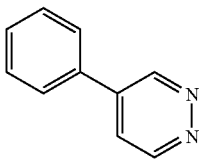
(17)
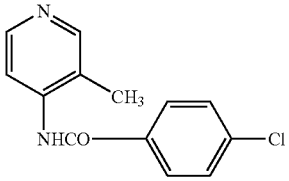
-continued
(18)
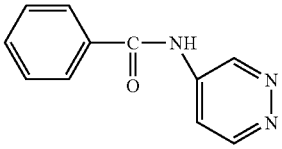
(19)
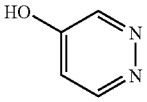
(20)
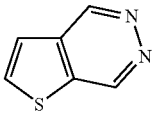
(21)
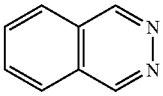
(22)
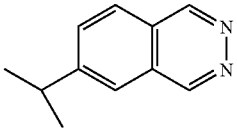
(23)
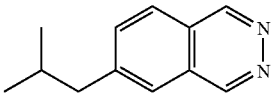
(24)
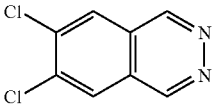
(25)
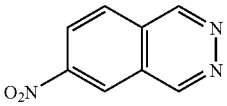
(26)
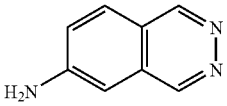
(27)
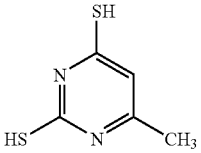
(28)
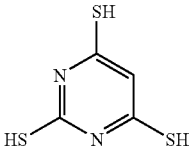

-continued (29)

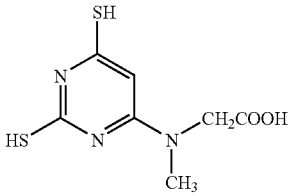

(30)

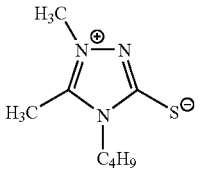

(31)

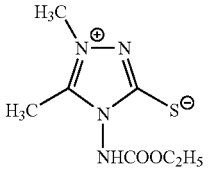

(32)

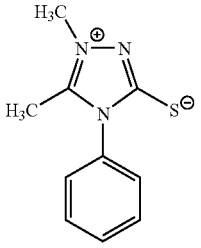

(33)

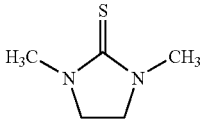

(34)

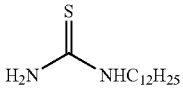

(35)

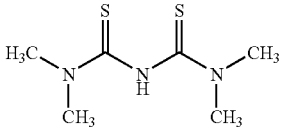

(36)

$HO(CH_2)_3S(CH_2)_2S(CH_2)_3OH$ (37)

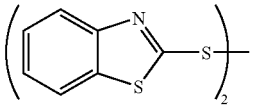

(38)

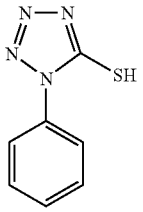

-continued (39)

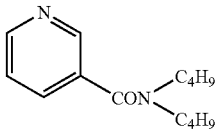

(40)

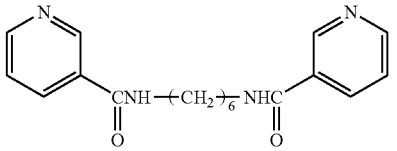

(41)

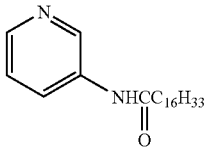

(42)

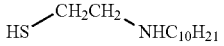

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

In the present invention, an absorption intensity of ultra violet-visible light absorption spectrum of photosensitive silver halide after thermal development preferably becomes 80% or less as compared with before thermal development, more preferably 40% or less and, particularly preferably 10% or less.

The silver iodide complex-forming agent according to the invention may be incorporated into a black and white photothermographic material by being added into the coating solution, such as in the form of a solution, an emulsion dispersion, a solid fine particle dispersion, or the like.

Well known emulsion dispersing methods include a method comprising dissolving the silver iodide complex-forming agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

Solid fine particle dispersing methods include a method comprising dispersing the powder of the silver iodide complex-forming agent according to the invention in a proper solvent such as water or the like, by means of ball mill, colloid mill, vibrating ball mill, sand mill, jet mill, roller mill, or ultrasonics, thereby obtaining a solid dispersion. In this case, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Depending on the dispersing conditions, the amount of Zr and the like generally incorporated in the dispersion is in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in the water dispersion.

The silver iodide complex-forming agent according to the invention is preferably used in the form of a solid dispersion.

The silver iodide complex-forming agent according to the invention is preferably used in the range from 1 mol % to 5000 mol %, more preferably, from 10 mol % to 1000 mol % and, further preferably, from 50 mol % to 300 mol %, with respect to the photosensitive silver halide in each case.

(Non-Photosensitive Organic Silver Salt)

An organic compound that contains a reducible silver (I) ion is contained in the black and white photothermographic materials of the present invention. Preferably, it is a silver salt or a coordination compound that forms a silver image which is comparatively stable to light, when heated to 50° C. or higher in the presence of an exposed silver halide and a reducing agent.

The non-photosensitive organic silver salt of the invention is a compound selected from a silver salt of an azole compound or a silver salt of a mercapto group. Preferable is a nitrogen-containing heterocyclic compound as an azole compound, and more preferable are a triazole compound and a tetrazole compound. The mercapto compound is a compound which contains at least one of a mercapto group and a thione group in a molecular.

The silver salt of a nitrogen-containing heterocyclic compound is preferably a silver salt of a compound containing an imino group. Specific examples of the silver salt include, but are not limited to these examples, a silver salt of 1,2,4-triazole, a silver salt of benzotriazole or a derivative thereof (for example, a silver salt of methylbenzotriazole and a silver salt of 5-chlorobenzotriazole), a silver salt of 1-H-tetrazole such as phenylmercaptotetrazole described in U.S. Pat. No. 4,220,709, a silver salt of imidazole or an imidazole derivative described in U.S. Pat. No. 4,260,677. Among these kinds of silver salt, particularly preferred are a silver salt of a benzotriazole derivative and a mixture of two or more of the silver salts described herein.

Most preferred compound used for the black and white photothermographic material of the present invention is a silver salt of a benzotriazole derevative.

The compound containing a mercapto group or a thione group according to the invention is preferably a heterocyclic compound containing of 5 or 6 atoms. In this case, at least one atom in the ring is a nitrogen atom and the other atoms are atoms selected from a carbon atom, an oxygen atom, and a sulfur atom. Examples of such heterocyclic compound include, but are not limited to these examples, triazoles, oxazoles, thiazoles, thiazolines, imidazoles, diazoles, pyridines, and triazines.

Representative examples of the silver salt of a compound containing a mercapto group or a thione group are set forth below, but the invention is not limited to these.

A silver salt of 3-mercapto-4-phenyl-1,2,4-triazole

A silver salt of 2-mercapto benzimidazole

A silver salt of 2-mercapto-5-aminothiazole

A silver salt of 2-(2-ethylglycolamido)benzothiazole

A silver salt of 5-carboxylic-1-methyl-2-phenyl-4-thiopyridine

A silver salt of mercaptotriazine

A silver salt of 2-mercaptobenzoxazole

A silver salt described in U.S. Pat. No. 4,123,274 (for example, a silver salt of a 1,2,4-mercaptothiazole derivative, and a silver salt of 3-amino-5-benzylthio-1,2,4-thiazole)

A silver salt of thione compounds (for example, a silver salt of 3-(2-carboxyethyl)-4-methyl-4-thiazoline-2-thione described in U.S. Pat. No. 3,785,830)

As the compound containing a mercapto group or a thione group according to the invention, a compound which does not contain a heterocycle can also be used. The mercapto or thione derivative which does not contain a heterocycle is preferably an aliphatic or aromatic hydrocarbon compound having 10 or more carbon atoms.

Examples of useful compound of mercapto and thione derivatives containing no heterocycle are set forth below, but the invention is not limited to these.

A silver salt of thioglycolic acid (for example, a silver salt of S-alkylthioglycolic acid, wherein the alkyl group has 12 to 22 carbon atoms)

A silver salt of dithiocarboxylic acid (for example, a silver salt of dithioacetic acid and a silver salt of thioamide).

An organic compound containing a silver salt of carboxylic acid is also used preferably. It is, for example, a silver salt of aromatic carboxylic acid. Preferred examples of the silver salts of aromatic carboxylic acid and other carboxylic acids include the following compounds, but the invention is not limited to these examples.

Substituted or unsubstituted silver benzoate (for example, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate)

Silver tannate

Silver phthalate

Silver terephthalate

Silver salicyate

Silver phenylacetate

Silver pyromellitate

In the present invention, a silver salt of fatty acid containing a thioether group as described in U.S. Pat. No. 3,330,663 (Weyde et al.) is also used preferably. Soluble silver carboxylate having a hydrocarbon chain incorporating an ether or thioether linkage, or having a sterically hindered substitutent in the alpha-position (on a hydrocarbon group) or ortho-position (on an aromatic group) can also be used. These silver salts can display increased solubility in coating solvents and affording coatings with less light scattering.

Such silver carboxylates are described in U.S. Pat. No. 5,491,059. Any of the silver salts described herein can be used in the invention, when necessary.

Silver salts of sulfonic acid which are described in U.S. Pat. No. 4,504,575 can also be used in the embodiment of this invention. Silver salts of sulfosuccinates which are described in EP-A No. 0227141 are also useful.

Moreover, silver salts of acetylenes described, for example, in U.S. Pat. Nos. 4,761,361 and 4,775,613 can be used in the invention.

Non-photosensitive silver sources which are capable of supplying reducible silver ions can also be provided as core-shell silver salts known in general or such as those described in U.S. Pat. No. 6,355,408.

These silver salts include a core comprised of one or more silver salts and a shell having one or more different silver salts.

Still another useful non-photosensitive silver source in the present invention is a silver dimer synthetic compound that comprises two different silver salts described in U.S. Pat. No. 6,472,131 (Whitcomb). Such non-photosensitive silver dimer synthetic compound comprises two different silver salts. In the case where the two different silver salts comprise linear, saturated hydrocarbon groups as silver ligands, those ligands differ by 6 or more carbon atoms.

Those of ordinary skill in the art understand that the non-photosensitive silver source which is capable of supplying reducible silver ions can be incorporated in the form of mixtures of various silver salt compounds described above.

The photosensitive silver halide grain and the non-photosensitive silver source which is capable of supplying reducible silver ions must be in catalytic proximity (that is, in the distance of reactive association), and these are preferably present in the same layer.

The non-photosensitive silver source which is capable of supplying reducible silver ions is preferably contained in an amount of from 5% by weight to 70% by weight, and more preferably from 10% by weight to 50% by weight, with respect to the total silver amount in the image forming layer.

Further, the amount of the non-photosensitive silver source is generally contained in an amount of from 0.001 $mol/m^2$ to 0.03 $mol/m^2$, and more preferably from 0.005 $mol/m^2$ to 0.02 $mol/m^2$, with respect to the black and white photothermographic material.

The total amount of silver in the black and white photothermographic material of the present invention is generally from 0.01 $mol/m^2$ to 0.05 $mol/m^2$.

(Reducing Agent)

The reducing agent which is used in the black and white photothermographic material of the present invention is explained below.

The reducing agent (individual or a mixture comprising two or more reducing agent components) for silver ions can be any material, preferably an organic material, that can reduce silver (I) ion to silver.

The photographic developing agents used for conventional wet processing (such as methyl gallate, hydroquinone, substituted hydroquinones, 3-pyrazolidones, p-aminophenols, p-phenylenediamines, hindered phenols, admioximes, azines, catechols, pyrogallols, ascorbic acid (and derivatives thereof), and leuco dyes), and other materials readily apparent to one skilled in the art, for example, materials described in U.S. Pat. No. 6,020,117, can be used in the present invention.

An "ascorbic acid reducing agent" (referred as a developing agent) indicates a complex including ascorbic acid and their derivatives. Ascorbic acid developing agents are described in many references, for example, in U.S. Pat. No. 5,236,816 and their cited references.

As the developing agents used for the present invention, an ascorbic acid developing agent is preferred. Useful examples of the ascorbic acid developing agent include ascorbic acid and analogous compounds thereof, isomer and derivatives thereof. Examples of such compounds are set forth below, but the invention is not limited to these.

D- and L-ascorbic acids and their glycosylated derivatives (for example, sorboascorbic acid, gamma-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, and L-arabosascorbic acid)

A sodium salt of ascorbic acid

A potassium salt of ascorbic acid

An isoascorbic acid (or L-erythroascorbic acid) and a salt thereof (for example, alkali salt, ammonium salt, or the salt known in this technical field)

An endiol type ascorbic acid

An enaminol type ascorbic acid

A thioenol type ascorbic acid, for example, compounds described in U.S. Pat. No. 5,498,511, EP-A Nos. 0585792, 0573700, and 0588408, U.S. Pat. Nos. 5,278,035, 5,384,232, and 5376510, JP-A No. 7-56286, U.S. Pat. No. 2,688,549, and Research Disclosure, item 37152 (March 1995).

Among these, preferred are D-, L-, and D, L-ascorbic acid (and an alkali salt thereof) and isoascorbic acid (and an alkali salt thereof), and preferred salt is a sodium salt. Mixtures of these developing agents can also be used, when necessary.

Hindered phenols are preferably used individually or in combination with one or more of high-contrast developers and contrast-enhancing agents.

Hindered phenol is a compound that has only one hydroxy group on the benzene ring and has at least one additional substituent located on ortho position with respect to the hydroxy group. Hindered phenol developing agents may contain a plurality of hydroxy groups so long as each hydroxy group is located on different benzene rings.

Examples of the hidered phenol reducing agent include binaphthols (that is dihydroxybinaphthols), biphenols (that is dihydroxybiphenols), bis(hydroxynaphthyl)methanes, bis(hydroxyphenyl)methanes (that is bisphenols), hindered phenols, and hindered naphthols, each of which may be substituted.

Representative binaphthols are the compounds described below, but the invention is not limited to these.

1,1'-Bi-2-naphthol 1,1'-Bi-4-methyl-2-naphthol 6,6'-Dibromo-bi-2-naphthol and other compounds are described in U.S. Pat. Nos. 3,094,714 and 5,262,295.

Representative biphenols are the compounds set forth below, but the invention is not limited to these.

2,2'-Dihydroxy-3,3'-di-t-butyl-5,5'-dimethylbiphenyl 2,2'-Dihydroxy-3,3',5,5'-tetra-t-butylbiphenyl 2,2'-Dihydroxy-3,3'-di-t-butyl-5,5'-dichlorobiphenyl 2-(2-Hydroxy-3-t-butyl-5-methyl phenyl)-4-methyl-6-n-hexylphenol 4,4'-Dihydroxy-3,3',5,5'-tetra-t-butylbiphenyl 4,4'-Dihydroxy-3,3',5,5'-tetramethylbiphenyl Compounds described in U.S. Pat. No. 5,262,295

Representative bis(hydroxynaphthyl)methanes are the compounds set forth below, but the invention is not limited to these.

4,4'-methylenebis(2-methyl-1-naphthol)

Compounds described in U.S. Pat. No. 5,262,295

Representative bis(hydroxyphenyl)methanes are the compounds described below, but the invention is not limited to these.

Bis(2-hydroxy-3-t-butyl-5-methylphenyl)methane (CAO-5)

1,1'-Bis(2-hydroxy-3,5-dimethylphenyl)-3,5,5-trimethylhexane (NONOX or PERMANAX WSO)

1,1'-Bis(3,5-di-t-butyl-4-hydroxyphenyl)methane 2,2'-Bis(4-hydroxy-3-methylphenyl)propane 4,4'-Ethylidene-bis(2-t-butyl-6-methylphenol)

2,2'-Isobutylidene-bis(4,6-dimethylphenol) (LOWINOX 221B46)

2,2'-Bis(3,5-dimethyl-4-hydroxyphenyl)propane

Compounds described in U.S. Pat. No. 5,262,295

Representative hindered phenols are the compounds described below, but the invention is not limited to these.

2,6-Di-t-butylphenol 2,6-Di-t-butyl-4-methylphenol 2,4-Di-t-butylphenol 2,6-Dichlorophenol 2,6-Dimethylphenol 2-t-Butyl-6-methylphenol Representative hindered naphthols are the compounds described below, but the invention is not limited to these.

1-Naphthol

4-Methyl-1-naphthol

4-Methoxy-1-naphthol

4-Chloro-1-naphthol

2-Methyl-1-naphthol

Compounds described in U.S. Pat. No. 5,262,295

Particularly, reducing agents that have been disclosed as suitable ones for the black and white photothermographic material include the following compounds.

Amidoximes (for example, phenylamidoxime)

2-Thienyl-amidoxime p-Phenoxyphenylamidoxime

Azines (for example, 4-hydroxy-3,5-dimethoxybenzalde hydrazine)

A combination of aliphatic carboxylic acid aryl hydrazide and ascorbic acid (such as a combination of 2,2'-bis-(hydroxymethyl)-propionyl-β-phenylhydrazide and ascorbic acid)

A combination of polyhydroxybenzene and hydroxylamine

A combination of reductone and hydrazine (for example, a combination of hydroquinone and bis(ethoxyethyl)hydroxylamine)

Piperidino-4-methylphenylhydrazine

Hydroxamic acids (for example, phenylhydroxamic acid, p-hydroxylphenylhydroxamic acid, and o-alaninehydroxamic acid)

A combination of azine and sulfonamidophenols (for example, a combination of phenothiazine and 2,6-dichloro-4-benzenesulfonamidophenol)

α-Cyanophenylacetic acid derivatives (for example, ethyl-α-cyano-2-methylphenylacetic acid and ethyl-α-cyanophenylacetic acid)

Bis-o-naphthol (for example, 2,2'-dihydroxy-1-binaphthyl, 6,6'-dibromo-2,2'-dihydroxy-1, 1'-binaphthyl, and bis (2-hydroxy-1-naphthyl)methane)

A combination of bis-o-naphthol and 1,3-dihydroxybenzene derivative (for example, 2,4-dihydroxybenzophenone and 2,4-dihydroxyacetophenone)

5-Pyrazolone (for example, 3-methyl-1-phenyl-5-pyrazolone)

Reductones (for example, dimethylaminohexose reductone, anhydrodihydro-aminohexose reductone, or anhydrodihydro-piperidone-hexose reductone)

Sulfonamidophenol reducing agents (for example, 2,6-dichloro-4-benzenesulfonamidophenol, or p-benzenesulfonamidophenol)

Indane-1,3-diones (for example, 2-phenylindane-1,3-dione)

Chromans (for example, 2,2-dimethyl-7-t-butyl-6-hydroxychroman)

1,4-Dihydropyridines (for example, 2,6-dimethoxy-3,5-dicarbethoxy-1,4-dihydropyridine)

Ascorbic acid derivatives (for example, 1-ascorbic acid palmitate, and ascorbic acid stearate)

Unsaturated aldehydes (for example, ketone)

3-Pyrazolidones

Additional reducing agents that can be used as developing agents are substituted hydrazines including sulfonylhydrazines as described in U.S. Pat. No. 5,464,738. Other useful reducing agents are described for example, in U.S. Pat. Nos. 3,074,809, 3,094,417, 3,080,254, and 3,887,417. Auxiliary reducing agents described in U.S. Pat. No. 5,981,151 is also useful. All compounds disclosed in the above patents can be applied for the present invention.

The elements of reducing agent may comprise two or more constitutional elements such as a hindered phenol developing agent and a compound that can be selected from the various classes of co-reducing agents set forth below. Mixture of three developing agents involving the further addition of a contrast-enhancing agent is also useful.

As the co-reducing agent, trityl hydrazide or formylphenylhydrazide described in U.S. Pat. No. 5,496,695 can be used.

Various contrast-enhancing agents, which are used in black and white photothermographic materials, can be used in combination with the co-reducing agent. As the contrast-enhancing agent, the following compounds are useful, but the invention is not limited to these.

Hydroxylamines (including hydroxylamine, and alkyl- and aryl-substituted derivatives thereof), alkanolamines and ammonium phthalamate compounds described, for example, in U.S. Pat. No. 5,545,505, hydroxamic acid compounds described, for example, in U.S. Pat. No. 5,545,507, N-acylhydrazine compounds described, for example, in U.S. Pat. No. 5,558,983, and hydrogen atom donor compounds described in U.S. Pat. No. 5,637,449.

The all combination of reducing agent and non-photosensitive organic silver salt are not always effective evenly. One of the preferred combination is a combination of, as non-photosensitive silver source, silver salt of benztraizole or their substituted compounds or the mixture thereof, and as reducing agent, ascorbic acid reducing agent.

The reducing agent (or the mixture thereof) described herein is incorporated in an amount of from 1% by weight to 10% by weight (dry weight) of the image forming layer. In multilayer construction, if the reducing agent is added to a layer other than the image forming layer, slightly higher proportions may be more desirable, such as from about 2% by weight to 15% by weight. The co-developing agent is generally incorporated in an amount of from 0.001% by weight to 1.5% by weight (dry weight) of the image forming layer.

The reducing agent of the invention can be added to the image forming layer which comprises a non-photosensitive organic silver salt and a photosensitive silver halide and to the layer adjacent to the image forming layer, but is preferably contained in the image forming layer.

In the invention, the reducing agent may be incorporated into the black and white photothermographic material by being added into the coating solution in any form, such as in the form of solution, emulsion dispersion, solid fine particle dispersion, or the like.

As well known emulsion dispersing method, there can be mentioned a method comprising dissolving the reducing agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

As solid fine particle dispersing method, there can be mentioned a method comprising dispersing the reducing agent in a proper solvent such as water or the like, by means of ball mill, colloid mill, vibrating ball mill, sand mill, jet mill, roller mill, or ultrasonics, thereby obtaining solid dispersion. A dispersing method using a sand mill is preferable. During the dispersion, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). An antiseptic (for instance, benzisothiazolinone sodium salt) can be added in the water dispersion.

Particularly preferably, the reducing agent is used as a solid particle dispersion, and the reducing agent is added in the form of fine particles having average particle size from 0.01 μm to 10 μm, preferably, from 0.05 μm to 5 μm, and more preferably, from 0.1 μm to 1 μm. In the invention, other solid dispersions are preferably used with this particle size range.

(Nucleator)

The black and white photothermographic material of the present invention may contain a nucleator.

The nucleator usable in the present invention is a compound, which can form a compound that can newly induce a development by the reaction with a developing product in consequence of an initial development. It was conventionally known to use a nucleator for the ultra-high contrast photosensitive materials suitable for the use in graphic arts. The ultra-high contrast photosensitive materials had an average gradient of ten or more and were unsuitable for conventional photographic materials, and especially unsuitable for the medical use where high diagnostic ability was required. And because the ultra-high contrast photosensitive material had rough graininess and did not have enough sharpness, there was no potential for medical diagnostic use. The nucleator in the present invention completely differs from the nucleator in the conventional ultra-high contrast photosensitive material as regards the effect. The nucleator in the present invention does not make a hard gradation. The nucleator in the present invention is the compound that can cause development sufficiently, even if the number of photosensitive silver halide grains with respect to non-photosensitive silver salt of an organic acid is extremely low. Although that mechanism is not clear, when thermal development is performed using the nucleator according to the present invention, it becomes clear that a large number of developed silver grains exists than the number of photosensitive silver halide grains in the maximum density part, and it is presumed that the nucleator according to the present invention forms the new development points (development nuclei) in those portions where silver halide grains do not exist.

As the nucleator, hydrazine derivative compounds represented by the following formula (H), vinyl compounds represented by the following formula (G), quaternary onium compounds represented by the following formula (P), cyclic olefine compounds represented by formulae (A), (B), and (C), and the like are preferable examples.

Formula (H)

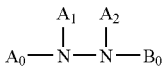

-continued

Formula (G)

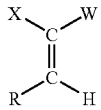

Formula (P)

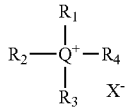

Formula (A)

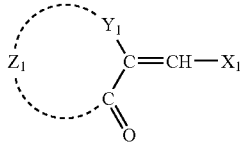

Formula (B)

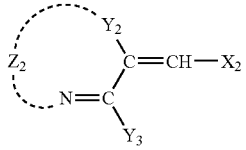

Formula (C)

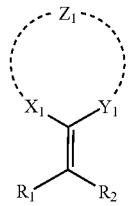

In formula (H), $A_0$ represents one selected from an aliphatic group, an aromatic group, a heterocyclic group, and a $-G_0-D_0$ group, each of which may have a substituent. $B_0$ represents a blocking group. $A_1$ and $A_2$ both represent a hydrogen atom, or one represents a hydrogen atom and the other represents one of an acyl group, a sulfonyl group, and an oxalyl group. Herein, $G_0$ represents one selected from a —CO— group, a —COCO— group, a —CS— group, a —C(=$NG_1D_1$) group, an —SO— group, an —$SO_2$— group, and a —P(O)($G_1D_1$)- group. $G_1$ represents one selected from a mere bonding hand, an —O— group, an —S— group, and an —N($D_1$)- group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like can be described.

In formula (H), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, and a benzyl group are described. These may be further substituted by a suitable substituent (e.g., an aryl group, an alkoxy group, an aryloxy group, an alkylthio group, an arylthio group, a sulfoxy group, a sulfonamide group, a sulfamoyl group, an acylamino group, a ureido group and the like).

In formula (H), the aromatic group represented by $A_0$ is preferably an aryl group of a single or condensed ring. For example, a benzene ring or a naphthalene ring is described. As a heterocycle represented by $A_0$, the heterocycle of a single or condensed ring containing at least one heteroatom selected from a nitrogen atom, a sulfur atom and an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. The arotamic group, heterocyclic group or $-G_0-D_0$ group, as $A_0$, may have a substituent. As $A_0$, an aryl group or a $-G_0-D_0$ group is particularly preferable.

And, in formula (H), $A_0$ preferably contains at least one of a diffusion-resistant group or an adsorptive group to silver halide. As a diffusion-resistance group, a ballast group usually used as non-moving photographic additive is preferable. As a ballast group, a photochemically inactive alkyl group, alkenyl group, alkynyl group, alkoxy group, phenyl group, phenoxy group, alkylphenoxy group and the like are described and it is preferred that the substituent part has 8 or more carbon atoms in total.

In formula (H), as an adsorption promoting group to silver halide, thiourea, a thiourethane group, a mercapto group, a thioether group, a thione group, a heterocyclic group, a thioamido heterocyclic group, a mercapto heterocyclic group, and an adsorptive group described in JP-A No. 64-90439 are described.

In formula (H), $B_0$ represents a blocking group and preferably a $-G_0-D_0$ group. $G_0$ represents one selected from a —CO— group, a —COCO— group, a —CS— group, a —C(=$NG_1D_1$) group, an —SO— group, an —$SO_2$— group, and a —P(O)($G_1D_1$)- group. As preferable $G_0$, a —CO— group and a —COCO— group are described. $G_1$ represents one selected from a mere bonding hand, an —O— group, an —S— group, and an —N($D_1$)- group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described. $A_1$ and $A_2$ both represent a hydrogen atom, or one of $A_1$ and $A_2$ represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), and an oxalyl group (an ethoxalyl group or the like).

As specific examples of the compound represented by formula (H), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

The compounds represented by formula (H) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (G) is explained. In formula (G), although X and R are displayed in a cis form, a trans form for X and R is also included in formula (G). This is also similar to the structure display of specific compounds.

In formula (G), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, and an immonium group.

R represents one selected from a halogen atom, a hydroxy group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt, or the like), an amino group, an alkylamino group, a cyclic amino group (e.g., a pyrrolidino group), an acylamino group, an oxycarbonylamino group, a heterocyclic group (a 5 or 6-membered nitrogen-containing heterocycle, e.g., a benztriazolyl group, an imidazolyl group, a triazolyl group, a tetrazolyl group, or the like), a ureido group, and a sulfonamide group. X and W, and X and R may bind each other to form a cyclic structure. As the ring formed by X and W, for example, pyrazolone, pyrazolidinone, cyclopentanedione, β-ketolactone, β-ketolactam, and the like are described.

Explaining formula (G) further, the electron-attracting group represented by X is a substituent which can have a positive value of substituent constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzooxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxysulfinyl and the like), a thiosulfinyl group (methylthiosulfinyl and the like), a sulfinamoyl group, a phosphoryl group, a nitro group, an imino group, a N-carbonylimino group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group or the like is also included. The substituent having σ p value of 0.30 or more is particularly preferable.

As an alkyl group represented by W, methyl, ethyl, trifluoromethyl and the like are described. As an alkenyl group as W, vinyl, halogen substituted vinyl, cyanovinyl and the like are described. As an alkynyl group as W, acetylenyl, cyanoacetylenyl and the like are described. As an aryl group as W, nitrophenyl, cyanophenyl, pentafluorophenyl and the like are described, and as a heterocyclic group as W, pyridyl, pyrimidyl, triazinyl, succinimide, tetrazolyl, triazolyl, imidazolyl, benzooxazolyl and the like are described. As W, the electron-attracting group having a positive a p value is preferable, and that value is more preferably 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described. More preferably, a hydroxy group, an alkoxy group, an organic or inorganic salt of hydroxy group or mercapto group and a heterocyclic group are described, and particularly preferably, a hydroxy group and an organic or inorganic salt of hydroxy group or mercapto group are described.

And among the substituents of X and W described above, the group having a thioether bond in the substituent is preferable.

As specific examples of the compound represented by formula (G), compound 1-1 to 92-7 of chemical formula Nos. 27 to 50 described in JP-A No. 2002-131864 are described, however specific examples are not limited in these.

In formula (P), Q represents a nitrogen atom or a phosphorus atom. $R_1$, $R_2$, $R_3$, and $R_4$ each independently represent a hydrogen atom or a substituent, and $X^-$ represents an anion. In addition, $R_1$ to $R_4$ may link each other to form a ring.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group and the like are described.

As the ring formed by linking $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring and the like are described.

The group represented by $R_1$ to $R_4$ may have a substituent such as a hydroxy group, an alkoxy group, an aryloxy group, a carboxyl group, a sulfo group, an alkyl group, an aryl group, and the like. As $R_1$, $R_2$, $R_3$, and $R_4$, a hydrogen atom and an alkyl group are preferable.

As the anion represented by $X^-$, an organic or inorganic anion such as a halogen ion, a sulfate ion, a nitrate ion, an acetate ion, a p-toluenesulfonate ion and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) and (B) are explained in detail. In formula (A), $Z_1$ represents a nonmetallic atomic group capable to form a 5 to 7-membered cyclic structure with —$Y_1$—C(═CH—$X_1$)—C(═O)—. $Z_1$ is preferably an atomic group selected from a carbon atom, an oxygen atom, a sulfur atom, a nitrogen atom and a hydrogen atom, and several atoms selected from these are bound each other by single bond or double bond to form a 5 to 7-membered cyclic structure with —$Y_1$—C(═CH—$X_1$)—C(═O)—. $Z_1$ may have a substituent, and $Z_1$ itself may be an aromatic or a non-aromatic carbon ring, or $Z_1$ may be a part of an aromatic or a non-aromatic heterocycle, and in this case, a 5 to 7-membered cyclic structure formed by $Z_1$ with —$Y_1$—C(═CH—$X_1$)—C(═O)— forms a condensed cyclic structure.

In formula (B), $Z_2$ represents a nonmetallic atomic group capable to form a 5 to 7-membered cyclic structure with —$Y_2$—C(═CH—$X_2$)—C($Y_3$)═N—. $Z_2$ is preferably an atomic group selected from a carbon atom, an oxygen atom, a sulfur atom, a nitrogen atom and a hydrogen atom, and several atoms selected from these are linked each other by single bond or double bond to form a 5 to 7-membered cyclic structure with —$Y_2$—C(═CH—$X_2$)—C($Y_3$)═N—. $Z_2$ may have a substituent, and $Z_2$ itself may be an aromatic or a non-aromatic carbon ring, or $Z_2$ may be a part of an aromatic or a non-aromatic heterocycle and in this case, a 5 to 7-membered cyclic structure formed by $Z_2$ with —$Y_2$—C(═CH—$X_2$)—C($Y_3$)═N— forms a condensed cyclic structure.

In the case where $Z_1$ and $Z_2$ have a substituent, examples of substituent are selected from the compounds listed below. Namely, as typical substituent, for example, a halogen atom (fluorine atom, chlorine atom, bromine atom or iodine atom), an alkyl group (includes an aralkyl group, a cycloalkyl group and an active methine group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including the group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, a N-substituted nitrogen-containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amide or phosphoric ester structure, a silyl group, a stannyl group, and the like are described. These substituents may be further substituted by these substituents.

Next, $Y_3$ is explained. In formula (B), $Y_3$ represents a hydrogen atom or a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamide group, a ureido group, a thioureido group, an imide group, an alkoxy group, an aryloxy group, an alkylthio group, an arylthio group, a heterocyclic thio group, and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-butoxy group, or the like), an aryloxy group (e.g., a phenoxy group, a p-t-pentylphenoxy group, a p-t-octylphenoxy group, or the like), a heterocyclic oxy group (e.g., a benzotriazolyl-5-oxy group, a pyridinyl-3-oxy group, or the like), a mercapto group (or a salt thereof), an alkylthio group (e.g., methylthio group, an ethlythio group, a butylthio group, a dodecylthio group, or the like), an arylthio group (e.g., a phenylthio group, a p-dodecylphenylthio group, or the like), a heterocyclic thio group (e.g., a 1-phenyltetrazoyl-5-thio group, a 2-methyl-1-phenyltriazolyl-5-thio group, a mercaptothiadiazolylthio group, or the like), an amino group, an alkylamino group (e.g., a methylamino group, a propylamino group, an octylamino group, a dimethylamino group, or the like), an arylamino group (e.g., an anilino group, a naphthylamino group, an o-methoxyanilino group, or the like), a heterocyclic amino group (e.g., a pyridylamino group, a benzotriazole-5-ylamino group, or the like), an acylamino group (e.g., an acetamide group, an octanoylamino group, a benzoylamino group, or the like), a sulfonamide group (e.g., a methanesulfonamide group, a benzenesulfonamide group a dodecylsulfonamide group, or the like), and a heterocyclic group.

Herein, a heterocyclic group is an aromatic or non-aromatic, a saturated or unsaturated, a single ring or condensed ring, and a substituted or unsubstituted heterocyclic group. For example, a N-methylhydantoyl group, a N-phenylhydantoyl group, a succinimide group, a phthalimide group, a N,N'-dimethylurazolyl group, an imidazolyl group, a benzotriazolyl group, an indazolyl group, a morpholino group, a 4,4-dimethyl-2,5-dioxo-oxazolyl group, and the like are described.

And herein, a salt represents a salt of an alkali metal (sodium, potassium, or lithium), a salt of an alkali earth metal (magnesium or calcium), a silver salt, a quaternary ammonium salt (a tetraethylammonium salt, a dimethylcetylbenzylammonium salt, or the like), a quaternary phosphonium salt, or the like. In formulae (A) and (B), $Y_1$ and $Y_2$ represent —C(═O)— or —$SO_2$—.

The preferable range of the compound represented by formulae (A) and (B) is described in JP-A No. 11-231459, paragraph Nos. 0027 to 0043. As specific examples of the compound represented by formulae (A) and (B), compound 1 to 110 of Table 1 to Table 8 in JP-A No. 11-231459 are described, however the invention is not limited in these.

Next, the compound represented by formula (C) is explained in detail. In formula (C), $X_1$ represents one selected from an oxygen atom, a sulfur atom, and a nitrogen atom. In the case where $X_1$ is a nitrogen atom, the bond of $X_1$ and $Z_1$ may be either a single bond or a double bond, and in the case of a single bond, a nitrogen atom may have a hydrogen atom or any substituent. As this substituent, for example, an alkyl group (includes an aralkyl group, a cycloalkyl group, an active methine group and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group, and the like are described. $Y_1$ represents the group represented by one selected from —C(═O)—, —C(═S)—, —SO—, —$SO_2$—, —C(═$NR_3$)—, and —($R_4$)C═N—. $Z_1$ represents a nonmetallic atomic group capable to form a 5 to 7-membered ring containing $X_1$ and $Y_1$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group, or an alkenyl group).

When $Z_1$ forms a 5 to 7-membered ring containing $X_1$ and $Y_1$, the ring is a saturated or unsaturated heterocycle, and may be a single ring or may have a condensed ring. When $Y_1$ is the group represented by C(═$NR_3$), ($R_4$)C═N, the condensed ring of this case may be formed by binding $R_3$ or $R_4$ with the substituent of $Z_1$.

In formula (C), $R_1$, $R_2$, $R_3$, and $R_4$ each independently represent a hydrogen atom or a substituent. However, $R_1$ and $R_2$ never bind each other to form a cyclic structure.

When $R_1$ and $R_2$ represent a monovalent substituent, the following groups are described as a monovalent substituent.

For example, a halogen atom (fluorine atom, chlorine atom, bromine atom, or iodine atom), an alkyl group (including an aralkyl group, a cycloalkyl group, an active methine group, and the like), an alkenyl group, an alkynyl group, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, a carboxyl group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (including the group in which ethylene oxy group units or propylene oxy group units are repeated), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, an heterocyclic amino group, a N-substituted nitrogen-containing heterocyclic group, an acylamino group, a sulfonamide group, a ureido group, a thioureido group, an imide group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amide or phosphoric ester structure, a silyl group, a stannyl group, and the like are described. These substituents may be further substituted by these monovalent substituents.

When $R_3$ and $R_4$ represent a substituent, the same substituent as what $R_1$ and $R_2$ may have except the halogen atom can be described as the substituent. Furthermore, $R_3$ and $R_4$ may further link to $Z_1$ to form a condensed ring.

Next, among the compounds represented by formula (C), preferable compounds are described. In formula (C), $Z_1$ preferably is an atomic group which forms a 5 to 7-membered ring with $X_1$ and $Y_1$, and consists of the atoms selected from 2 to 4 carbon atoms, a nitrogen atom, a sulfur atom, and an oxygen atom. A heterocycle, which is formed by $Z_1$ with $X_1$ and $Y_1$, preferably contains 3 to 40 carbon atoms in total, more preferably 3 to 25 carbon atoms in total, and most preferably 3 to 20 carbon atoms in total. $Z_1$ preferably comprises at least one carbon atom.

In formula (C), $Y_1$ is preferably —C(=O)—, —C(=S)—, —$SO_2$—, or —($R_4$)C=N—, particularly preferably, —C(=O)—, —C(=S)—, or —$SO_2$—, and most preferably, —C(=O)—.

In formula (C), in the case where $R_1$ and $R_2$ represent a monovalent substituent, the monovalent substituent represented by $R_1$ and $R_2$ is preferably one of the following groups having 0 to 25 carbon atoms in total, namely, those are an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a hydroxy group and a salt thereof, a mercapto group and a salt thereof, and an electron-attracting group. Herein, an electron-attracting group means the substituent capable to have a positive value of Hammett substituent constant $\sigma p$, and specifically a cyano group, a sulfamoyl group, an alkylsulfonyl group, an arylsulfonyl group, a sulfonamide group, an imino group, a nitro group, a halogen atom, an acyl group, a formyl group, a phosphoryl group, a carboxyl group (or a salt thereof), a sulfo group (or a salt thereof), a saturated or unsaturated heterocyclic group, an alkenyl group, an alkynyl group, an acyloxy group, an acylthio group, a sulfonyloxy group, and an aryl group substituted by these electron-attracting group are described. These substituents may have any substituents.

In formula (C), when $R_1$ and $R_2$ represent a monovalent substituent, more preferable are an alkoxy group, an aryloxy group, a heterocyclic oxy group, an alkylthio group, an arylthio group, a heterocyclic thio group, an amino group, an alkylamino group, an arylamino group, a heterocyclic amino group, a ureido group, an imide group, an acylamino group, a sulfonamide group, a heterocyclic group, a hydroxy group or a salt thereof, a mercapto group or a salt thereof, and the like. In formula (C), $R_1$ and $R_2$ particularly preferably are a hydrogen atom, an alkoxy group, an aryloxy group, an alkylthio group, an arylthio group, a heterocyclic group, a hydroxy group or a salt thereof, a mercapto group or a salt thereof, or the like. In formula (C), most preferably, one of $R_1$ and $R_2$ is a hydrogen atom and another is an alkoxy group, an aryloxy group, an alkylthio group, an arylthio group, a heterocyclic group, a hydroxy group or a salt thereof, or a mercapto group or a salt thereof.

In formula (C), when $R_3$ represents a substituent, $R_3$ is preferably an alkyl group having 1 to 25 carbon atoms in total (including an aralkyl group, a cycloalkyl group, an active methine group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group, or the like. An alkyl group and an aryl group are particularly preferable.

In formula (C), when $R_4$ represents a substituent, $R_4$ is preferably an alkyl group (including an aralkyl group, a cycloalkyl group, an active methine group, and the like) having 1 to 25 carbon atoms in total, an aryl group, a heterocyclic group, a heterocyclic group containing a quaternary nitrogen atom (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, or the like. Particularly preferably, an alkyl group, an aryl group, an alkoxy group, an aryloxy group, a heterocyclic oxy group, an alkylthio group, an arylthio group, a heterocyclic thio group, and the like are described. When $Y_1$ represents C($R_4$)=N, the carbon atom in $Y_1$ binds with the carbon atom substituted by $X_1$ or $Y_1$.

Specific compounds represented by formula (C) are represented by A-1 to A-230 of chemical formula Nos. 6 to 18 described in JP-A No. 11-133546, however the invention is not limited in these.

The addition amount of the above nucleator is in a range from $10^{-5}$ mol to 1 mol per 1 mol of organic silver salt, and preferably, in a range from $10^{-4}$ mol to $5\times10^{-1}$ mol.

The nucleator described above may be incorporated into the black and white photothermographic material by being added into the coating solution, such as in the form of a solution, an emulsion dispersion, a solid fine particle dispersion, or the like.

As well known emulsion dispersing method, there can be mentioned a method comprising dissolving the nucleator in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there can be mentioned a method comprising dispersing the powder of the nucleator in a proper solvent such as water or the like, by means of ball mill, colloid mill, vibrating ball mill, sand mill, jet mill, roller mill, or ultrasonics, thereby obtaining solid dispersion. In this step, there can also be used a protective colloid (such as polyvinyl alcohol), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the water dispersion.

The nucleator is particularly preferably used as solid particle dispersion, and is added in the form of fine particles having average particle size from 0.01 μm to 10 μm, preferably from 0.05 μm to 5 μm and, more preferably from 0.1 μm to 2 μm.

In the black and white photothermographic material which is subjected to a rapid development where time period for development is 20 seconds or less, the compound represented by formulae (H) or (P) is used preferably, and the compound represented by formula (H) is used particularly preferably, among the nucleators described above.

In the black and white photothermographic material where low fog is required, the compound represented by formulae (G), (A), (B), or (C) is used preferably, and the compound represented by formulae (A) or (B) is particularly preferably used. Moreover, in the black and white photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

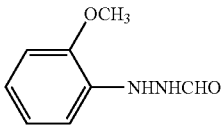

SH-2

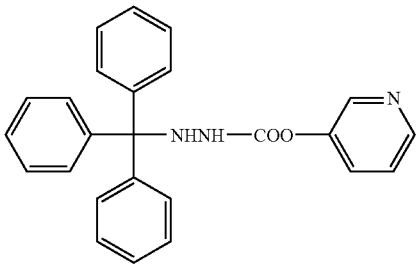

SH-3

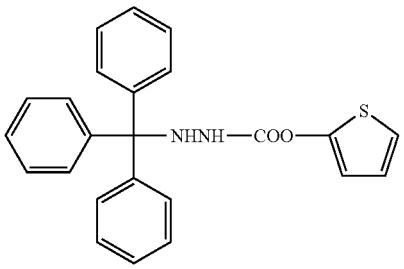

-continued

SH-4

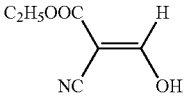

SH-5

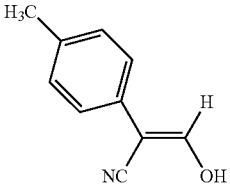

SH-6

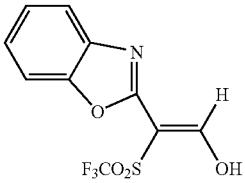

SH-7

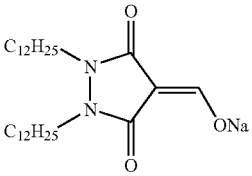

SH-8

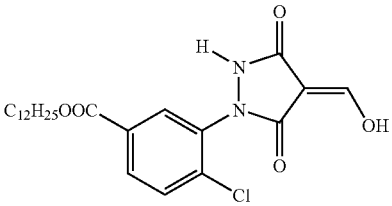

SH-9

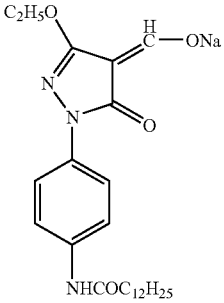

SH-10

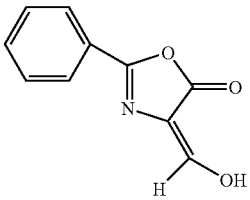

SH-11

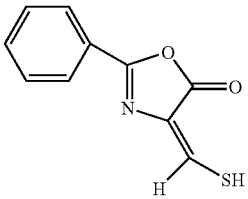

-continued

SH-12

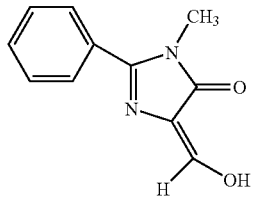

The nucleator of the present invention can be added to the image forming layer or the layer adjacent to the image forming layer, however, it is preferably added to the image forming layer. The addition amount of nucleator is in a range from $10^{-5}$ mol to 1 mol per 1 mol of organic silver salt, and preferably, in a range from $10^{-4}$ mol to $5\times10^{-1}$ mol. The nucleator may be added either only one kind or, two or more kinds in combination.

(Development Accelerator)

In the black and white photothermographic material of the invention, sulfonamidophenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (I) described in the specification of JP-A No. 2002-278017; and phenolic or naphthalic compounds represented by formula (2) described in the specification of JP-A No. 2001-264929 are used preferably as a development accelerator.

Further, phenolic compounds described in JP-A Nos. 2002-311533 and 2002-341484 are also preferable. Naphthalic compounds described in JP-A No. 2003-66558 are particularly preferable. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) and (A-2).

$Q_1$-NHNH-$Q_2$ Formula (A-1)

(wherein, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by $Q_1$ is, preferably, 5 to 7-membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings, in which the rings described above are condensed to each other, are also preferred.

The rings described above may have substituents and in a case where they have two or more substituents, the substituents may be identical or different with each other. Examples of the substituents can include halogen atom, alkyl group, aryl group, carbonamide group, alkylsulfonamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfonamide group, arylsulfonamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl, and N-benzylcarbamoyl.

The acyl group represented by $Q_2$ is an acyl group having preferably 1 to 50 carbon atoms and, more preferably 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group having preferably 2 to 50 carbon atoms, and more preferably, 6 to 40 carbon atoms and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group preferably having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butyl-sulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group preferably having 0 to 50 carbon atoms, and more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Then, preferred range for the compounds represented by formula (A-1) is to be described. 5 or 6-membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

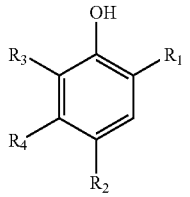

In formula (A-2), $R_1$ represents one selected from an alkyl group, an acyl group, an acylamino group, a sulfonamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), and a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). Among them, an acylamino group (including a ureido group or a urethane group) is more preferred. $R_2$ is preferably a halogen atom (more preferably, a chlorine atom, a bromine atom), an alkoxy group (for example, a methoxy group, a butoxy group, a n-hexyloxy group, a n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, alkyl group, or an acylamino group, and more preferably an alkyl group or an acylamino group. Examples of the preferred substituent thereof are similar to those for $R_1$. In a case where $R_4$ is an acylamino group, $R_4$ may preferably link with $R_3$ to form a carbostyryl ring.

In a case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, a benzoyl group is particularly preferred. $R_2$ is, preferably, one of an alkoxy group and an aryloxy group and, particularly preferably an alkoxy group.

Preferred specific examples for the development accelerator of the invention are to be described below. The invention is not restricted to them.

A-1

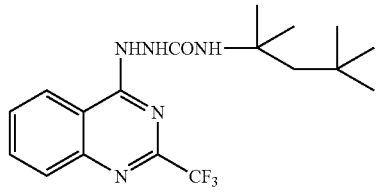

A-2

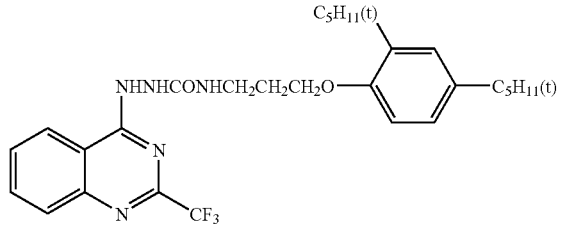

A-3

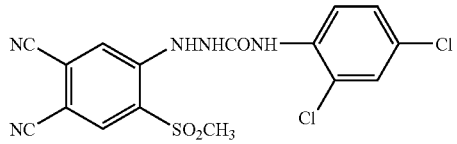

A-4

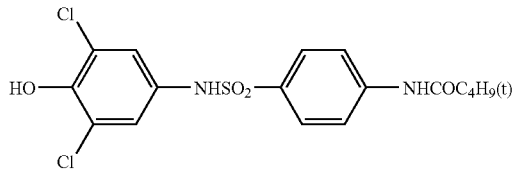

A-5

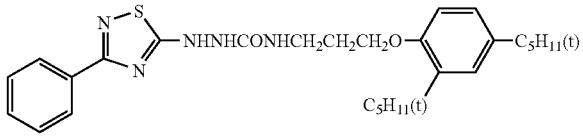

-continued

A-6

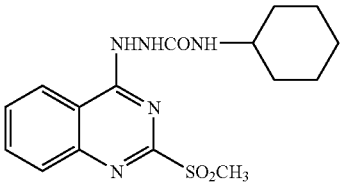

A-7

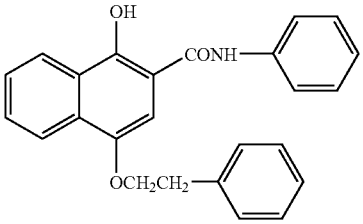

A-8

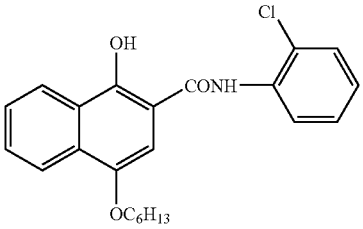

A-9

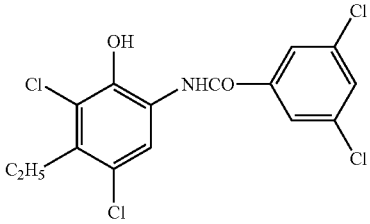

A-10

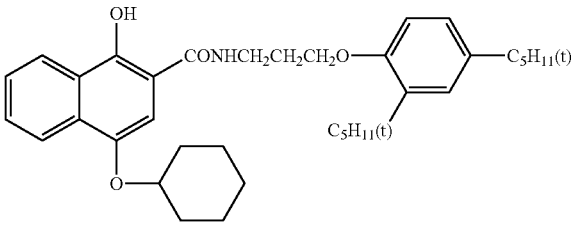

(Hydrogen Bonding Compound)

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group capable of forming a hydrogen bond, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Preferred among them are a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

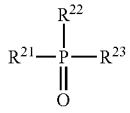

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ have a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1
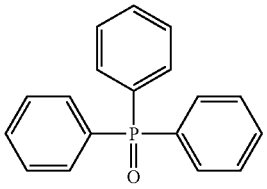
D-2
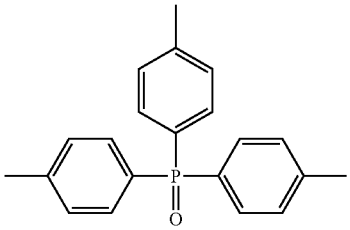
D-3
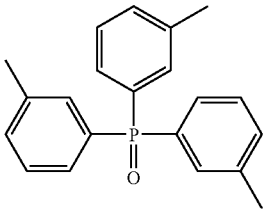
D-4
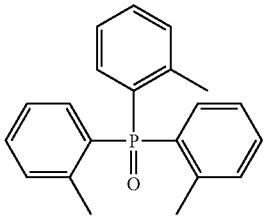
D-5
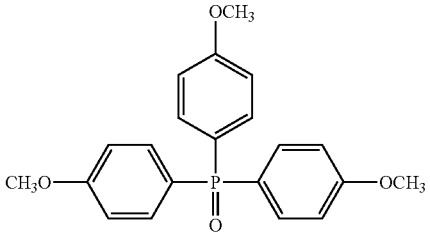
D-6
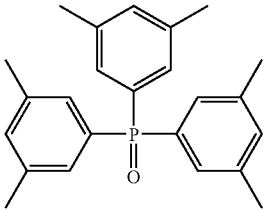
D-7
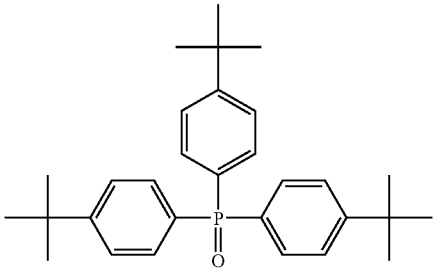
-continued
D-8
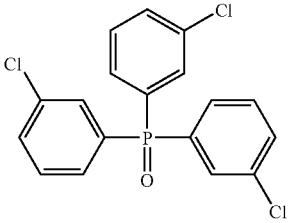
D-9
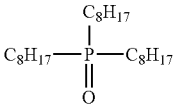
D-10
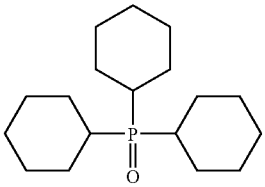
D-11
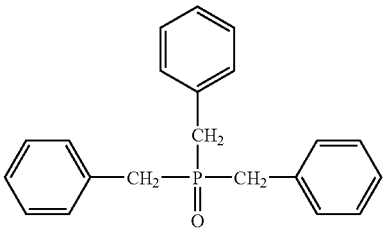
D-12
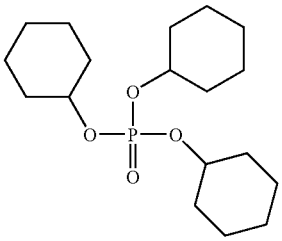
D-13
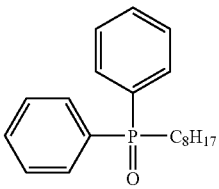
D-14
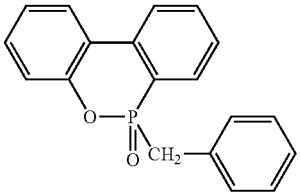

-continued

D-15

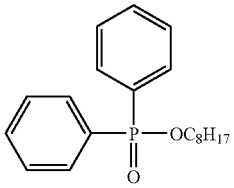

D-16

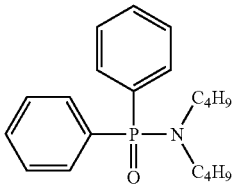

D-17

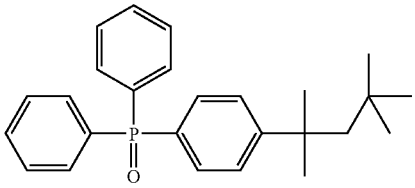

D-18

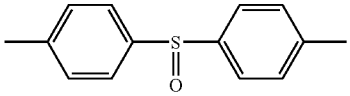

D-19

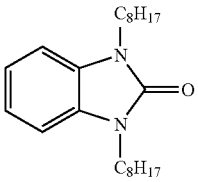

D-20

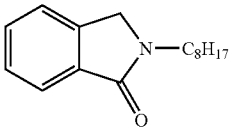

D-21

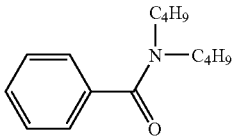

Specific examples of hydrogen bonding compounds other than those enumerated above can be found in those described in JP-A Nos. 2001-281793 and 2002-14438.

The hydrogen bonding compound of the invention can be used in the black and white photothermographic material by being incorporated into the coating solution in the form of solution, emulsion dispersion, or solid fine particle dispersion, similar to the case of the reducing agent.

In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill and the like.

The hydrogen bonding compound of the invention is preferably used in a range from 1 mol % to 200 mol %, more preferably from 10 mol % to 150 mol %, and further preferably, from 30 mol % to 100 mol %, with respect to the reducing agent.

(Binder)

The binder used in the black and white photothermographic material of the present invention will be described.

Photosensitive silver halides, non-photosensitive silver sources which are capable of supplying reducible silver ions, reducing agents, toners and any other additives used for the present invention are generally held in one or more binders.

In the present invention, the binder is preferably a hydrophilic polymer or a polymer latex dispersed in a water medium. It is preferred that an aqueous medium (where at least 50% by weight, more preferably at least 70% by weight of the solution may consist of water) is used to prepare the black and white photothermographic material of the present invention.

A mixture of plural binders can also be used as the binder.

1) Hydrophilic Binder

Examples of useful hydrophilic binder include, protein and protein derivatives, gelatin and gelatin derivatives (hardened or unhardened, alkali-treated gelatin, acid-treated gelatin, acetylated gelatin, oxidized gelatin, phthalated gelatin and deionized gelatin), cellulosic materials such as hydroxymethyl cellulose and cellulose ester, acrylamide/methacrylamide polymers, acrylic/methacrylic polymer, polyvinyl pyrrolidones, polyvinyl alcohols, polyvinyl lactams, polymer of sulfoalkyl acrylate or methacrylate, hydrolysised polyvinyl acetate, polyacrylamide, polysaccarides (for example, dextrans and starch ethers), and other synthetic or natural peptizer which is well known for aqueous photographic emulsion (for example, Research Disclosure, Item 38957), but the invention is not limited to these examples. The cationic starches can be preferably used as a peptizer of tabular grain emulsion as described in U.S. Pat. Nos. 5,620,840 and 5,667,955.

Especially, examples of useful hydrophilic binder include gelatin, gelatin derivatives, polyvinyl alcohol, and cellulosic materials. Gelatin and derivatives thereof are most preferred and preferably present in at least 75% by weight of the total binder when the mixtures of binders are used.

So long as the binder can be selected from hydrophilic polymers in an amount of 50% by weight or more of total binder, "minor" portions of hydrophobic binder may also be present. Examples of typical hydrophobic binder include, but are not limited to these examples, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily known to one skilled in the art. Copolymers (including trimers) are also included in the definition of polymers. The polyvinyl acetals (for example, polyvinyl butyral and polyviyl formal) and vinyl copolymers (for, example, polyvinyl acetate and polyvinyl chloride) are particularly preferred. Examples of preferred binder are polyvinyl butyral resins that are available as BUTVAR B79 (trade mark, Solutia, Inc.) and PIOLOFORM BS-18, or PIOLOFORM BL-16 (trade mark, Wacker Chemical Company). Water dispersion of hydrophobic binder (for example, latex) in a minor amount can also be used. For example, such latex binder is described in EP No. 0911691A1.

Hardeners for various binders can be used, when necessary. Hydrophilic binders used in the black and white photothermographic material can be hardened partially or completely by a conventional hardener. For example, useful hardeners are well known and include vinyl sulfone synthetic compounds described, for example, in U.S. Pat. No. 6,143,487 and EP No. 040589, and aldehydes and other various hardeners are described in U.S. Pat. No. 6,190,822 and T. H. James, "The THEORY OF THE PHOTOGRAPHIC PROCESS", Fourth Edition, published by Macmillan publishing Co., Inc. (1977), chapter 2, pages 77 to 78.

Where the black and white photothermographic materials require a particular developing time and temperature, the binder should be able to withstand those conditions. Generally, it is preferred that the binder does not decompose or lose its structural integrity at 150° C. for 60 seconds. It is more preferred that it does not decompose or lose its structural integrity at 177° C. for 60 seconds.

The polymer binders are used in an amount sufficient to carry the components dispersed therein. An effective range can be approximately determined by one skilled in the art. Preferably, a binder is used in an amount of about 10% by weight to 90% by weight with respect to the total dry weight of the layer in which it is included, and more preferably about 20% by weight to 70% by weight. In the case of double-side photothermographic material, the amounts of the binder for both sides may be either the same or different.

2) Polymer Latex

Dispersed states may be a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in a range from 1 nm to 50000 nm, preferably from 5 nm to 1000 nm, more preferably from 10 nm to 500 nm, and further preferably from 50 nm to 200 nm. There is no particular limitation concerning particle size distribution of the dispersed particles, and they may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chloride)s, poly(vinyl acetate)s, poly(vinylidene chloride)s, polyolefins, and the like. The polymers above may be straight chain polymers, branched polymers, or crosslinked polymers; and may be so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range from 5,000 to 1,000,000, and preferably from 10,000 to 200,000. Those having too small a molecular weight exhibit insufficient mechanical strength on forming the image forming layer, and those having too large a molecular weight are also not preferred because the resulting film-forming properties are poor. Further, a polymer latex having crosslinking property is particularly preferably used.

<Specific Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of—MMA(70)—EA(27)—MAA(3)—(molecular weight 37000, Tg 61° C.)

P-2; Latex of—MMA(70)—2EHA(20)—St(5)—AA(5)—(molecular weight 40000, Tg 59° C.)

P-3; Latex of—St(50)—Bu(47)—MAA(3)—(crosslinking, Tg −17° C.)

P-4; Latex of—St(68)—Bu(29)—AA(3)—(crosslinking, Tg 17° C.)

P-5; Latex of—St(71)—Bu(26)—AA(3)—(crosslinking, Tg 24° C.)

P-6; Latex of—St(70)—Bu(27)—IA(3)—(crosslinking)

P-7; Latex of—St(75)—Bu(24)—AA(1)—(crosslinking, Tg 29° C.)

P-8; Latex of—St(60)—Bu(35)—DVB(3)—MAA(2)—(crosslinking)

P-9; Latex of—St(70)—Bu(25)—DVB(2)—AA(3)—(crosslinking)

P-10; Latex of—VC(50)—MMA(20)—EA(20)—AN(5)—AA(5)—(molecular weight 80000)

P-11; Latex of—VDC(85)—MMA(5)—EA(5)—MAA(5)—(molecular weight 67000)

P-12; Latex of—Et(90)—MAA(10)—(molecular weight 12000)

P-13; Latex of—St(70)—2EHA(27)—AA(3)—(molecular weight 130000, Tg 43° C.)

P-14; Latex of—MMA(63)—EA(35)—AA(2)—(molecular weight 33000, Tg 47° C.)

P-15; Latex of—St(70.5)—Bu(26.5)—AA(3)—(crosslinking, Tg 23° C.)

P-16; Latex of—St(69.5)—Bu(27.5)—AA(3)—(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer. Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above.

As the latex of styrene-butadiene copolymer preferably used in the invention, there can be mentioned P-3 to P-8, and P-15, or commercially available LACSTAR 3307B, LACSTAR 7132C, Nipol Lx416, and the like.

In the image forming layer of the black and white photothermographic material according to the invention, if necessary, there can be added hydrophilic polymers such as gelatin, polyvinyl alcohol, methyl cellulose, hydroxypropyl cellulose, carboxymethyl cellulose, or the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is preferably in a range of from 1/10 to 10/1, more preferably from 1/3 to 5/1, and further preferably 1/1 to 3/1.

The image forming layer is, in general, a photosensitive layer containing a photosensitive silver halide, i.e., the photosensitive silver salt; in such a case, the weight ratio for total binder to silver halide (total binder/silver halide) is in a range of from 400 to 5, and more preferably, from 200 to 10.

The total amount of binder in the image forming layer of the invention is preferably in a range from 0.2 $g/m^2$ to 30 $g/m^2$, more preferably from 1 $g/m^2$ to 15 $g/m^2$ and further preferably from 2 $g/m^2$ to 10 $g/m^2$. As for the image forming layer of the invention, there may be added a crosslinking agent for crosslinking, or a surfactant and the like to improve coating properties.

<Preferable Solvent of Coating Solution>

In the invention, a solvent of a coating solution for the image forming layer in the black and white photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide, ethyl acetate, and the like. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

In order to control the characteristic of the properties of photothermographic material (e.g., gradation, Dmin, sensitivity and fog), it is also preferred to add one or more heteroaromatic ring mercapto compound or heteroaromatic ring disulfide compound represented by the formulae Ar—S-$M^1$ or Ar—S—S—Ar. Herein, $M^1$ represents a hydrogen atom or an alkali metal atom, and Ar represents a hetero aromatic ring or a heteroaromatic condensed ring containing at least one or more among a nitrogen atom, a sulfur atom, an oxygen atom, a selenium atom, and a tellurium atom.

As a preferred heteroaromatic ring, benzimidazole, naphthoimidazole, benzothaizole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, and quinazoline are described. The heteroaromatic ring compound, which functions as a supersensitizer, is also preferred. For example, the heteroaromatic ring mercapto compound is described in EP-A No. 0559228 as a supersensitizer for infrared black and white photothermographic materials.

In the black and white photothermographic material of the present invention, an antifoggant or a stabilizer can be used to prevent the generation of fog and to improve the deterioration in sensitivity at the storage. Mercury (II) salt can be also added to the image forming layer, when necessary. The preferred mercury (II) salts for these purposes are mercury acetate and mercury bromide. Another useful mercury salts are described in U.S. Pat. No. 2,728,663.

As suitable antifoggant and stabilizer used by a combination of another method or alone, thiazolium salts described in U.S. Pat. Nos. 2,131,038 and 2,694,716, azaindenes described in U.S. Pat. No. 2,886,437, triazaindolidines described in U.S. Pat. No. 2,444,605, urazoles described in U.S. Pat. No. 3,287,135, sulfocatechols described in U.S. Pat. No. 3,235,652, oximes described in G.B. Patent No. 623448, multivalent metal salts described in U.S. Pat. No. 2,839,405, thiuronium salts described in U.S. Pat. No. 3,220,839, palladium, platinum, and gold salts described in U.S. Pat. Nos. 2,566,263 and 2,597,915, the compound having a —$SO_2CBr_3$ group described in U.S. Pat. Nos. 5,594,143 and 5,374,514,2-(tribromopmethylsulfonyl) quinoline compounds described in U.S. Pat. No. 5,460,938, and the like are described.

The stabilizer precursor, which can release a stabilizer according to the heat during thermal development, can be also used. Such precursor compounds are described in, for example, U.S. Pat. Nos. 5,158,866, 5,175,081, 5,298,390, and 5,300,420.

Further, it was proved that benzotriazoles having a substituted sulfonyl group (e.g., alkylsulfonylbenzotriazoles and arylsulfonylbenzotriazoles) were useful stabilizers (for example, improvement in stability after development) as described in U.S. Pat. No. 6,171,767.

Further, another useful antifoggants/stabilizers are described in U.S. Pat. No. 6,083,681 in more detail.

The black and white photothermographic material of the present invention may have a polyhalogen antifoggant containing one or more polyhalogen substituents having a dichloro group, a dibromo group, a trichloro group, a tribromo group, or the like. These antifoggants may be an aliphatic, alycyclic, or aromatic synthetic compound including a heterocycle or a carbocycle.

Especially useful of this type of antifoggant is a polyhalogen compound having a $—SO_2(X')_3$ group. Herein, X' represents a halogen atom, which is the same or different.

As another useful antifoggant, the compound represented by the following formula (I) and having the pKa of 8 or less can be described.

$$R^1—SO_2—C(R^2)R^3—(CO)_m-(L_1)_n-SG \quad \text{Formula (I)}$$

wherein, $R^1$ represents an aliphatic group or a cyclic group. $R^2$ and $R^3$ each independently represent a hydrogen atom or a bromine atom, at least one of them is bromine. $L_1$ represents a divalent aliphatic linking group, m and n each independently represent 0 or 1, and SG represents a soluble group having the pKa of 8 or less.

As preferred embodiment of formula (I):

Both of m and n are O, SG is one selected from a carboxyl group (or a salt thereof), a sulfo group (or a salt thereof), a phospho group (or a salt thereof), $(—SO_2N^-COR^4)(M^2)^+$, and $(—N^{-SO}{}_2R^4)(M^2)^+$.

m is 1 and n is O, and SG is one selected from a carboxyl group (or a salt thereof), a sulfo group (or a salt thereof), a phospho group (or salt thereof), and $(—N^-SO_2R^4)(M^{2})^+$.

Both of m and n are 1, SG is one selected from a carboxyl group (or a salt thereof), a sulfo group (or a salt thereof), a phospho group (or a salt thereof), and $(—SO_2N^-COR^4)(M^2)^+$.

Herein, $R^4$ is an aliphatic group or a cyclic group and $(M^2)^+$ is an anion other than a proton.

(Other Additives)

1) Toner

A toner is a synthetic compound, which improves color tone of a developed silver image and increases optical density of developed image.

In a black and white photothermographic material, especially useful toner is the compound, which attributes to form the image having pure black tone.

Therefore, it is desirable to use a toner or a derivative thereof, and it is desirable to contain it in the black and white photothermographic material of present invention.

Such compound is well known in the technology of black and white photothermographic materials and described in U.S. Pat. Nos. 3,080,254, 3,847,612, 4,123,282, 4,082,901, 3,074,809, 3,446,648, 3,844,797, 3,951,660, 5,599,647, 4,220,709, 4,451,561, 4,543,309, 3,832,186, 4,201,582, and 3,881,938, and G.B. Patent No. 1439478.

Special examples are described in the following, however, the invention is not limited in these. Phthalimide, N-hydroxyphthalimide, cyclic imide (e.g., succinimide), pyrazoline-5-one, quinazoline, 1-phenylurazole, 3-phenyl-2-pyrazoline-5-one, 2,4-thiazolidinedione, naphthalimide (e.g., N-hydroxy-1,8-naphthalimide), cobalt complex (e.g., hexaminocobalt (3+) trifluoroacetate), mercaptan (e.g., mercaptotriazoles including 3-mercapto-1,2,4-triazole, 3-mercapto-4-phenyl-1,2,4-triazole, 4-phenyl-1,2,4-triazolidine-3,5-dithione, 4-allyl-3-amine-5-mercapto-1,2,4-triazole, 4-methyl-5-thioxo-1,2,4-triazolidine-3-one and the like, pyrimides including 2,4-dimercaptopyrimidine, thiadiazoles including 2,5-dimercapto-1,3,4-thiadiazole and 5-methyl-1,3,4-thiadiazolyl-2-thiol, mercaptotetrazoles including 1-phenyl-5-mercaptotetrazole, and 5-acetylamino-1,3,4-thiadiazoline-2-thione, mercaptoimidazoles including 1,3-dihydro-1-phenyl-2H-imidazole-2-thione), N-(aminomethyl)allyldicarboxyimides [e.g., (N,N-dimethylaminomethyl)phthalimide, and N-(dimethylaminomethyl)naphthalene-2,3-dicarboxyimide], a combination of blocked pyrazoles, isothiuronium derivatives, and special photographic bleaching agent [e.g., a combination of N,N'-hexamethylene-bis-(1-carbamoyl-3,5-dimethylpyrazole), 1,8-(3,6-diazaoctane)bis(isothiuronium) trifluoroacetate, and 2-(tribromomethylsulfonyl)benzothiazole], merocyanine dye {e.g., 3-ethyl-5-[(3-ethyl-2-benzothiazolinylidene)-1-methylethylidene]-2-thio-2,4-oazolidinedione}, phthalazine and derivatives thereof [e.g., described in U.S. Pat. No. 6,146,822], phtahalazinone and derivatives thereof or a metal salt of the derivative [e.g., 4-(1-naphthyl)phthalazinone, 6-chlorophthalazinone, 5,7-dimethoxyphthalazinone, and 2,3-dihydro-1,4-phthalazinedione], a combination of phthalazine (or a derivative thereof) and one or more phthalic acid derivatives (e.g., phthalic acid, 4-methylphthalic acid, 4-nitrophthalic acid, and tetrachlorophthalic anhydride), quinazolinediones, benzoxazines or naphthoxazine derivatives, rhodium complex which has not only the function of toner but also is the halogen source to form a silver halide in-situ [e.g., 6 chlororhodium (III) ammonium, rhodium bromide, rhodium nitrate and 6 chlororhodium (III) potassium], benzoxazine-2,4-diones (e.g., 1,3-benzoxazine-2,4-dione, 8-methyl-1,3-benzoxazine-2,4-dione, and 6-nitro-1,3-benzoxazine-2,4-dione), pyrimidines and asym-triazines (e.g., 2,4-dihydroxypyrimidine, 2-hydroxy-4-aminopyrimidine, and azauracil) and tetrazapentalene derivatives [e.g., 3,6-dimercapto-1,4-diphenyl-1H,4H-2,3a,5,6a-tetrazapentalene and 1,4-di(o-chlorophenyl)-3,6-dimercapto-1H,4H-2,3a,5,6a-tetrazapentalene].

In the case where a silver salt of nitrogen-containing heterocyclic compound is used as a non-photosensitive silver source which is capable of supplying reducible silver ions, and ascorbic acid, an ascorbic acid complex, or an ascorbic acid derivative is used as a reducing agent, the mercapto compound represented by formula (II) is a especially useful toner of the present invention.

Formula (II)

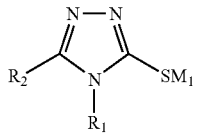

In formula (II), $R_1$ and $R_2$ each independently represent one selected from a hydrogen atom, a substituted or unsubstituted alkyl group having 1 to 7 carbon atoms (e.g., a methyl group, an ethyl group, an isopropyl group, a t-butyl group, a n-hexyl group, a hydroxymethyl group, and a benzyl group), a substituted or unsubstituted alkenyl group wherein the hydrocarbon chain has 2 to 5 carbon atoms (e.g., an ethynyl group, a 1,2-propenyl group, a methallyl group, and a 3-butene-1-yl group), a substituted or unsubstituted cycloalkyl group where its ring is formed by 5 to 7 carbon atoms (e.g., a cyclopentyl group, a cyclohexyl group and a 2,3-dimethylcyclohexyl group), a substituted or unsubstituted, aromatic or non-aromatic heterocycle wherein the heterocycle is formed by 5 or 6 carbon atoms and a nitrogen atom, an oxygen atom, or a sulfur atom (e.g., pyridyl, furanyl, thiazolyl, and thienyl), an amino group or an amide group (e.g., an amino group or an acetamide group) and a substituted or unsubstituted aryl group wherein the aromatic ring is formed by 6 to 10 carbon atoms (e.g., phenyl, toluyl, naphthyl and 4-ethoxyphenyl).

Further, $R_1$ and $R_2$ are substituted or unsubstituted $Y_1$—$(CH_2)_k$—, herein, $Y_1$ is a substituted or unsubstituted aryl group having 6 to 10 carbon atoms defined by $R_1$ and $R_2$ described above or a substituted or unsubstituted, aromatic or non-aromatic heterocyclic group defined by $R_1$ and k is an integer from 1 to 3.

Or, by linking each other, $R_1$ and $R_2$ are a substituted or unsubstituted 5 to 7-membered aromatic or non-aromatic heterocycle including a carbon atom, a nitrogen atom, an oxygen atom, or a sulfur atom. As examples, pyridyl, diazinyl, triazinyl, piperidine, morpholine, pyrrolidine, pyrazolidine, and thiomorpholine can be described.

Further, $R_1$ and $R_2$ may be a divalent linking group which link with two mercaptotriazole groups (e.g., a phenylene group, a methylene group, and an ethylene group), and $R_2$ may further be a carboxyl group and a salt thereof.

$M_1$ is a hydrogen atom or a monovalent anion (e.g., an alkali metal anion, an ammonium ion, or a pyridinium ion).

The mercaptotriazole of formula (II) is preferred to fulfill the following conditions.

(1) $R_1$ and $R_2$ are not hydrogen atoms simultaneously.

(2) When $R_1$ is a substituted or unsubstituted phenyl group or benzyl group, $R_2$ is not a substituted or unsubstituted phenyl group or benzyl group.

(3) When $R_2$ is a hydrogen atom, $R_1$ is not an allenyl, 2,2-diphenylethyl, α-methylbenzyl, or phenyl group having a cyano group or a sulfonic acid group.

(4) When $R_1$ is a benzyl group or a phenyl group, $R_2$ is not a 1,2-dihydroxyethyl group or a 2-hydroxy-2-propyl group having a substituent.

(5) When $R_1$ is a hydrogen atom, $R_2$ is not a 3-phenylthiopropyl group.

Furthermore, one of preferred embodiment is the following black and white photothermographic material.

(6) The pH of at least one image forming layer capable of being thermal developed is 7 or less.

$R_1$ is preferably a methyl group, a t-butyl group, a substituted phenyl group, or a benzyl group. And $R_1$ more preferably is a benzyl group. $R_1$ can represent a divalent linking group which link two mercaptotriazole groups (e.g., phenylene, methylene, or an ethylene group).

$R_2$ is preferably a hydrogen atom, an acetamide group, or a hydroxymethyl group, and more preferably, a hydrogen atom. $R_2$ can represent a divalent linking group which link two mercaptotriazole groups (e.g., phenylene, methylene, or an ethylene group).

As described above, one embodiment is that the pH of at least one image forming layer capable of being thermal developed is 7 or less. The pH of the layer may be controlled to acidic by adding an ascorbic acid as a developing agent. Or the pH may be controlled by adjusting the pH of a silver salt dispersion before coating by addition of a mineral acid, for example, sulfuric acid or nitric acid, or an organic acid such as citric acid.

The pH of at least one image forming layer is preferably less than 7, and more preferably, less than 6. This pH value can be determined by using surface pH electrode after dropping one drop of $KNO_3$ solution on a sample surface. Such electrode can be obtained from Corning Co., Ltd. (Corning (N.Y.)).

Many of toners described here are heterocyclic synthetic compounds. It is known well that a tautomer exists in a heterocyclic synthetic compound. Furthermore, a cyclic tautomer and a substituent tautomer are also possible. For example, it is possible that at least 3 tautomers (1H-type, 2H-type, and 4H-type) exist in 1,2,4-mercaptotetrazole which is a preferable toner.

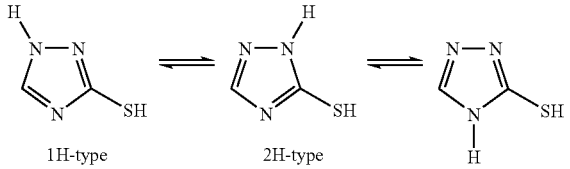

Furthermore, 1,2,4-mercaptotriazole can form thiol-thione substituent tautomer.

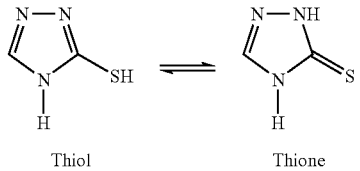

The mutual conversion of these tautomers can be occurred rapidly. And one tautomer may be dominant although each tautomer can not be isolated.

In the present invention, 1,2,4-mercaptotriazole is described as a 4H-thiol structure, however it is used on the assumption that such tautomers exist.

In the case where silver salt of benzotriazole is used as a non-photosensitive silver source which is capable of supplying reducible silver ions and ascorbic acid is used as a reducing agent, the mercaptotriazole compound represented by formula (II) is particularly preferred. A black image having high image density can be obtained by using the compound represented by formula (II).

Representative examples T-1 to T-59 of the compound represented by formula (II), which are preferably used in the present invention, are shown below.

T-1

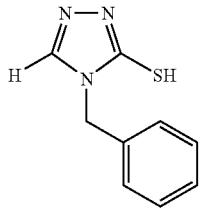

T-2

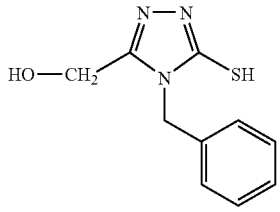

-continued
T-3
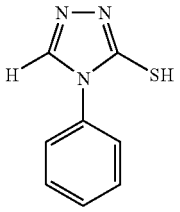
T-4
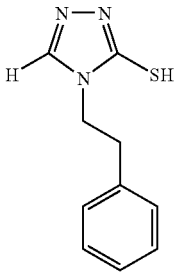
T-5
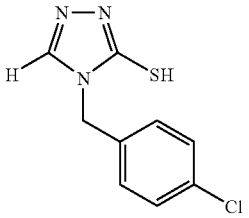
T-6
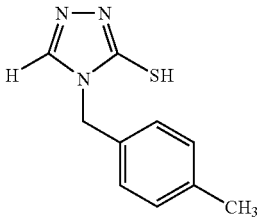
T-7
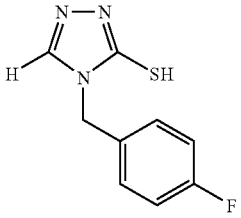
T-8
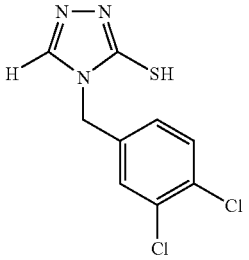
-continued
T-9
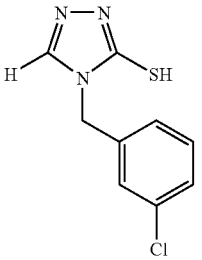
T-10
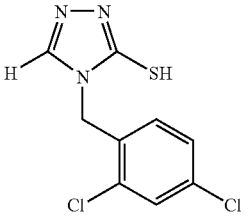
T-11
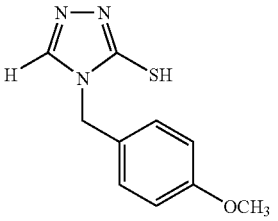
T-12
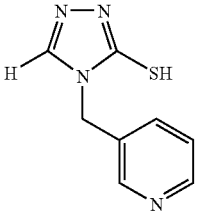
T-13
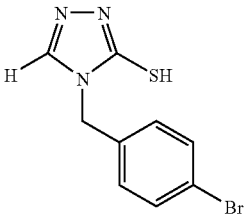
T-14
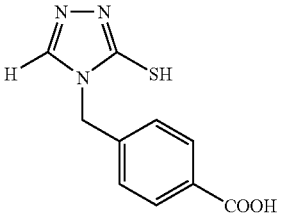
T-15
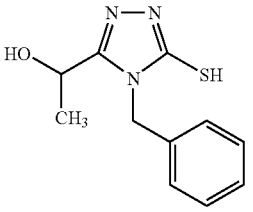

-continued
T-16
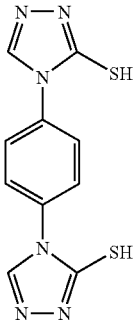
T-17
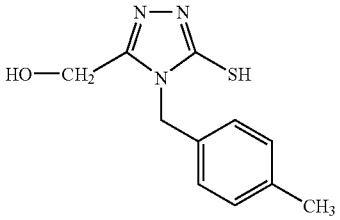
T-18
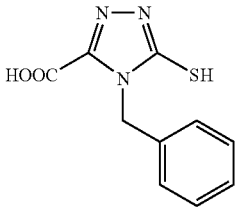
T-19
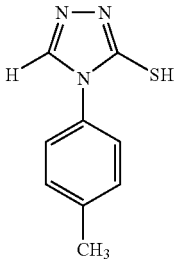
T-20
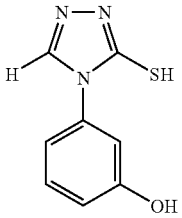
T-21
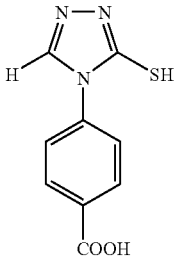
-continued
T-22
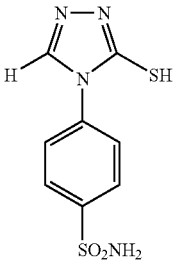
T-23
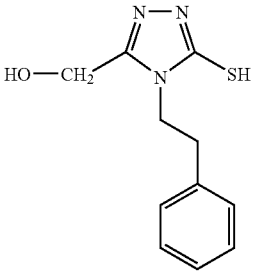
T-24
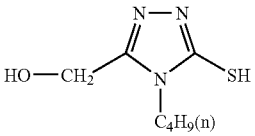
T-25
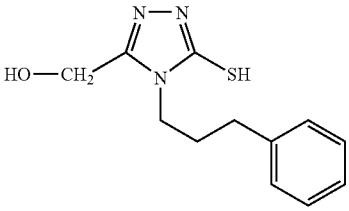
T-26
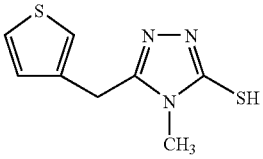
T-27
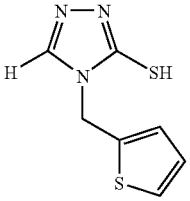
T-28
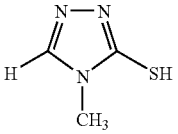
T-29
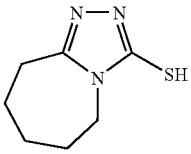

-continued
T-30
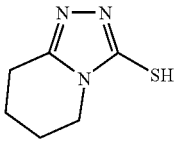
T-31
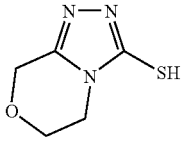
T-32
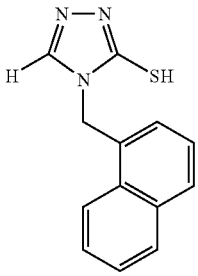
T-33
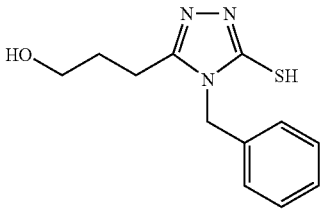
T-34
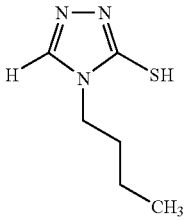
T-35
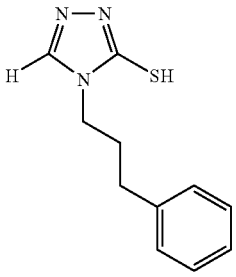
T-36
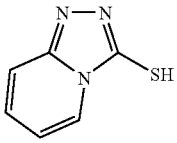
T-37
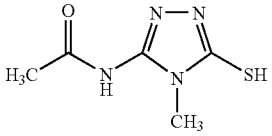
-continued
T-38
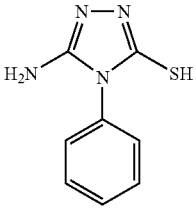
T-39
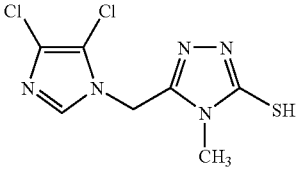
T-40
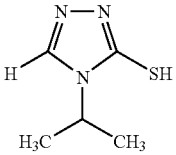
T-41
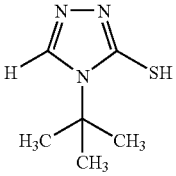
T-42
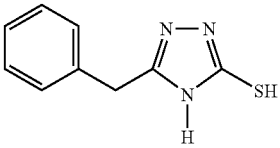
T-43
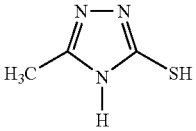
T-44
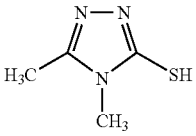
T-45
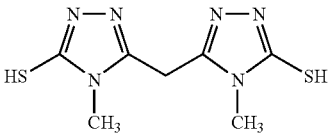
T-46
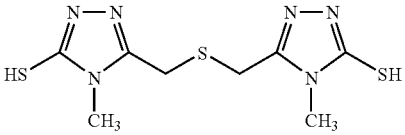

-continued
T-47
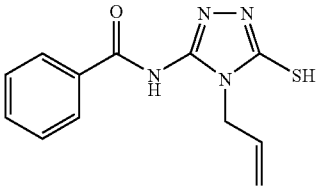
T-48
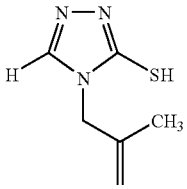
T-49
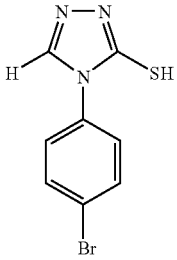
T-50
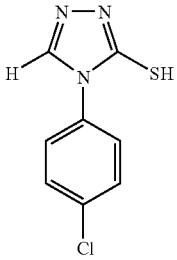
T-51
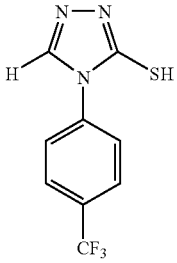
T-52
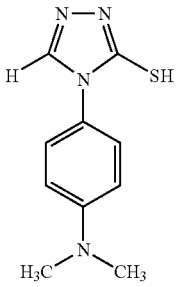
-continued
T-53
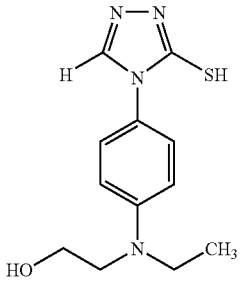
T-54
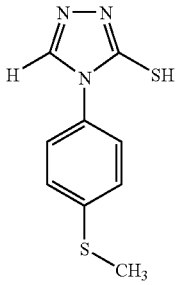
T-55
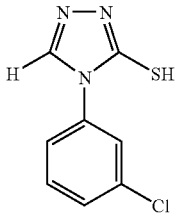
T-56
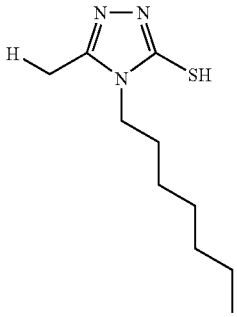
T-57
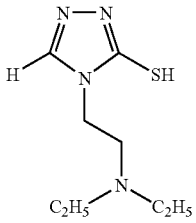
T-58
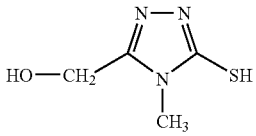

-continued

T-59

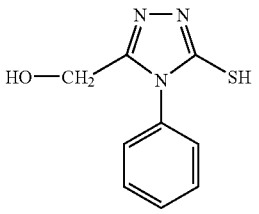

In the present invention, compound Nos. T-1, T-2, T-3, T-11, T-12, T-16, T-37, T-41, and T-44 are more preferred, and compound Nos. T-1, T-2, and T-3 are particularly preferred.

The mercaptotriazole toner can be easily prepared by the well-known synthetic method. For example, compound No. T-1 can be prepared according to the description in U.S. Pat. No. 4,628,059. The synthetic methods of various mercaptotriazoles are described in U.S. Pat. Nos. 3,769,411, 4,183,925, 6,074,813, DE Patent No. 1670604, and Chemical Abstract, 69, 52114j, 1968. Some mercaptotriazole compounds are commercially available.

As well known in the art, two or more of the mercaptotriazole compounds represented by formula (II) may be used if necessary and plural toners can exist in a same layer or different layer of the black and white photothermographic material.

Furthermore, conventional toner can be additionally included with one or more mercaptotriazole compounds described above. Those compounds are well-known compounds in the technology of black and white photothermographic materials as described in U.S. Pat. Nos. 3,080,254, 3,847,612, 4,123,282, 4,082,901, 3,074,809, 3,446,648, 3,844,797, 3,951,660, and 5,599,647, and G.B. Patent No. 1439478.

A mixture of a mercaptotriazole compound and additional toner (for example, 3-mercapto-4-benzyl-1,2,4-triazole and phthalazine) is also preferred in the practice of the present invention.

Generally, the addition amount of one ore more toners is preferably in a range from about 0.01% by weight to 10% by weight with respect to the total dry weight of the layer containing those toners, and more preferably about from 0.1% by weight to 10% by weight.

The toner may be contained in a layer adjacent to the image forming layer, for example in a protective overcoat layer or a lower "carrier layer", as well as the image forming layer capable of being thermal developed. If the image forming layer capable of being thermal developed exists in the both sides of a support, a toner can also be contained in both sides of a support.

2) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

3) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

4) Nucleation Accelerator

In the case of using a nucleator in the black and white photothermographic material of the invention, it is preferred to use a nucleation accelerator in combination. As for a nucleation accelerator, description can be found in paragraph No. 0102 of JP-A No. 11-65021, and in paragraph Nos. 0194 to 0195 of JP-A No. 11-223898.

In the case of using a nucleator in the black and white photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

2. Layer Constitution and Other Constituting Components

The image forming layer of the invention is constructed on a support by one or more layers. In the case of constituting the layer by a single layer, it comprises an organic silver salt, a photosensitive silver halide, a reducing agent, and a binder, which may further comprise additional materials as desired if necessary, such as a toner, a film-forming promoting agent, and other auxiliary agents. In the case of constituting the image forming layer from two or more layers, the first image forming layer (in general, a layer placed nearer to the support) contains an organic silver salt and a photosensitive silver halide, and some of the other components are incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the image forming layers as described in U.S. Pat. No. 4,460,681.

The photothermographic material according to the invention can have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The black and white photothermographic material of the invention may comprise a surface protective layer with an object to prevent adhesion of the image forming layer. The surface protective layer may be a single layer, or plural layers.

Description of the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The coating amount of polyvinyl alcohol (per 1 $m^2$ of support) in the protective layer (per one layer) is preferably in a range from 0.3 $g/m^2$ to 4.0 $g/m^2$, and more preferably, from 0.3 $g/m^2$ to 2.0 $g/m^2$.

The coating amount of total binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

Further, it is preferred to use a lubricant such as a liquid paraffin, a aliphatic ester, or the like, in the surface protective layer. The addition amount of the lubricant is in a range from 1 $mg/m^2$ to 200 $mg/m^2$, preferably from 10 $mg/m^2$ to 150 $mg/m^2$, and more preferably from 20 $mg/m^2$ to 100 $mg/m^2$.

2) Antihalation Layer

The black and white photothermographic material of the present invention can comprise an antihalation layer provided to the side farther from the light source with respect to the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially remain after image formation, and is preferred to employ a means for decoloring by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from about 0.001 $g/m^2$ to 1 $g/m^2$.

By decoloring the dye in such a manner, the optical density after thermal development can be lowered to 0.1 or lower. Two or more kinds of bleaching dyes may be used in combination in a black and white photothermographic material. Similarly, two or more kinds of base precursors may be used in combination.

In the case of thermal decolorization by the combined use of a bleaching dye and a base precursor, it is advantageous from the viewpoint of thermal decolorization efficiency to further use a substance capable of lowering the melting point by at least 3° C. (deg) when mixed with the base precursor (e.g., diphenylsulfone, 4-chlorophenyl(phenyl)sulfone, 2-naphthyl benzoate, or the like) as disclosed in JP-A No. 11-352626.

3) Back Layer

In the case where the black and white photothermographic material of the invention is a so-called single-sided type photosensitive material, which comprises an image forming layer only on one side of the support, the material has preferably a back layer on the other side.

Back layers usable in the invention are described in paragraph Nos. 0128 to 0130 of JP-A No. 11-65021.

In the invention, coloring matters having maximum absorption in a wavelength range from 300 nm to 450 nm can be added in order to improve color tone of developed silver images and a deterioration of the images during aging. Such coloring matters are described in JP-A Nos. 62-210458, 63-104046, 63-103235, 63-208846, 63-306436, 63-314535, 01-61745, 2001-100363, and the like.

Such coloring matters are generally added in a range from 0.1 $mg/m^2$ to 1 $g/m^2$, preferably to the back layer which is provided to the side opposite to the image forming layer.

Further, in order to control the basic color tone, it is preferred to use a dye having an absorption peak in the wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in a non-photosensitive layer on the image forming side, or in the back side.

4) Matting Agent

In the invention, a matting agent is preferably added in order to improve transportability. Description of the matting agent can be found in paragraphs Nos. 0126 to 0127 of JP-A No. 11-65021. The addition amount of the matting agent is preferably in a range from 1 $mg/m^2$ to 400 $mg/m^2$, and more preferably, from 5 $mg/m^2$ to 300 $mg/m^2$, with respect to the coating amount per 1 $m^2$ of the black and white photothermographic material.

In the invention, the shape of the matting agent may be fixed form or non-fixed form. Preferred is to use those having fixed form and globular shape.

Volume weighted mean equivalent spherical diameter of the matting agent used in the image forming layer surface is preferably in a range from 0.3 μm to 10 μm, and more preferably, from 0.5 μm to 7 μm. Further, the particle distribution of the matting agent is preferably set as such that the variation coefficient may become from 5% to 80%, and more preferably, from 20% to 80%. The variation coefficient, herein, is defined by (the standard deviation of particle diameter)/(mean diameter of the particle)×100. Furthermore, two or more kinds of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in a range from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more kinds of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The level of matting on the image forming layer surface is not restricted as far as star-dust trouble occurs, but the level of matting of 30 seconds to 2000 seconds is preferred, particularly preferred, 40 seconds to 1500 seconds as Beck's smoothness. Beck's smoothness can be calculated easily, by using Japan Industrial Standared (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and further preferably, 500 seconds or less and 40 seconds or more, when expressed by Beck smoothness.

In the present invention, a matting agent is preferably contained in an outermost layer, in a layer which can function as an outermost layer, or in a layer nearer to outer surface, and also preferably is contained in a layer which can function as a so-called protective layer.

5) Polymer Latex

A polymer latex is preferably incorporated in the surface protective layer or the back layer, in the black and white photothermographic material of the present invention. As for such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate(33.5% by weight)/ethyl acrylate(50% by weight)/methacrylic acid (16.5% by weight) copolymer, a latex of methyl methacrylate(47.5% by weight)/butadiene(47.5% by weight)/itaconic acid(5% by weight) copolymer, a latex of ethyl acrylate/methacrylic acid copolymer, a latex of methyl methacrylate(58.9% by weight)/2-ethylhexyl acrylate(25.4% by weight)/styrene (8.6% by weight)/2-hydroethyl methacrylate(5.1% by weight)/acrylic acid(2.0% by weight) copolymer, a latex of methyl methacrylate(64.0% by weight)/styrene(9.0% by weight)/butyl acrylate(20.0% by weight)/2-hydroxyethyl methacrylate(5.0% by weight)/acrylic acid(2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably, from 20% by weight to 80% by weight of the total weight of binder.

6) Surface pH

The surface pH of the black and white photothermographic material according to the invention preferably yields a pH of 7.0 or lower, and more preferably, 6.6 or lower, before thermal developing process. Although there is no particular restriction concerning the lower limit, the lower limit of pH value is about 3. Most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "EKITAI KONGO GIJUTSU (Liquid Mixing Technology)" (Nikkan Kogyo Shinbunsha, 1989), and the like.

8) Surfactant

As for the surfactant, the solvent, the support, the antistatic or electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573 and in paragraph Nos. 0049 to 0062 of JP-A No. 2000-208857.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably. For the black and white photothermographic material of the invention, fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoint of capacity in static control, stability of the coating surface state and sliding facility. The fluorocarbon surfactants described in JP-A No. 2001-264110 are most preferred because of high capacity in static control and that it needs small amount to use.

In the invention, the fluorocarbon surfactant can be used on either side of image forming layer side or back layer side, but is preferred to use on the both sides. Further, it is particularly preferred to use in combination with electrically conductive layer including aforementioned metal oxides. In this case, the amount of the fluorocarbon surfactant on the side of the electrically conductive layer can be reduced or removed.

The addition amount of the fluorocarbon surfactant is preferably in a range from 0.1 mg/m$^2$ to 100 mg/m$^2$ on each side of image forming layer and back layer, more preferably from 0.3 mg/m$^2$ to 30 mg/m$^2$, and further preferably from 1 mg/m$^2$ to 10 mg/m$^2$. Especially, the fluorocarbon surfactant described in JP-A No. 2001-264110 is effective, and used preferably in a range from 0.01 mg/m$^2$ to 10 mg/m$^2$, and more preferably from 0.1 mg/m$^2$ to 5 mg/m$^2$.

9) Antistatic Agent

The black and white photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably, 3.0 to 50, is preferred viewed from the standpoint of the electric conductivity effect. The metal oxides is used preferably in a range from 1 mg/m$^2$ to 1000 mg/m$^2$, more preferably from 10 mg/m$^2$ to 500 mg/m$^2$, and further preferably from 20 mg/m$^2$ to 200 mg/m$^2$. The antistatic layer can be laid on either side of the image forming layer side or the back layer side, but it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a black and white photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or less when coating for image forming layer and back layer is conducted on the support.

11) Other Additives

Furthermore, antioxidant, stabilizing agent, plasticizer, UV absorbent, or a film-forming promoting agent may be added to the black and white photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The black and white photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the image forming layer in the invention is preferably a so-called thixotropic fluid. Concerning this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used preferably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the black and white photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and continuously produce the black and white photothermographic material of the invention.

The black and white photothermographic material is preferably of mono-sheet type (i.e., a type which can form image on the black and white photothermographic material without using other sheets such as an image-receiving material).

13) Wrapping Material

In order to suppress fluctuation from occurring on the photographic property during a preservation of the black and white photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1} m^{-2} day^{-1}$ or lower at 25° C., more preferably, 10 $mL \cdot atm^{-1} m^{-2} day^{-1}$ or lower, and further preferably, 1.0 $mL \cdot atm^{-1} m^{-2} day^{-1}$ or lower. Preferably, vapor transmittance is 10 $g \cdot atm^{-1} m^{-2} day^{-1}$ or lower, more preferably, 5 $g \cdot atm^{-1} m^{-2} day^{-1}$ or lower, and further preferably, 1 $g \cdot atm^{-1} m^{-2} day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the black and white photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

3. Image Forming Method 3-1. Exposure

The black and white photothermographic material of the present invention may be either "single-sided type" having an image forming layer on one side of the support, or "double-sided type" having image forming layers on both sides of the support.

(Double-Sided Type Photothermographic Material)

The black and white photothermographic material of the present invention is preferably applied for an image forming method to record radiation images using a fluorescent intensifying screen.

The image forming method using the black and white photothermographic materials described above comprises the steps of:

(a) providing an assembly for forming an image by placing the photothermographic material between a pair of fluorescent intensifying screens;

(b) putting an analyte between the assembly and an X-ray source;

(c) irradiating the analyte with X-rays having an energy level in a range of 25 kVp to 125 kVp;

(d) taking the photothermographic material out of the assembly; and (e) heating the removed photothermographic material in a temperature range of 90° C. to 180° C.

The black and white photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+(optical density of 0.1) and a density of fog+(optical density of 0.5) is from 0.5 to 0.9, and the average gamma (γ) made at the points of a density of fog+(optical density of 1.2) and a density of fog+(optical density of 1.6) is from 3.2 to 4.0. For the X-ray radiography employed in the practice of the present invention, the use of photothermographic material having the aforesaid photographic characteristic curve would give the radiation images with excellent photographic properties that exhibit an extended bottom portion and high gamma value at a middle density area. According to this photographic property, the photographic properties mentioned have the advantage of that the depiction in low density portion on the mediastinal region and the heart shadow region having little X-ray transmittance becomes excellent, and that the density becomes easy to view, and that the contrast in the images on the lung field region having much X-ray transmittance becomes excellent.

The black and white photothermographic material having the preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high contrast for the lower layer. In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced.

For example, if the sensitivity difference is two times, and the covering power is equal, the ratio of the amount of high sensitivity emulsion to low sensitivity emulsion would be preferably adjusted to be in the range from 1:20 to 1:50 based on silver amount.

As the techniques for crossover cut (in the case of double-sided photosensitive material) and anti-halation (in the case of single-sided photosensitive material), dyes or combined use of dye and mordant described in JP-A. No. 2-68539, (from page 13, left lower column, line 1 to page 14, left lower column, line 9) can be employed.

Next the fluorescent intensifying screen employed in the practice of the present invention is explained below. The fluorescent intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate fluorescent substances ($CaWO_4$, $MgWO_4$, $CaWO_4$:Pb, and the like), terbium activated rare earth sulfoxide fluorescent substances ($Y_2O_2S$:Tb, $Gd_2O_2S$:Tb, $La_2O_2S$:Tb, $(Y,Gd)_2O_2S$:Tb, $(Y,Gd)O_2S$:Tb, Tm, and the like), terbium activated rare earth phosphate fluorescent substances ($YPO_4$:Tb, $GdPO_4$:Tb, $LaPO_4$:Tb, and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb, and the like), thulium activated rare earth oxyhalogen fluorescent substances (LaOBr:Tm, LaOCl:Tm, and the like), barium sulfate fluorescent substances ($BaSO_4$:Pb, $BaSO_4$:$Eu^{2+}$, (Ba, Sr)$SO_4$:$Eu^{2+}$, and the like), divalent europium activated alkali earth metal phosphate fluorescent substances ($(Ba_2PO_4)_2$:$Eu^{2+}$, $(Ba_2PO_4)_2$:$Eu^{2+}$, and the like), divalent europium activated alkali earth metal fluorinated halogenide fluorescent substances (BaFCl:$Eu^{2+}$, BaFBr:$Eu^{2+}$, BaFCl:$Eu^{2+}$, Tb, BaFBr:$Eu^{2+}$, Tb, $BaF_2$•BaCl•KCl:$Eu^{2+}$, (Ba,Mg)$F_2$•BaCl•KCl:$Eu^{2+}$, and the like), iodide fluorescent substances (CsI:Na, CsI:Tl, NaI, KI:Tl, and the like), sulfide fluorescent substances (ZnS:Ag(Zn,Cd)S:Ag, (Zn,Cd)S:Cu, (Zn,Cd)S:Cu, Al, and the like), hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

The fluorescent intensifying screen which is more preferred for the present invention is a screen where 50% or more of the emission light has a wavelength region from 350 nm to 420 nm. Especially, as the fluorescent substance, a divalent europium activated fluorescent substance is preferred, and a divalent europium activated barium halide fluorescent substance is more preferred. The emission wavelength region is preferably from 360 nm to 420 nm, and more preferably from 370 nm to 420 nm. Moreover, the preferred fluorescent screen can emit 70% or more of the above region, and more preferably 85% or more thereof.

The ratio of the emission light can be calculated from the following method; the emission spectrum is measured where an antilogarithm of the emission wavelength is plotted on the abscissa axis at equal interval and a number of the emitted photon is plotted on the ordinate. The ratio of the emission light in the wavelength region from 350 nm to 420 nm is defined as a value dividing the area from 350 nm to 420 nm on the chart by the entire area of the emission spectrum. The black and white photothermographic materials of the present invention used in combination with the fluorescent substance emitting the above wavelength region can attain high sensitivity.

In order that most of the emission light of the fluorescent substance may exist in the above wavelength region, the narrower half band width is preferred. The preferred half band width is from 1 nm to 70 nm, more preferably from 5 nm to 50 nm, and still more preferably from 10 nm to 40 nm.

So long as the fluorescent substance has the above emission, the fluorescent substance used in the present invention is not particularly limited, but the europium activated fluorescent substance where the divalent europium is an emission center is preferred to attain high sensitivity as the purpose of the invention. Specific examples of these fluorescent substances are described below, but the scope of the present invention is not limited to the examples.

BaFCl:Eu, BaFBr:Eu, BaFI:Eu, and the fluorescent substances where their halogen composition is changed; $BaSO_4$:Eu, SrFBr:Eu, SrFCl:Eu, SrFI:Eu, $(Sr,Ba)Al_2Si_2O_8$:Eu, $SrB_4O_7F$:Eu, $SrMgP_2O_7$:Eu, $Sr_3(PO_4)_2$:Eu, $Sr_2P_2O_7$:Eu, and the like.

More preferred fluorescent substance is a divalent europium activated barium halide fluorescent substance expressed by the following formula:

$$MX_1X_2:Eu$$

wherein, M represents Ba as a main component, but a small amount of Mg, Ca, Sr, or other compounds may be included. $X_1$ and $X_2$ each represent a halogen atom, and can be selected from F, Cl, Br and I. Herein, X, is more preferably a fluorine atom. $X_2$ can be selected from Cl, Br, and I, and the mixture with other halogen composition may be used preferably. More preferably X=Br. Eu represents an europium atom. Eu as an emission center is preferably contained at a ratio from $10^{-7}$ to 0.1, based on Ba, more preferably from $10^{-4}$ to 0.05. Preferably the mixture with a small quantity of other compounds can be included. As most preferred fluorescent substance, BaFCl:Eu, BaFBr:Eu, and $BaFBr_{1-x}I_x$:Eu can be described.

The fluorescent intensifying screen preferably consists of a support, an undercoat layer on the support, a fluorescent substance layer, and a surface protective layer.

The fluorescent substance layer is prepared as follows. A dispersion solution is prepared by dispersing the fluorescent substance particles described above in an organic solvent solution containing binder resins. The thus-prepared solution is coated directly on the support (or on the undercoat layer such as a light reflective layer provided beforehand on the support) and dried to form the fluorescent substance layer. Besides the above method, the fluorescent substance layer may be formed by the steps of coating the above dispersion solution on the temporary support, drying the coated dispersion to form a fluorescent substance layer sheet, peeling off the sheet from the temporary support, and fixing the sheet onto a permanent support by means of an adhesive agent.

The particle size of the fluorescent substance particles used in the present invention is not particularly restricted, but is usually in a range of from about 1 μm to 15 μm, and preferably from about 2 μm to 10 μm. The higher volume filling factor of the fluorescent substance particles in the fluorescent substance layer is preferred, usually in the range of from 60% to 85%, preferably from 65% to 80%, and particularly preferably from 68% to 75%. (The ratio of the fluorescent substance particles in the fluorescent substance layer is usually 80% by weight or more, preferably 90% by weight or more, and particularly preferably 95% by weight or more). Various kinds of known documents have described the binder resins, organic solvents, and the various additives used for forming the fluorescent substance layer. The thickness of the fluorescent substance layer may be set arbitrary according to the target sensitivity, but is preferably in a range of from 70 μm to 150 μm for the front side screen, and in a range of from 80 μm to 400 μm for the backside screen. The X-ray absorption efficiency of the fluorescent substance layer depends on the coating amount of the fluorescent substance particles in the fluorescent substance layer.

The fluorescent substance layer may consist of one layer, or may consist of two or more layers. It preferably consists of one to three layers, and more preferably, one or two layers. For example, the layer may be prepared by coating a plurality of layers comprising the fluorescent substance particles with different particle size having a comparatively narrow particle size distribution. In that case, the particle size of the fluorescent substance particles contained in each layer may gradually decrease from the top layer to the bottom layer provided next to the support. Especially, the fluorescent substance particles having a large particle size is preferably coated at the side of the surface protective layer and fluorescent substance particles having a small particle size is preferably coated at the side of the support. Hereto, the small particle size of fluorescent substance is preferably in the range from 0.5 μm to 2.0 μm and the large size is preferably in the range from 10 μm to 30 μm. The fluorescent substance layer may be formed by mixing the fluorescent substance particles with different particle sizes, or the fluorescent substances may be packed in a particle size graded structure as described in JP-A No. 55-33560 (page 3, line 3 on the left column to page 4, line 39 on the left column). Usually, a variation coefficient of a particle size distribution of the fluorescent substance is in a range of from 30% to 50%, but a monodispersed fluorescent substance particles with a variation coefficient of 30% or less can also be preferably used.

Attempts to attain a desired sharpness by dying the fluorescent substance layer with respect to the emission light wavelength are practiced. However, the layer with least dying is preferably required. The absorption length of the fluorescent substance layer is preferably 100 μm or more, and more preferably 1000 μm or more.

The scattering length of the fluorescent substance layer is preferably designed to be from 0.1 μm to 100 μm, and more preferably from 1 μm to 100 μm. The scattering length and the absorption length can be calculated from the equation based on the theory of Kubelka-Munk mentioned below.

As for the support, any support can be selected from various kinds of supports used in the well-known radiographic intensifying screen depending on the purpose. For example, a polymer film containing white pigments such as titanium dioxide or the like, and a polymer film containing black pigments such as carbon black or the like may be preferably used. An undercoat layer such as a light reflective layer containing a light reflective agent may be preferably coated on the surface of the support (the surface of the fluorescent substance layer side). The light reflective layer as described in JP-A No. 2001-124898 may be preferably used. Especially, the light reflective layer containing yttrium oxide described in Example 1 of the above patent or the light reflective layer described in Example 4 thereof is preferred. As for the preferred light reflective layer, the description in JP-A No. 23001-124898 (paragraph 3, 15 line on the right side to paragraph 4, line 23 on the right side) can be referred.

A surface protective layer is preferably coated on the surface of the fluorescent substance layer. The light scattering length measured at the main emission wavelength of the fluorescent substance is preferably in a range of from 5 μm to 80 μm, and more preferably from 10 μm to 70 μm, and particularly preferably from 10 μm to 60 μm. The light scattering length indicates a mean distance in which a light travels straight until it is scattered. Therefore a short scattering length means that the light scattering efficiency is high. On the other hand, the light absorption length, which indicates a mean free distance until a light is absorbed, is optional. From the viewpoint of the screen sensitivity, no absorption by the surface protective layer favors preventing the desensitization. In order to compensate the scattering loss, a very slightly absorption may be allowable. A preferred absorption length is 800 μm or more, and more preferably 1200 μm or more. The light scattering length and the light absorption length can be calculated from the equation based on the theory of Kubelka-Munk using the measured data obtained by the following method.

Three or more film samples comprising the same component composition as the surface protective layer of the aimed sample but a different thickness from each other are prepared, and then the thickness (μm) and the diffuse transmittance (%) of each of the samples is measured. The diffuse transmittance can be measured by means of a conventional spectrophotometer equipped with an integrating sphere. For the measurement of the present invention, an automatic recording spectrophotometer (type U-3210, manufactured by Hitachi Ltd.) equipped with an integrating sphere of 150 ϕ (150-0901) is used. The measuring wavelength must correspond to the wavelength of the main emission peak of the fluorescent substance in the fluorescent substance layer having the surface protective layer. Thereafter, the film thickness (μm) and the diffuse transmittance (%) obtained in the above measurement is introduced to the following equation (A) derived from the theoretical equation of Kubelka-Munk. For example, the equation (A) can be derived easily, under the boundary condition of the diffuse transmittance (%), from the equations 5•1•12 to 5•1•15 on page 403 described in "Keikotai Hando Bukku" (the Handbook of Fluorescent Substance) (edited by Keikotai Gakkai, published by Ohmsha Ltd. 1987).

$$T/100=4\beta/[(1+\beta)^2\cdot exp(\alpha d)-(1-\beta)^2\cdot exp(-\alpha d)] \quad \text{Equation (A)}$$

wherein, T represents a diffuse transmittance (%), d represents a film thickness (μm) and, α and β are defined by the following equation respectively.

$$\alpha=[K\cdot(K+2S)]^{1/2}$$

$$\beta=[K/(K+2S)]^{1/2}$$

T (diffuse transmittance: %) and d (film thickness: μm) measured from three or more film samples are introduced respectively to the equation (A), and thereby the value of K and S are determined to satisfy the equation (A). The scattering length (μm) and the absorption length (μm) are defined by 1/S and 1/K respectively.

The surface protective layer may preferably comprise light scattering particles dispersed in a resin material. The light refractive index of the light scattering particles is usually 1.6 or more, and more preferably 1.9 or more. The particle size of the light scattering particles is in a range of from 0.1 μm to 1.0 μm. Examples of the light scattering particles may include the fine particles of aluminum oxide, magnesium oxide, zinc oxide, zinc sulfide, titanium oxide, niobium oxide, barium sulfate, lead carbonate, silicon oxide, polymethyl methacrylate, styrene, and melamine.

The resin materials used to form the surface protective layer are not particularly limited, but poly(ethylene terephthalate), poly(ethylene naphthalate), polyamide, aramid, fluororesin, polyesters, or the like are preferably used. The surface protective layer can be formed by the step of dispersing the light scattering particles set forth above in an organic solvent solution containing the resin material (binder resin) to prepare a dispersion solution, coating the dispersion solution on the fluorescent substance layer directly (or via an optionally provided auxiliary layer), and then drying the coated solution. By other way, the surface protective sheets prepared separately can be overlaid on the fluorescent substance layer by means of an adhesive agent. The thickness of the surface protective layer is usually in a range of from 2 μm to 12 μm, and more preferably from 3.5 μm to 10 μm.

In addition, in respect with the preferred producting methods and the materials used for the process of the radiographic intensifying screen, references can be made to various publications, for example, JP-A No. 9-21899 (page 6, line 47 on left column to page 8, line 5 on left column), JP-A No. 6-347598 (page 2, line 17 on right column to page 3, line 33 on left column) and (page 3, line 42 on left column to page 4, line 22 on left column).

In the fluorescent intensifying sheets used for the present invention, the fluorescent substance is preferably packed in a particle size graded structure. Especially, the fluorescent substance particles having a large particle size are preferably coated at the side of the surface protective layer and fluorescent substance particles having a small particle size are preferably coated at the side of the support. The small particle size of fluorescent substance is preferably in the range from 0.5 μm to 2.0 μm, and the large size is preferably in the range from 10 μm to 30 μm.

(Single-Sided Type Photothermographic Material)

The single-sided type photothermographic material of the present invention is favorably applied for an X-ray photosensitive material used for mammography.

To use the single-sided type photothermographic material for that purpose, it is very important to design the contrast of the obtained image in the suitable range.

Concerning the preferable constitution for a photosensitive material used for mammography, reference can be made to JP-A Nos. 5-45807, 10-62881, 10-54900, 11-109564.

(Combined Use with Ultraviolet Fluorescent Intensifying Screen)

As for the image forming method using the black and white photothermographic material according to the present invention, it is preferred that the image forming method is performed in combination with a fluorescent substance having a main emission peak at 400 nm or lower. More preferably, the image forming method is performed in combination with a fluorescent substance having a main emission peak at 380 nm or lower. Either single-sided photosensitive material or double-sided photosensitive material can be applied for the assembly. As the screen having a main emission peak at 400 nm or lower, the screens described in JP-A No. 6-11804 and WO No. 93/01521 are used, but the present invention is not limited to these. As the techniques of crossover cut (for double-sided photosensitive material) and anti-halation (for single-sided photosensitive material) of ultraviolet light, the technique described in JP-A No. 8-76307 can be applied. As an ultraviolet absorbing dye, the dye described in JP-A No. 2001-144030 is particularly preferable.

The image forming method of the present invention may use laser beam as an exposure source.

As laser beam which can be used for the image forming method according to the invention, preferably used are gas laser ($Ar^+$, He—Ne, He—Cd), YAG laser, pigment laser, and laser diode. Laser diode and second harmonics generator element can also be used. Preferred laser is determined corresponding to the peak absorption wavelength of spectral sensitizer and the like used in the black and white photothermographic material. Preferred are He—Ne laser of red through infrared emission, red laser diode, or $Ar^+$, He—Ne, He—Cd laser of blue through green emission, and blue laser diode. In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of laser beam is 300 nm to 500 nm, preferably 400 nm to 500 nm, of blue, or 600 nm to 900 nm, preferably 620 nm to 850 nm, of red to infrared.

A laser beam which oscillates in a longitudinal multiple modulation by a method such as high frequency superposition is also preferably employed.

3-2. Thermal Development

Although any method may be used for the development of the black and white photothermographic material of the invention, the thermal developing process is usually performed by elevating the temperature of the black and white photothermographic material exposed imagewise. The temperature for the development is preferably in a range from 80° C. to 250° C., and more preferably, from 100° C. to 140° C.

Time period for development is preferably in a range from 1 second to 60 seconds, more preferably from 5 second to 30 seconds, and particularly preferably from 5 seconds to 20 seconds.

Concerning the process for thermal development, a plate type heater process is preferred. A preferable process for thermal development by a plate type heater is a process described in JP-A NO. 11-133572, which discloses a thermal developing apparatus in which a visible image is obtained by bringing a black and white photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by about 1° C. to 10° C.

Such a process is also described in JP-A NO. 54-30032, which allows for passage of moisture and organic solvents included in the black and white photothermographic material out of the system, and also allows for suppressing the change of shapes of the support of the black and white photothermographic material upon rapid heating of the black and white photothermographic material.

3-3. System

Examples of a medical laser imager equipped with an exposing portion and a thermal developing portion include Fuji Medical Dry Laser Imager FM-DP L and DRYPIX 7000. In connection with FM-DP L, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

4. Application of the Invention

The black and white photothermographic material and the image forming method of the invention are preferably employed as black and white photothermographic materials for use in medical imaging, photothermographic materials for use in industrial photographs, photothermographic materials for use in graphic arts, as well as black and white photothermographic materials for COM, and as image forming methods.

The present invention is specifically explained by way of Examples below, which should not be construed as limiting the invention thereto.

EXAMPLES

Example 1

1. Preparation of PET Support and Undercoating 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 KV·A·minute·m$^{-2}$ was executed, judging from the readings of current and voltage on that occasion. The frequency upon this treatment was 9.6 kHz, and the gap clearance between the electrode and dielectric roll was 1.6 mm.

1-3. Undercoating

<Preparations of Coating Solution for Undercoat Layer>

1) Undercoating on Image Forming Layer Side

| Formula (1) (for first layer on the image forming layer side) | |
|---|---|
| Styrene-butadiene copolymer latex (solid content of 40% by weight, styrene/butadiene weight ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| **Formula (2) (for second layer on the image froming layer side)** | |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

Both surfaces of the biaxially tentered polyethylene terephthalate support having the thickness of 175 μm were respectively subjected to the corona discharge treatment as described above. Thereafter, the aforementioned formula (1) of the coating solution for the undercoat was coated on image forming layer side with a wire bar so that the amount of wet coating became 5.7 mL/m$^2$, and dried at 180° C. for 5 minutes. Then, the aforementioned formula (2) of the coating solution for the undercoat was coated with a wire bar so that the amount of wet coating became 7.7 mL/m$^2$, and dried at 180° C. for 5 minutes.

2) Undercoating on Back Layer Side

| Formula (3) (for first layer on the backside) | |
|---|---|
| Styrene-butadiene copolymer latex (solid content of 40% by weight, styrene/butadiene weight ratio = 68/32) | 130.8 g |
| Sodium salt of 2,4-dichloro-6-hydroxy-S-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |
| **Formula (4) (for second layer on the backside)** | |
| $SnO_2$/SbO (9/1 weight ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

After undercoating on the image forming layer side, the aforementioned formula (3) of the coating solution for the undercoat was coated on the reverse side (backside) with a wire bar so that the amount of wet coating became 5.7 mL/m$^2$, and dried at 180° C. for 5 minutes. Furthermore, the aforementioned formula (4) of the coating solution for the undercoat was coated on the reverse side (backside) with a wire bar so that the amount of wet coating became 8.4 mL/m$^2$, and dried at 180° C. for 6 minutes. Thus, an undercoated support was produced.

1-4. Back Layer

1) Preparation of Coating Solution for Back Layer (Preparation of Dispersion of Solid Fine Particles (a) of Base Precursor)

2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by IMEX Co., Ltd.). Process for dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor becomes 25% by weight, and filtrated (with a polypropylene filter having a mean fine pore diameter of 3 μm) for eliminating dust to put into practical use.

(Preparation of Solid Fine Particle Dispersion of Dye)

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed solution was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion ($D_{650}/D_{750}$) becomes 5.0 or higher upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Antihalation Layer)

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone, and 490 mL of water to allow gelatin to be dissolved. Additionally, 2.3 mL of a 1 mol/L sodium hydroxide aqueous solution, 40 g of the above-mentioned dispersion solution of the solid fine particles of the dye, 90 g of the above-mentioned dispersion solution of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

2) Preparation of Coating Solution for Back Surface Protective Layer

A vessel was kept at 40° C., and thereto were added 40 g of gelatin, 35 mg of benzoisothiazolinone, and 840 mL of water to allow gelatin to be dissolved. Additionally, 5.8 mL of a 1 mol/L sodium hydroxide aqueous solution, 5 g of a 10% by weight emulsion of liquid paraffin, 5 g of a 10% by weight emulsion of tri(isostearic acid)-trimethylol-propane, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (weight ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

3) Coating of Back Layer

The back side of the undercoated support described above was subjected to simultaneous double coating so that the coating solution for the antihalation layer gave the coating amount of gelatin of 0.52 g/m$^2$, and so that the coating solution for the back surface protective layer gave the coating amount of gelatin of 1.7 g/m$^2$, followed by drying to produce a back layer.

2. Image Forming Layer, Intermediate Layer, and Surface Protective Layer 2-1. Preparations of Coating Materials 1) Preparation of Silver Halide Emulsion <<Preparation of Silver Halide Emulsion A>>

To 1421 mL of distilled water was added 3.1 mL of a 1% by weight potassium bromide solution. Further, a liquid added with 3.5 mL of 0.5 mol/L sulfuric acid and 31.7 g of phthalated gelatin was kept at 30° C. while stirring in a stainless steel reaction vessel, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion A.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparations of Emulsion 1 to 17 for Coating Solution>>

The silver halide emulsion A described above was dissolved, and thereto was added benzothiazolium iodide in a 1% by weight aqueous solution at $7\times10^{-3}$ mol per 1 mol of silver.

Further, as shown in Table 1, "a compound that can be one-electron-oxidized to provide a one-electron oxidation product, which releases one or more electrons", "an adsorptive redox compound having an adsorptive group to silver halide and a reducing group in a molecule", comparative compound 1, or comparative compound 2 were added in an amount of $2\times10^{-3}$ mol per 1 mol of silver in silver halide.

Comparative compound 1

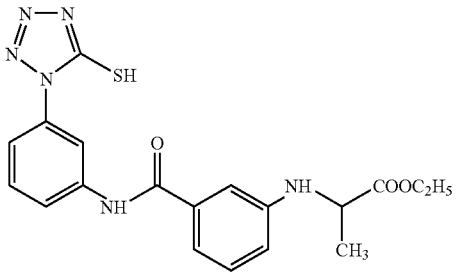

-continued

Comparative compound 2

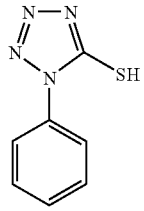

Further, water was added thereto to give the content of silver halide of 38.2 g in terms of silver, per 1 kg of the emulsion for a coating solution. 1-(3-methylureidophenyl)-5-mercaptotetrazole was added to give 0.34 g per 1 kg of the emulsion for a coating solution.

TABLE 1

| Emulsion for Coating Solution No. | Electron Releasing Compound | Adsorptive Redox Compound | Note |
|---|---|---|---|
| 1 | — | — | Comparative |
| 2 | Comparative Compound 1 | — | Comparative |
| 3 | — | Comparative Compound 2 | Comparative |
| 4 | 10 | — | Invention |
| 5 | 21 | — | Invention |
| 6 | 22 | — | Invention |
| 7 | 28 | — | Invention |
| 8 | 36 | — | Invention |
| 9 | 37 | — | Invention |
| 10 | — | 14 | Invention |
| 11 | — | 19 | Invention |
| 12 | — | 30 | Invention |
| 13 | — | 71 | Invention |
| 14 | — | 76 | Invention |
| 15 | — | 93 | Invention |
| 16 | 21 | 71 | Invention |
| 17 | 27 | 19 | Invention |

2) Preparation of Dispersion of Non-Photosensitive Organic Silver Salt

A solution was prepared by dissolving 85 g of lime processed gelatin, 25 g of phthalated gelatin in 2 liters of ion-exchange water in a reaction vessel and stirred well (solution A). A solution containing 185 g of benzotriazole and 1405 mL of ion-exchange water (solution B), and 680 g of 2.5 mol/L sodium hydroxide solution were prepared. The solution of the reaction vessel was adjusted to keep the pAg and pH at 7.25 and 8.0, respectively, if required, by adding solution B and 2.5 mol/L sodium hydroxide solution. And the temperature of the mixture was kept at 36° C.

Solution C containing 228.5 g of silver nitrate and 1222 mL of ion-exchange water was added into the reaction vessel at an accelerated flow rate (flow rate: $16(1+0.002t^2)$ mL/min, wherein t represents time expressed in minute). And then solution B was concurrently added to keep the pAg at 7.25. When the addition of solution C was finished, the process was stopped. And then, solution D containing 80 g of phthalated gelatin and 700 mL of ion-exchange water was added thereto at 40° C., while stirring the resulting reaction solution mixture, the pH of the mixture was adjusted at 2.5 by adding 2 mol/L sulfuric acid to aggregate silver salt emulsion. The aggregates were washed well twice by 5 liters of ion-exchange water. Thereafter the pH and pAg were adjusted to 6.0 and 7.0, respectively, by adding 2.5 mol/L sodium hydroxide solution and solution B to redisperse the aggregates. The obtained organic silver salt dispersion contained fine crystals of silver salt of benzotriazole.

<Shape of Particles>

The shape of the obtained fine particles of silver salt of benzotriazole was evaluated by an electron microscope. The particles were flaky shaped crystals having a mean projected area equivalent diameter of 0.05 μm, a long axis length of 0.2 μm, a short axis length of 0.05 μm, a grain thickness of 0.05 μm, and a variation coefficient of an projected area equivalent diameter distribution of 21%.

3) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

4) Preparation of Development Accelerator-1 Dispersion

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed similar to the development accelerator-1, and thus dispersions of 20% by weight and 15% by weight were respectively obtained.

5) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

6) Preparation of Toner Dispersion

The dispersions of compound Nos. T-59 and T-3 used for toner dispersions were prepared as follows.

4 g of triazole compound No. T-59 (5-hydroxymethyl-4-benzyl-1,2,4-triazole-3-thiol), 10% by weight of polyvinyl pyrrolidone solution and 18 mL of ion-exchange water were thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. 15 g of 30% by weight lime processed gelatin was added to the above dispersion and the mixture was heated to 50° C. to obtain fine particle dispersion of mercaptotriazole T-59.

Dispersion of triazole compound No. T-3 (4-benzyl-1,2,4-triazole-3-thiol) was prepared in a similar manner.

7) Preparations of Various Solutions

<Preparation of Reducing Agent Solution>

A 10% by weight aqueous solution of ascorbic acid was prepared.

<Preparations of Aqueous Solution of Mercapto Compound>

Mercapto compound-1 (1-(3-sulfophenyl)-5-mercaptotetrazole sodium salt) in an amount of 7 g was dissolved in 993 g of water to give a 0.7% by weight aqueous solution.

Mercapto compound-2 (1-(3-methylureidophenyl)-5-mercaptotetrazole) in an amount of 20 g was dissolved in 980 g of water to give a 2.0% by weight aqueous solution.

<Preparations of Thermal Solvent Solution>

A 5% by weight aquous solution of 1,3-dimethylurea and a 10% by weight aquous solution of succinimide were prepared.

2-2. Preparations of Coating Solution

1) Preparations of Coating Solution for Image Forming Layer

To the dispersion of silver salt of benzotriazole obtained as described above in an amount of 1000 g were serially added the aqueous solution of gelatin, the pigment-1 dispersion, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound aqueous solutions, and the thermal solvent solutions. The silver halide emulsion 1 to 17 for coating solution was added thereto in an amount of 0.092 mol per 1 mol of non-photosensitive organic silver salt, followed by thorough mixing just prior to the coating, which was fed directly to a coating die.

2) Preparation of Coating Solution for Intermediate Layer

To 772 g of a 10% by weight aqueous solution of polyvinyl alcohol PVA-205 (manufactured by Kuraray Co., Ltd.), 5.3 g of pigment-1 dispersion, and 226 g of a 27.5% by weight solution of methyl methacrylate/styrene/butyl acrylate/hydroxyethyl methacrylate/acrylic acid copolymer (weight ratio of the copolymerization of 64/9/20/5/2) latex, were added 2 mL of a 5% by weight aqueous solution of aerosol OT (manufactured by American Cyanamid Co.), 10.5 mL of a 20% by weight aqueous solution of ammonium secondary phthalate and water to give total amount of 880 g. The mixture was adjusted with sodium hydroxide to give the pH of 7.5. Accordingly, the coating solution for the intermediate layer was prepared, and was fed to a coating die to provide 10 mL/m$^2$.

3) Preparation of Coating Solution for First Layer of Surface Protective Layers

In water was dissolved 64 g of inert gelatin, and thereto were added 80 g of a 27.5% by weight solution of methyl methacrylate/styrene/butyl acrylate/hydroxyethyl methacrylate/acrylic acid copolymer (weight ratio of the copolymerization of 64/9/20/5/2) latex, 23 mL of a 10% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT, 0.5 g of phenoxyethyl alcohol, and 0.1 g of benzisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 3.2 mL of a 5% by weight solution of a fluorocarbon surfactant (F-1), 32 mL of a 2% by weight aqueous solution of another fluorocarbon surfactant (F-2), 23 mL of a 5% by weight aqueous solution of aerosol OT, 4 g of polymethyl methacrylate fine particles (mean particle diameter of 0.7 μm), 21 g of polymethyl methacrylate fine particles (mean particle diameter of 4.5 μm), 1.6 g of 4-methyl phthalic acid, 4.8 g of phthalic acid, 44 mL of 0.5 mol/L sulfuric acid, and 10 mg of benzisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

2-3. Coating

On the reverse side of the back layer with respect to the support, simultaneous overlaying coating by a slide bead coating method was subjected in order of the image forming layer, intermediate layer, first layer of the surface protective layers, and second layer of the surface protective layers, starting from the undercoated face. Thus Sample Nos. 1 to 17 of black and white photothermographic materials were produced. The amount of coated silver in the image forming layer was 1.42 g/m$^2$ with respect to the sum of organic silver salt and silver halide.

The coating amount of each compound (g/m$^2$) for the image forming layer is as follows.

| | |
|---|---|
| Silver salt of benzotriazole (on the basis of Ag content) | 1.30 |
| Gelatin | 3.5 |
| Pigment (C.I. Pigment Blue 60) | 0.036 |
| Triazole compound No. T-59 | 0.08 |
| Triazole compound No. T-3 | 0.08 |
| Ascorbic acid | 2.1 |
| Hydrogen bonding compound-1 | 0.28 |
| Development accelerator-1 | 0.019 |
| Development accelerator-2 | 0.016 |
| Color-tone-adjusting agent-1 | 0.006 |

-continued

| | |
|---|---|
| Mercapto compound-1 | 0.002 |
| Mercapto compound-2 | 0.012 |
| Thermal solvent: 1,3-dimethlyurea | 0.48 |
| Thermal solvent: succinimide | 0.16 |
| Silver halide (on the basis of Ag content) | 0.120 |

Chemical structures of the compounds used in Examples of the invention are shown below.

Spectral sensitizing dye A

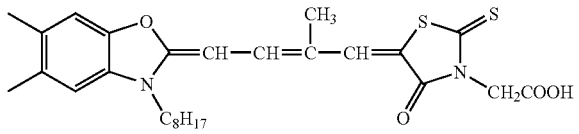

Spectral sensitizing dye B

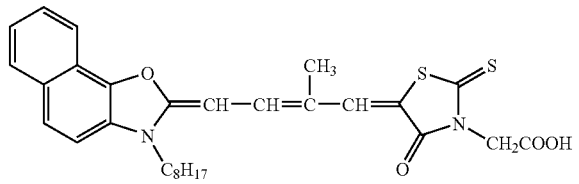

Tellurium sensitizer C

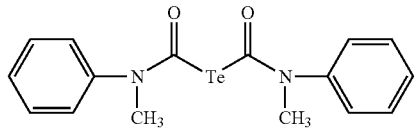

Base precursor-1

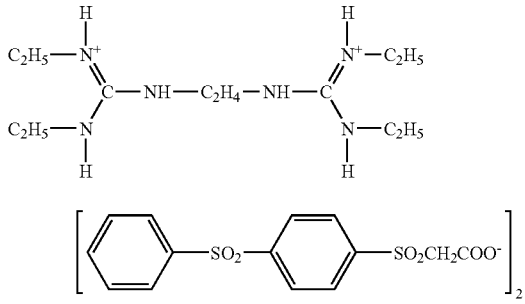

Cyanine dye-1

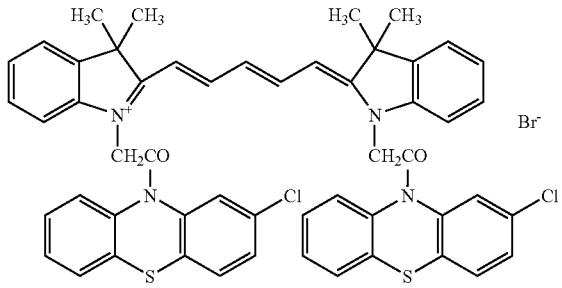

-continued

Hydrogen bonding compound-1

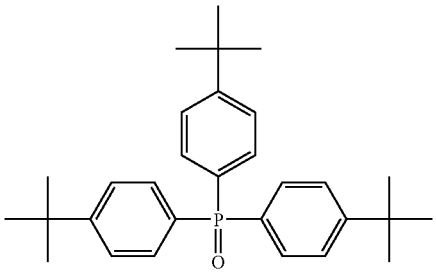

Mercapto compound-1

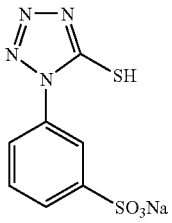

Mercapto compound-2

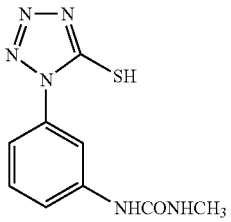

Development accelerator-1

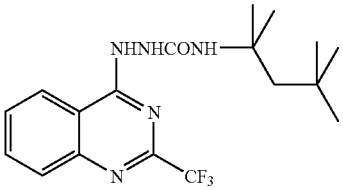

Development accelerator-2

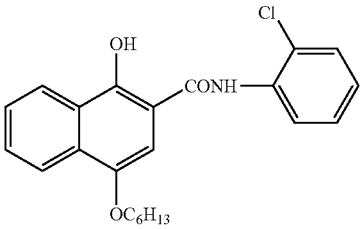

Color-tone-adjusting agent-1

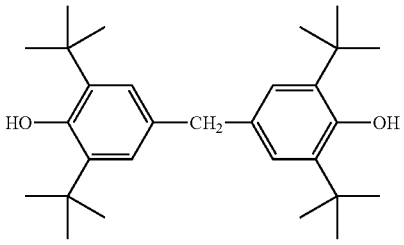

(F-1)

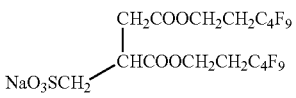

Mixture of

-continued (F-2)

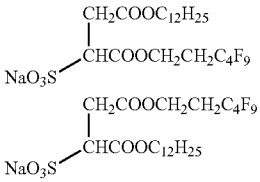

3. Evaluation of Photographic Properties 3-1. Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 2% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

3-2. Condition of Evaluation

1) Exposure and Thermal Development

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation on an obtained image was performed with a densitometer.

2) Terms for Evaluation

Fog: Fog is expressed in terms of a density of the unexposed part.

Sensitivity: Sensitivity is expressed by a reciprocal of the exposure value necessary to give an optical density of fog+1.0. Sensitivities are shown in relative values, detecting the sensitivity of Sample No. 1 to be 100. The larger is the value, the higher is the sensitivity thereof.

Color tone of developed silver images: The exposed sample is subjected to thermal development at temperature conditions such as +3° C. and −3° C. with respect to the standard development temperature. The color tone of developed silver images of each sample obtained at the above development temperature condition was observed visually and the difference in the color tone of developed silver images was evaluated according to the following criteria.

◎: Difference in color tone of developed silver images due to development temperature condition is not observed, excellent.

○: Difference in color tone of developed silver images due to development temperature condition is slightly observed, but distinguishable level.

Δ: Difference in color tone of developed silver images due to development temperature condition is large, but in allowable range.

X: Difference in color tone of developed silver images due to development temperature condition is big, impractical.

Raw stock storability: Samples were sealed in the packaging materials described above and stored under an accelerated storage condition at 45° C. for 7 days. Thereafter, the samples were subjected to imagewise exposure and thermal development. The samples were evaluated about the sensitivity change by comparing with the sample stored in a refrigerator.

Raw stock storability (Sensitivity change)=−log ((Sensitivity of a sample after being stored under the accelerated storage condition at 45° C. for 7 days)/(Sensitivity of the sample stored in a refrigerator))

Print-out resistance: Thermally developed samples were left for 21 days under an illumination condition of fluorescent lamp of 250 Lux at 25° C. and 70% RH. The increment of fog relative to the fog before leaving was measured.

3-3. Results of Evaluation

The obtained results are shown in Table 2.

From the results shown in Table 2, it is revealed that the black and white photothermographic materials of the present invention have high sensitivity and low fog, and also exhibit excellent quality in color tone of developed silver images, raw stock storability, and print-out resistance.

TABLE 2

| Sample No. | Silver Halide Emulsion No. | Fog | Sensitivity | Difference in Color Tone of Developed Silver Images | Raw Stock Storability | Print-out Resistance | Note |
|---|---|---|---|---|---|---|---|
| 1 | 1 | 0.23 | 100 | Δ | 0.33 | 0.18 | Comparative |
| 2 | 2 | 0.22 | 75 | Δ | 0.29 | 0.16 | Comparative |
| 3 | 3 | 0.21 | 60 | Δ | 0.31 | 0.15 | Comparative |
| 4 | 4 | 0.22 | 253 | ○ | 0.04 | 0.03 | Invention |
| 5 | 5 | 0.23 | 312 | ◎ | 0.02 | 0.02 | Invention |
| 6 | 6 | 0.22 | 260 | ○ | 0.03 | 0.03 | Invention |
| 7 | 7 | 0.21 | 285 | ○ | 0.05 | 0.03 | Invention |
| 8 | 8 | 0.22 | 272 | ○ | 0.04 | 0.02 | Invention |
| 9 | 9 | 0.25 | 205 | ○ | 0.07 | 0.02 | Invention |
| 10 | 10 | 0.22 | 245 | ○ | 0.05 | 0.03 | Invention |
| 11 | 11 | 0.22 | 285 | ◎ | 0.03 | 0.02 | Invention |
| 12 | 12 | 0.21 | 255 | ○ | 0.05 | 0.03 | Invention |
| 13 | 13 | 0.21 | 322 | ◎ | 0.02 | 0.02 | Invention |
| 14 | 14 | 0.22 | 315 | ○ | 0.02 | 0.03 | Invention |
| 15 | 15 | 0.23 | 253 | ○ | 0.04 | 0.03 | Invention |
| 16 | 16 | 0.22 | 334 | ◎ | 0.02 | 0.02 | Invention |
| 17 | 17 | 0.21 | 341 | ◎ | 0.02 | 0.02 | Invention |

Example 2

1. Preparation of Undercoated Support

Undercoating described below was conducted on the support, which was subjected to the corona discharge treatment of Example 1.

1) Preparations of Coating Solution for Undercoat Layer

| Formula (1) (for first layer) | |
|---|---|
| Styrene-butadiene copolymer latex (solid content of 40% by weight, styrene/butadiene weight ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| **Formula (2) (for second layer)** | |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

2) Undercoating on Back Layer Side

Both surfaces of the biaxially tentered polyethylene terephthalate support having the thickness of 175 μm were respectively subjected to the corona discharge treatment as described above. Thereafter, the aforementioned formula (1) of the coating solution for the undercoat was coated on image forming layer side with a wire bar so that the amount of wet coating became 5.7 mL/m$^2$, and dried at 180° C. for 5 minutes. Then, the aforementioned formula (2) of the coating solution for the undercoat was coated with a wire bar so that the amount of wet coating became 7.7 mL/m$^2$, and dried at 180° C. for 5 minutes. This was subjected to both sides and thus an undercoated support was produced.

2. Preparations of Coating Material

1) Preparation of Photosensitive Silver Halide Emulsion B

<Preparation of Tabular Silver Iodide Emulsion>

A solution was prepared by adding 2.3 mL of a 10% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 78° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 38 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 60 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 40 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 9.0.

The silver halide emulsion was a pure silver iodide emulsion, and the obtained silver halide grains had a mean projected area equivalent diameter of 1.35 μm, a variation coefficient of a projected area equivalent diameter distribution of 18.5%, a mean thickness of 0.110 μm, and a mean aspect ratio of 12.3. Tabular grains having an aspect ratio of 2 or more occupied 76% or more of the total projected area. The mean equivalent spherical diameter of the grains was 0.69 μm. 90% or more of the silver iodide existed in γ phase from the result of powder X-ray diffraction analysis.

<Preparation of Epitaxial Portion>

1 mol of the tabular silver iodide emulsion described above was added to the reaction vessel. At 30° C., 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form. During the operation, the silver potential was kept at +100 mV.

Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide and then the pAg was adjusted to 6.5.

<Chemical Sensitization>

The above-mentioned silver halide dispersion was kept at 38° C. with stirring, and thereto was added 5 mL of a 0.34% by weight methanol solution of 1,2-benzisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion B.

<Preparations of Emulsion 21 to 37 for Coating Solution>

The silver halide emulsion B described above was dissolved at 40° C., and thereto was added benzothiazolium iodide in a 1% by weight aqueous solution at $7\times10^{-3}$ mol per 1 mol of silver.

Further, water was added thereto to give the content of silver halide of 38.2 g in terms of silver, per 1 kg of the emulsion for a coating solution. 1-(3-methylureidophenyl)-5-mercaptotetrazole was added to give 0.34 g per 1 kg of the emulsion for coating solution.

Further, as shown in Table 3, "a compound that can be one-electron-oxidized to provide a one-electron oxidation product, which releases one or more electrons", "an adsorptive redox compound having an adsorptive group to silver halide and a reducing group in a molecule", comparative compound 1, or comparative compound 2 were added in an amount of $2\times10^{-4}$ mol per 1 mol of silver in silver halide.

TABLE 3

| Emulsion for Coating Solution No. | Electron Releasing Compound | Adsorptive Redox Compound | Note |
|---|---|---|---|
| 21 | — | — | Comparative |
| 22 | Comparative Compound 1 | — | Comparative |
| 23 | — | Comparative Compound 2 | Comparative |
| 24 | 10 | — | Invention |
| 25 | 21 | — | Invention |
| 26 | 22 | — | Invention |
| 27 | 28 | — | Invention |
| 28 | 36 | — | Invention |
| 29 | 37 | — | Invention |
| 30 | — | 14 | Invention |
| 31 | — | 19 | Invention |
| 32 | — | 30 | Invention |
| 33 | — | 71 | Invention |
| 34 | — | 76 | Invention |
| 35 | — | 93 | Invention |
| 36 | 21 | 71 | Invention |
| 37 | 27 | 19 | Invention |

3. Preparations of Black and White Photothermographic Material

1) Coating Solution 21 to 37 for Image Forming Layer

Similar to Example 1, the aqueous solution of gelatin, the pigment-1 dispersion, the silver iodide complex-forming agent solution described below, the hydrogen bonding compound-1 dispersion, the development accelerator-1 dispersion, the development accelerator-2 dispersion, the color-tone-adjusting agent-1 dispersion, the reducing agent solution, the toner dispersion, the mercapto compound aqueous solutions, the thermal solvent solutions, and the nucleator dispersion described below were serially added to the dispersion of silver salt of benzotriazole in an amount of 1000 g. The silver halide emulsion for coating solution was added thereto in an amount of 0.26 mol per 1 mol of non-photosensitive organic silver salt, followed by thorough mixing just prior to the coating, which was fed directly to a coating die.

<Preparation of Silver Iodide Complex-forming Agent Solution>

8 kg of modified polyvinyl alcohol MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of compound No. 22 as a silver iodide complex-forming agent. Accordingly, a 5% by weight solution of silver iodide complex-forming agent compound was prepared.

<Preparation of Nucleator Dispersion>

2.5 g of polyvinyl alcohol (manufactured by Kuraray Co., Ltd., PVA-217) and 87.5 g of water are added to 10 g of nucleator SH-7, and thoroughly admixed to give a slurry. This slurry is allowed to stand for 3 hours. Zirconia beads having a mean particle diameter of 0.5 mm are provided in an amount of 240 g, and charged in a vessel with the slurry. Dispersion is performed with a dispersing machine (1/4G sand grinder mill: manufactured by AIMEX Co., Ltd.) for 10 hours to obtain a solid fine particle dispersion of nucleator. Particles of the nucleator included in the resulting nucleator dispersion have a mean particle diameter of 0.5 μm, and 80% by weight of the particles has a particle diameter of 0.1 μm to 1.0 μm.

2) Coating

Simultaneous overlaying coating by a slide bead coating method was subjected on the undercoated face in order of the image forming layer, intermediate layer, first layer of the surface protective layers, and second layer of the surface protective layers, and thus sample of black and white photothermographic material-21 to -37 were produced. In this method, the temperature of the coating solution was adjusted to 31° C. for the image forming layer and intermediate layer, to 36° C. for the first layer of the surface protective layers, and to 37° C. for the second layer of the surface protective layers. After drying, reverse surface with respect to the support was coated similarly to obtain a double-sided type photosensitive material.

The amount of coated silver was 0.861 g/m$^2$ per one side, with respect to the sum of non-photosensitive organic silver salt and silver halide. And, the amount of coated silver was 1.72 g/m$^2$ with respect to the sum of coated silver on both sides.

The coating amount of each compound (g/m$^2$) for the image forming layer per one side is as follows.

| | |
|---|---|
| Silver salt of benzotriazole (on the basis of Ag content) | 0.686 |
| Gelatin | 3.5 |
| Pigment (C.I. Pigment Blue 60) | 0.036 |
| Triazole compound No. T-59 | 0.04 |
| Triazole compound No. T-3 | 0.04 |
| Silver iodide complex-forming agent | 0.46 |
| Ascorbic acid | 1.1 |
| Nucleator | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Thermal solvent: 1,3-dimethlyurea | 0.24 |
| Thermal solvent: succinimide | 0.08 |
| Silver halide (on the basis of Ag content) | 0.175 |

Conditions for coating and drying were as follows.

The support was decharged by ionic wind. Coating was performed at the speed of 160 m/min.

Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared black and white photothermographic material had a matt degree of 250 seconds as Beck's smoothness. In addition, measurement of the pH of the film surface gave the result of 6.0.

4. Evaluation of Photographic Properties 4-1. Preparation

The resulting sample was cut into a half-cut size, and was wrapped with the following packaging material under an environment of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by weight:

oxygen permeability at 25° C.: 0.02 mL·atm$^{-1}$m$^{-2}$day$^{-1}$, vapor permeability at 25° C.: 0.10 g·atm$^{-1}$m$^{-2}$day$^{-1}$.

4-2. Preparation of Fluorescent Intensifying Screen A (1) Undercoating

A light reflecting layer comprising alumina powder was coated on a polyethylene terephthalate film (support) having a thickness of 250 μm in a similar manner to the Example 4 in JP-A. No. 2001-124898. The light reflecting layer which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 1001) and 0.5 g of isocyanate compounds (manufactured by Nippon Polyurethane Industry Co., Ltd., trade name: CORONATE HX) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 kgw/cm$^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

The emission spectrum of the intensifying screen A was measured by X-ray at 40 kVp and is shown in FIG. 1. The fluorescent intensifying screen A showed an emission having a peak at 390 nm and a narrow half band width.

4-3. Exposure and Thermal Development

Two sheets of the aforementioned fluorescent intensifying screen A were used. The assembly for image formation was provided by inserting the sample between them. This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E. After exposure, the samples were thermally developed under the following thermal developing process condition.

The thermal developing section of Fuji Medical Dry Laser Imager FM-DP L was modified so that it can heat from both sides, and by another modification the conveying rollers in the thermal developing section were changed to the heating drum so that the sheet of film could be conveyed. The temperatures of four panel heaters were set to 112° C.-118° C.-120° C.-120° C., and the temperature of the heating drum was set to 120° C. Total time period for thermal development was set to be 24 seconds in total.

4-4. Terms for Evaluation

Fog: The density of the unexposed part is expressed as fog.

Sensitivity: Sensitivity is shown in a relative value, detecting the sensitivity of Sample No. 21 to be 100.

Dmax: Dmax is a maximum density obtained by increasing the exposure valus.

Average gradient: Average gradient is gradient of a straight line connecting the points at fog+(optical density of 0.25) and fog+(optical density of 2.0) on the photographic characteristic curve (i.e., the value equals tan θ when the angle between the line and the horizontal axis is θ).

Color tone of developed silver images: The sample was subjected to X-ray exposure using a chest phantom image while adjusting the exposure value to give a proper density (D=1.8) for lung field image portion. The color tone of overall developed silver images was evaluated from the overall chest phantom image by visual observation.

◎: cold black tone, good level in practical use in the market.

○: cold black to slightly magenta tint, but acceptable level for practical use.

Δ: clear magenta tint, not acceptable level in the market.

Evaluation of image storability (print-out): The image samples obtained by thermally developing Samples Nos. 21 to 37 were left for 5 days under an illumination condition of fluorescent lamp of 6000 Lux at 40° C. and 50% RH. Thereafter, the optical density of an unexposed part was measured. The obtained density was denoted as $Dmin_2$ and a density of the unexposed part before leaving under a fluorescent lamp was denoted as $Dmin_1$, and then the difference (ΔDmin) between $Dmin_2$ and $Dmin_1$ was calculated as follows;

$$\Delta Dmin = Dmin_2 - Dmin_1$$

Raw stock storability: Samples sealed in the said packaging materials were stored in the accelerated storage condition at 45° C. for 7 days, and then subjected to imagewise exposure and thermal development. The samples were evaluated about the sensitivity change by comparing with the sample stored in a refrigerator.

Raw stock storability (Sensitivity change)=−log ((Sensitivity of the sample stored in the accelerated storage condition for 7 days at 45° C.)/(Sensitivity of the samples stored in a refrigerator))

4-5. Results of Evaluation

The obtained results are shown in Table 4.

From the results shown in Table 4, it is revealed that the black and white photothermographic materials of the present invention have high sensitivity and low fog, and also exhibit excellent quality in color tone of developed silver images, raw stock storability, and print-out resistance.

TABLE 4

| Sample No. | Silver Halide Emulsion No. | Fog | Sensitivity | Dmax | Gradation | Difference in Color Tone of Developed Silver Images | Raw Stock Storability | Print-out Resistance | Note |
|---|---|---|---|---|---|---|---|---|---|
| 21 | 21 | 0.25 | 100 | 2.6 | 1.4 | Δ | 0.45 | 0.04 | Comparative |
| 22 | 22 | 0.29 | 55 | 2.4 | 1.6 | Δ | 0.35 | 0.05 | Comparative |
| 23 | 23 | 0.28 | 40 | 2.2 | 1.8 | Δ | 0.42 | 0.04 | Comparative |
| 24 | 24 | 0.20 | 300 | 2.9 | 3.0 | ○ | 0.05 | 0.01 | Invention |
| 25 | 25 | 0.21 | 361 | 3.3 | 3.3 | ◎ | 0.04 | 0.00 | Invention |
| 26 | 26 | 0.20 | 308 | 3.1 | 3.1 | ○ | 0.04 | 0.01 | Invention |
| 27 | 27 | 0.19 | 337 | 3.0 | 3.0 | ○ | 0.05 | 0.01 | Invention |
| 28 | 28 | 0.20 | 321 | 3.2 | 2.9 | ○ | 0.05 | 0.00 | Invention |
| 29 | 29 | 0.22 | 252 | 3.0 | 3.0 | ○ | 0.06 | 0.00 | Invention |
| 30 | 30 | 0.20 | 290 | 3.1 | 3.1 | ○ | 0.04 | 0.01 | Invention |
| 31 | 31 | 0.20 | 336 | 3.3 | 3.2 | ◎ | 0.04 | 0.00 | Invention |
| 32 | 32 | 0.19 | 307 | 2.9 | 2.8 | ○ | 0.03 | 0.01 | Invention |
| 33 | 33 | 0.19 | 370 | 3.3 | 3.3 | ◎ | 0.04 | 0.00 | Invention |
| 34 | 34 | 0.20 | 363 | 2.9 | 2.8 | ○ | 0.03 | 0.01 | Invention |

TABLE 4-continued

| Sample No. | Silver Halide Emulsion No. | Fog | Sensitivity | Dmax | Gradation | Difference in Color Tone of Developed Silver Images | Raw Stock Storability | Print-out Resistance | Note |
|---|---|---|---|---|---|---|---|---|---|
| 35 | 35 | 0.21 | 301 | 3.0 | 2.9 | ○ | 0.05 | 0.01 | Invention |
| 36 | 36 | 0.20 | 385 | 3.5 | 3.3 | ◎ | 0.02 | 0.00 | Invention |
| 37 | 37 | 0.19 | 393 | 3.4 | 3.3 | ◎ | 0.02 | 0.00 | Invention |

Example 3

1. Preparations of Coating Material

1) Preparation of Silver Halide Emulsion C

A tabular silver iodobromide emulsion was prepared.

(Grain Formation)

1178 mL of an aqueous solution prepared by dissolving 0.8 g of potassium bromide and 3.2 g of acid-treated gelatin having an average molecular weight of 20,000 was stirred while maintaining the temperature at 35° C. An aqueous solution containing 1.6 g of silver nitrate, an aqueous solution containing 1.16 g of potassium bromide, and an aqueous solution containing 1.1 g of acid-treated gelatin having an average molecular weight of 20,000 were added to the mixture over a period of 45 seconds by the method of triple jet addition. The concentration of the silver nitrate solution was 0.3 mol/L. Thereafter, the temperature of the mixture was increased to 76° C. over a period of 20 minutes. And then an aqueous solution containing 26 g of succinated gelatin having an average molecular weight of 100,000 was added thereto. An aqueous solution containing 209 g of silver nitrate and the aqueous potassium bromide solution were added by controlled double jet method at an accelerated flow rate over a period of 75 minutes while keeping the pAg at 8.0. For the stage where the grain growth reached to an equivalent to 30 mol % to 90 mol % with respect to total silver amount, silver iodide fine grain having a diameter of 0.03 μm was concurrently added to make the iodide content to a concentration of 6 mol %. The entire amount of potassium hexachloroiridate (III) was added thereto to give a concentration of $2\times10^{-5}$ mol % per 1 mol of silver at 30 minutes after starting the addition of the aqueous silver nitrate solution and the aqueous potassium bromide solution. After addition of gelatin having an average molecular weight of 100,000, the mixture was desalted according to the conventional method. Thereafter, the mixture was dispersed by adding gelatin having an average molecular weight of 100,000. The pH and pAg of the resulting emulsion was then adjusted to 5.8 and 8.0 at 40° C., respectively. Thus prepared emulsion contained 1 mol of silver and 40 g of gelatin per 1 kg of emulsion.

(Chemical Sensitization)

The emulsion prepared above was stirred and subjected to chemical sensitization while keeping the temperature at 56° C. Thiosulfonate compound-1 set forth below was added in an amount of $10^{-4}$ mol per 1 mol of silver halide, and then silver iodide grain having a diameter of 0.03 μm was added thereto in an amount of 0.15 mol %, based on the total silver amount. Three minutes later, thiourea dioxide was added in an amount of $1\times10^{-6}$ mol per 1 mol of silver and was subjected to reduction sensitization while keeping the temperature for 22 minutes. Thereafter, 4-hydroxy-6-methyl-1,3,3a,7-tetrazaindene was added in an amount of $3\times10^{-4}$ mol equivalent per 1 mol of silver halide, and sensitizing dye-1, -2, and -3 were added in an amount of $1\times10^{-4}$ mol equivalent per 1 mol of silver halide, respectively. Furthermore, calcium chloride was added thereto.

Sequentially, sodium thiosulfate and selenium compound-1 were added in an amount of $6\times10^{-6}$ mol equivalent, and $4\times10^{-6}$ mol equivalent per 1 mol of silver halide, respectively. After the addition, chloroauric acid was added in an amount of $2\times10^{-3}$ mol equivalent per 1 mol of silver halide. Further, nucleic acid (RNA-F, trade name, available from Sanyo-Kokusaku Pulp Co., Ltd.) was added thereto in an amount of 67 mg equivalent per 1 mol of silver halide. 40 minutes later, water-soluble mercapto compound-1 was added in an amount of $1\times10^{-4}$ mol equivalent per 1 mol of silver halide, and the mixture was then cooled to 35° C. Thereby, chemical sensitization was finished to obtain silver halide emulsion C.

Chemical sensitization was conducted similar to emulsion A, adjusting the amount of chemical sensitizer so as to show an optimum photographic property.

(Shape of Obtained Grains)

The obtained tabular silver halide grains were tabular silver iodobromide grains having an average iodide content of 3.75 mol %, and 30 mol % to 90 mol % of total silver amount had an iodide content of 6 mol %. The shape of the prepared grains was observed by an electron microscope. The grains had a mean projected area equivalent diameter of 1.004 μm, a mean equivalent spherical diameter of 0.420 μm, a mean grain thickness of 0.049 μm, a mean aspect ratio of 21, and a variation coefficient of a projected area equivalent diameter distribution of 21%.

<Preparation of Silver Halide Emulsion C for Coating Solution>

The silver halide emulsion C was dissolved at 40° C. and thereto was added benzothiazolium iodide in a 1% by weight aqueous solution at $7\times10^{-3}$ mol per 1 mol of silver.

Further, water was added thereto to give the content of silver halide of 38.2 g in terms of silver, per 1 kg of the emulsion for a coating solution. 1-(3-methylureidophenyl)-5-mercaptotetrazole was added to give 0.34 g per 1 kg of the emulsion for a coating solution.

Further, similar to Example 2, "a compound that can be one-electron-oxidized to provide a one-electron oxidation product, which releases one or more electrons", "an adsorptive redox compound having an adsorptive group to silver halide and a reducing group in a molecule", comparative compound 1, or comparative compound 2 were added in an amount of $2\times10^{-4}$ mol per 1 mol of silver in silver halide.

2) Preparation of Coating Solution for Image forming Layer

Preparation of coating solution for image forming layer was conducted in a similar manner to the process in the preparation of coating solution for image froming layer of Example 2, except that using silver halide emulsion C for coating solution instead of using silver halide emulsion B for coating solution.

3) Preparation of Coating Solution for Crossover Cut Layer 17 g of polyvinyl alcohol PVA-205 (manufactured by Kuraray Co., Ltd.), 9.6 g of polyacrylamide, 70 g of the dispersion solution of the solid fine particles of the base precursor similar to Example 1, 56 g of the dispersion solution of the solid fine particles of the orthochromatic thermal bleaching dye, 0.03 g of benzisothiazolinone, 2.2 g of poly(sodium styrenesulfonate), and 844 mL of water were admixed to give a coating solution for the crossover cut layer.

The coating solution for the crossover cut layer was fed to the coating station by controlling the flow speed of the coating solution to give the coating amount of solid content of the orthochromatic thermal bleaching dye of 0.04 g/m$^2$.

Orthochromatic thermal bleaching dye-1

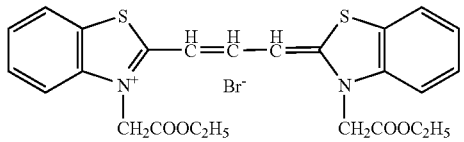

Thiosulfonate compound-1

$C_2H_5SO_2SNa$

Selenium compound-1

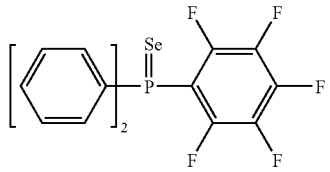

Water-soluble mercapto compound-1

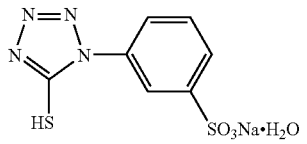

Sensitizing dye-1

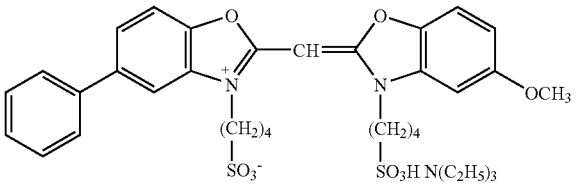

Sensitizing dye-2

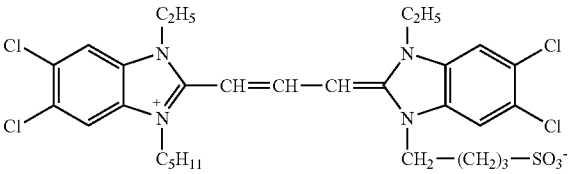

Sensitizing dye-3

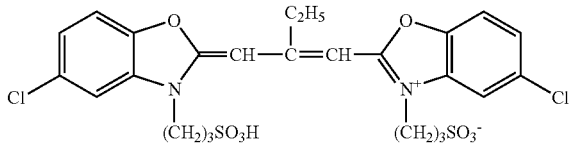

2. Preparations of Coated Sample

Simultaneous overlaying coating by a slide bead coating method was subjected in order of the crossover cut layer, image forming layer, intermediate layer, first layer of the surface protective layers, and second layer of the surface protective layers, on the undercoated support same as that of Example 2, and thus sample of black and white photothermographic material was produced. In this method, the temperature of the coating solution was adjusted to 31° C. for the image forming layer and intermediate layer, to 36° C. for the first layer of the surface protective layers, and to 37° C. for the second layer of the surface protective layers. After drying, reverse surface with respect to the support was coated similarly to obtain a double-sided type photosensitive material.

3. Evaluation of Photographic Properties

Thus prepared double-sided coated photothermographic material was evaluated as follows.

Two sheets of X-ray orthochomatic screen HG-M (using as fluorescent substance a terbium activated gadolinium oxysulfide fluorescent substance, emission peak wavelength of 545 nm) produced by Fuji Photo Film Co., Ltd. were used. The assembly for image formation was provided by inserting the sample between them. This assembly was subjected to X-ray exposure for 0.05 seconds, and then X-ray sensitometry is performed. The X-ray apparatus used was DRX-3724HD (trade name) produced by Toshiba Corp., and a tungsten target tube was used. X-ray emitted by a pulse generator operated at three phase voltage of 80 kVp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E. After exposure, the samples were thermally developed under the following thermal developing process condition. Evaluation on an obtained image was performed with a densitometer.

Other than these, evaluation was performed similar to Example 2.

4. Results of Evaluation

Similar to Example 2, the black and white photothermographic materials of the present invention have high sensitivity and low fog, and also exhibit excellent quality in color tone of developed silver images, raw stock storability, and print-out resistance.

Example 4

1. Preparation of Comparative Dispersion of Organic Silver Salt

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Behenate>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant.

In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

2. Preparations of Coating Material

Sample Nos. 41 and 42 were prepared in a similar manner to the process in the preparations of Sample Nos. 36 and 37 of Example 2, except that using the dispersion of behenic acid described above instead of using silver salt of benzotriazole as the non-photosensitive organic silver salt in the same amount on the basis of Ag content.

3. Evaluation of Photographic Properties

Sample Nos. 36, 37, 41, and 42 were evaluated about photographic properties similar to Example 2 and about granularity.

(Evaluation Method of Granularity)

The sample was subjected to X-ray exposure using a chest phantom image while adjusting the exposure value to give a proper density (D=1.8) for lung field image portion. Granularity of lung field image portion of chest phantom images was evaluated by visual observation.

○: excellent in granularity, excellent in practical use in medical diagnosis.

Δ: granular roughness can be observed, but acceptable level for practical use in the market.

X: granular roughness is large, not acceptable level in the market.

The obtained results are shown in Table 5. From the results, it is revealed that the comparative black and white photothermographic materials in which silver behenate is used have high fog and a problem in granularity, but the black and white photothermographic material of the present invention have excellent properties in sensitivity, fog, and granularity balance.

TABLE 5

| Sample No. | Organic Silver Salt | Electron Releasing Compound | Adsorptive Redox Compound | Fog | Sensitivity | Granularity | Note |
|---|---|---|---|---|---|---|---|
| 36 | Silver benzotriazole | 21 | 71 | 0.20 | 385 | ○ | Invention |
| 37 | Silver benzotriazole | 27 | 19 | 0.19 | 393 | ○ | Invention |
| 41 | Silver behenate | 21 | 71 | 0.26 | 405 | X | Comparative |
| 42 | Silver behenate | 27 | 19 | 0.23 | 415 | X | Comparative |

What is claimed is:

1. A black and white photothermographic material comprising an image forming layer on at least one side of a support comprising at least a photosensitive silver halide, a non-photosensitive organic silver salt, a reducing agent for silver ions, and a binder, wherein:

the non-photosensitive organic silver salt comprises at least one compound selected from a silver salt of an azole compound or a silver salt of a mercapto compound;

an average silver iodide content of the photosensitive silver halide is 40 mol % or higher;

and the photothermographic material further comprises a silver iodide complex-forming agent which substantially reduces visible light absorption by photosensitive silver halide after thermal development;

and the photothermographic material further comprises at least one selected from a compound that can be one-electron-oxidized to provide a one-electron oxidation product which releases one or more electrons or an adsorptive redox compound having a group adsorbable to the silver halide and a reducing group in a molecule, wherein the compound that can be one-electron-oxidized to provide a one-electron oxidation product which releases one or more electrons, is at least one compound selected from the following Group 1 or Group 2:

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction, and the adsorptive redox compound is represented by the following formula (I):

$$A\text{-}(W)_n\text{—}B \qquad \text{Formula (I)}$$

wherein: A represents a group adsorbable to a silver halide; W represents a divalent linking group; n represents 0 or 1; and B represents a reducing group.

2. The black and white photothermographic material according to claim 1, which comprises the compound that can be one-electron-oxidized to provide a one-electron oxidation product which releases one or more electrons, wherein the compound that can be one-electron-oxidized to provide a one-electron oxidation product which releases one or more electrons, is at least one compound selected from the following Group 1 or Group 2:

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction and the adsorptive redox compound is represented by the following formula (I):

$$A\text{-}(W)_n\text{—}B \qquad \text{Formula (I)}$$

wherein: A represents a group adsorbable to a silver halide; W represents a divalent linking group; n represents 0 or 1; and B represents a reducing group.

3. The black and white photothermographic material according to claim 1, wherein the compounds of Groups 1 and 2 are the compounds containing in a molecule a group adsorbable to a silver halide, or a group with a partial structure of a spectral sensitizing dye.

4. The black and white photothermographic material according to claim 1, wherein 50% or more of the total projected area of the photosensitive silver halide is occupied by tabular grains having an aspect ratio of 2 or more.

5. The black and white photothermographic material according to claim 4, wherein 50% or more of the total projected area of the photosensitive silver halide is occupied by tabular grains having an aspect ratio of 5 or more.

6. The black and white photothermographic material according to claim 4, wherein the tabular grains having an aspect ratio of 2 or more have a mean equivalent spherical diameter of 0.3 μm to 8.0 μm.

7. The black and white photothermographic material according to claim 1, wherein the silver salt of an azole compound is a silver salt of a nitrogen-containing heterocyclic compound.

8. The black and white photothermographic material according to claim 7, wherein the silver salt of the nitrogen-containing heterocyclic compound is at least one compound selected from a silver salt of a triazole compound or a silver salt of a tetrazole compound.

9. The black and white photothermographic material according to claim 8, wherein the silver salt of a triazole compound is a silver salt of a benzotriazole compound.

10. The black and white photothermographic material according to claim 1, wherein the silver salt of a mercapto compound is at least one compound selected from a silver salt of an aliphatic mercapto compound or a silver salt of a heterocyclic mercapto compound.

11. The black and white photothermographic material according to claim 10, wherein the non-photosensitive organic silver salt is a silver salt of an aliphatic mercapto compound having 10 or more carbon atoms.

12. The black and white photothermographic material according to claim 1, wherein 50% by weight or more of the binder is formed by a hydrophilic binder.

13. The black and white photothermographic material according to claim 12, wherein the hydrophilic binder is at least one binder selected from gelatin or a derivative thereof.

14. The black and white photothermographic material according to claim 1, wherein 50% by weight or more of the binder is formed by a polymer latex.

15. The black and white photothermographic material according to claim 1, wherein the reducing agent for silver ions is at least one agent selected from ascorbic acid or a derivative thereof.

16. The black and white photothermographic material according to claim 1, which further comprises as a toner at least one compound selected from mercapto triazole or a derivative thereof.

17. The black and white photothermographic material according to claim 1, which comprises a nucleator and has an average gradient on a photographic characteristic curve of from 1.8 to 4.3.

18. The black and white photothermographic material according to claim 1, wherein the average silver iodide content of the photosensitive silver halide is 80 mol % or higher.

19. The black and white photothermographic material according to claim 18, wherein the silver iodide content of the photosensitive silver halide is 90 mol % or higher.

20. The black and white photothermographic material according to claim 1, which comprises the image forming layer on both sides of the support.

21. An image forming method using the black and white photothermographic material according to claim 1, which comprises:

(a) providing an assembly for forming an image by placing the black and white photothermographic material between a pair of fluorescent intensifying screens;

(b) putting an analyte between the assembly and an X-ray source;

(c) irradiating the analyte with X-rays having an energy level in a range of 25 kVp to 125 kVp;

(d) taking the black and white photothermographic material out of the assembly; and, (e) heating the removed black and white photothermographic material in a temperature range of 90° C. to 180° C.

22. The image forming method according to claim 21, wherein the fluorescent intensifying screen contains a fluorescent substance in which 50% or more of the emission light has a wavelength region from 350 nm to 420 nm.

23. The image forming method according to claim 22, wherein the fluorescent substance is a divalent Eu-activated fluorescent substance.

24. The image forming method according to claim 23, wherein the fluorescent substance is a divalent Eu-activated barium halide fluorescent substance.

* * * * *